US010224042B2

(12) United States Patent
Chebiyyam et al.

(10) Patent No.: US 10,224,042 B2
(45) Date of Patent: Mar. 5, 2019

(54) ENCODING OF MULTIPLE AUDIO SIGNALS

(71) Applicant: QUALCOMM Incorporated, San Diego, CA (US)

(72) Inventors: Venkata Subrahmanyam Chandra Sekhar Chebiyyam, San Diego, CA (US); Venkatraman Atti, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/711,538

(22) Filed: Sep. 21, 2017

(65) Prior Publication Data

US 2018/0122385 A1 May 3, 2018

Related U.S. Application Data

(60) Provisional application No. 62/415,369, filed on Oct. 31, 2016.

(51) Int. Cl.
*H04R 5/00* (2006.01)
*G10L 19/008* (2013.01)
(Continued)

(52) U.S. Cl.
CPC ..... *G10L 19/008* (2013.01); *G10L 19/0212* (2013.01); *G10L 21/055* (2013.01);
(Continued)

(58) Field of Classification Search
CPC ..... H04R 5/00
See application file for complete search history.

(56) References Cited

U.S. PATENT DOCUMENTS 6,973,184 B1 12/2005 Shaffer et al.
2007/0171944 A1* 7/2007 Schuijers ..... G10L 19/008 370/537

(Continued)

OTHER PUBLICATIONS

Dirk M., et al., "A Low Delay, Variable Resolution, Perfect Reconstruction Spectral Analysis-Synthesis System for Speech Enhancement", 2007 15th European Signal Processing Conference, IEEE, Sep. 3, 2007 (Sep. 3, 2007), pp. 222-226, XP032773138, ISBN: 978-83-921340-4-6 [retrieved on Apr. 30, 2015].

(Continued)

*Primary Examiner* — Olisa Anwah
(74) *Attorney, Agent, or Firm* — Toler Law Group, P.C.

(57) ABSTRACT

A device includes a receiver configured to receive an encoded bitstream from a second device. The encoded bitstream includes a temporal mismatch value determined based on a reference channel captured at the second device and a target channel captured at the second device. The device also includes a decoder configured to decode the encoded bitstream to generate a first frequency-domain output signal and a second frequency-domain output signal. The decoder is configured to perform inverse transform operations on the frequency-domain output signals to generate a first and second time-domain signals. Based on the temporal mismatch value, the decoder is configured to map the time-domain signals to a decoded target channel and a decoded reference channel. The decoder is also configured to perform a causal time-domain shift operation on the decoded target channel based on the temporal mismatch value to generate an adjusted decoded target channel.

30 Claims, 22 Drawing Sheets

(51) Int. Cl.

| | |
|---|---|
| ***G10L 19/02*** | (2013.01) |
| ***H04S 3/00*** | (2006.01) |
| ***H04S 1/00*** | (2006.01) |
| ***G10L 21/055*** | (2013.01) |
| *G10L 19/022* | (2013.01) |
| *G10L 19/26* | (2013.01) |

(52) U.S. Cl.
CPC ..... *H04S 1/007* (2013.01); *H04S 3/008* (2013.01); *G10L 19/022* (2013.01); *G10L 19/26* (2013.01); *H04S 2420/03* (2013.01)

(56) References Cited

U.S. PATENT DOCUMENTS

2007/0291951 A1* 12/2007 Faller ..... G10L 19/008 381/22
2008/0170711 A1* 7/2008 Breebaart ..... G10L 19/008 381/77
2010/0283639 A1 11/2010 Philippe et al.
2011/0096932 A1* 4/2011 Schuijers ..... G10L 19/008 381/22
2011/0288872 A1* 11/2011 Liu ..... G10L 19/008 704/500
2012/0224702 A1* 9/2012 Den Brinker ..... G10L 19/008 381/22
2012/0232912 A1* 9/2012 Tammi ..... G10L 19/008 704/502
2013/0030819 A1* 1/2013 Purnhagen ..... G10L 19/04 704/500
2013/0279702 A1* 10/2013 Lang ..... G10L 19/008 381/22
2015/0310871 A1* 10/2015 Vasilache ..... G10L 19/008 381/23
2016/0005407 A1* 1/2016 Friedrich ..... G10L 19/008 381/22
2016/0027445 A1* 1/2016 Vasilache ..... G10L 19/035 381/22
2016/0055855 A1* 2/2016 Kjoerling ..... G10L 19/008 704/500

OTHER PUBLICATIONS

International Search Report and Written Opinion—PCT/US2017/053040—ISA/EPO—dated Nov. 7, 2017.

* cited by examiner

ENCODING OF MULTIPLE AUDIO SIGNALS

I. CROSS REFERENCE TO RELATED APPLICATIONS

The present application claims the benefit of U.S. Provisional Patent Application No. 62/415,369, entitled "ENCODING OF MULTIPLE AUDIO SIGNALS," filed Oct. 31, 2016, which is expressly incorporated by reference herein in its entirety.

II. FIELD

The present disclosure is generally related to encoding of multiple audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include multiple microphones to receive audio signals. Generally, a sound source is closer to a first microphone than to a second microphone of the multiple microphones. Accordingly, a second audio signal received from the second microphone may be delayed relative to a first audio signal received from the first microphone due to the respective distances of the microphones from the sound source. In other implementations, the first audio signal may be delayed with respect to the second audio signal. In stereo-encoding, audio signals from the microphones may be encoded to generate a mid channel signal and one or more side channel signals. The mid channel signal may correspond to a sum of the first audio signal and the second audio signal. A side channel signal may correspond to a difference between the first audio signal and the second audio signal. The first audio signal may not be aligned with the second audio signal because of the delay in receiving the second audio signal relative to the first audio signal. The misalignment of the first audio signal relative to the second audio signal may increase the difference between the two audio signals. Because of the increase in the difference, a higher number of bits may be used to encode the side channel signal.

IV. SUMMARY

In a particular implementation, a device includes a receiver configured to receive an encoded bitstream from a second device. The encoded bitstream includes a temporal mismatch value and stereo parameters. The temporal mismatch value and the stereo parameters are determined based on a reference channel captured at the second device and a target channel captured at the second device. The device also includes a decoder configured to decode the encoded bitstream to generate a first frequency-domain output signal and a second frequency-domain output signal. The decoder is also configured to perform a first inverse transform operation on the first frequency-domain output signal to generate a first time-domain signal. The decoder is further configured to perform a second inverse transform operation on the second frequency-domain output signal to generate a second time-domain signal. The decoder is also configured to map one of the first time-domain signal or the second time-domain signal as a decoded target channel based on the temporal mismatch value. The decoder is further configured to map the other of the first time-domain signal or the second time-domain signal as a decoded reference channel. The decoder is also configured to perform a causal time-domain shift operation on the decoded target channel based on the temporal mismatch value to generate an adjusted decoded target channel. The device also includes an output device configured to output a first output signal and a second output signal. The first output signal is based on the decoded reference channel and the second output signal is based on the adjusted decoded target channel.

The device also includes a stereo decoder configured to decode the encoded bitstream to generate a decoded mid signal. The device further includes a transform unit configured to perform a transform operation on the decoded mid signal to generate a frequency-domain decoded mid signal. The device also includes an up-mixer configured to perform an up-mix operation on the frequency-domain decoded mid signal to generate the first frequency-domain output signal and the second frequency-domain output signal. The stereo parameters are applied to the frequency-domain decoded mid signal during the up-mix operation.

In another particular implementation, a method includes receiving, at a receiver of a device, an encoded bitstream from a second device. The encoded bitstream includes a temporal mismatch value and stereo parameters. The temporal mismatch value and the stereo parameters are determined based on a reference channel captured at the second device and a target channel captured at the second device. The method also includes decoding, at a decoder of the device, the encoded bitstream to generate a first frequency-domain output signal and a second frequency-domain output signal. The method also includes performing a first inverse transform operation on the first frequency-domain output signal to generate a first time-domain signal. The method further includes performing a second inverse transform operation on the second frequency-domain output signal to generate a second time-domain signal. The method also includes mapping one of the first time-domain signal or the second time-domain signal as a decoded target channel based on the temporal mismatch value. The method further includes mapping the other of the first time-domain signal or the second time-domain signal as a decoded reference channel. The method also includes outputting a first output signal and a second output signal. The first output signal is based on the decoded reference channel and the second output signal is based on the adjusted decoded target channel.

The method also includes decoding the encoded bitstream to generate a decoded mid signal. The method further includes performing a transform operation on the decoded mid signal to generate a frequency-domain decoded mid signal. The method also includes performing an up-mix operation on the frequency-domain decoded mid signal to generate the first frequency-domain output signal and the second frequency-domain output signal. The stereo parameters are applied to the frequency-domain decoded mid signal during the up-mix operation.

In another particular implementation, a non-transitory computer-readable medium includes instructions that, when executed by a processor within a decoder, cause the decoder to perform operations including decoding an encoded bitstream received from a second device to generate a first frequency-domain output signal and a second frequency-domain output signal. The encoded bitstream includes a temporal mismatch value and stereo parameters. The temporal mismatch value and the stereo parameters are determined based on a reference channel captured at the second device and a target channel captured at the second device. The operations also include performing a first inverse transform operation on the first frequency-domain output signal to generate a first time-domain signal. The operations also include performing a second inverse transform operation on the second frequency-domain output signal to generate a second time-domain signal. The operations also include mapping one of the first time-domain signal or the second time-domain signal as a decoded target channel based on the temporal mismatch value. The operations also include mapping the other of the first time-domain signal or the second time-domain signal as a decoded reference channel. The operations also include outputting a first output signal and a second output signal. The first output signal is based on the decoded reference channel and the second output signal is based on the adjusted decoded target channel.

The operations also includes decoding the encoded bitstream to generate a decoded mid signal. The operations further includes performing a transform operation on the decoded mid signal to generate a frequency-domain decoded mid signal. The operations also includes performing an up-mix operation on the frequency-domain decoded mid signal to generate the first frequency-domain output signal and the second frequency-domain output signal. The stereo parameters are applied to the frequency-domain decoded mid signal during the up-mix operation.

In another particular implementation, an apparatus includes means for receiving an encoded bitstream from a second device. The encoded bitstream includes a temporal mismatch value and stereo parameters. The temporal mismatch value and the stereo parameters are determined based on a reference channel captured at the second device and a target channel captured at the second device. The apparatus also includes means for decoding the encoded bitstream to generate a first frequency-domain output signal and a second frequency-domain output signal. The apparatus further includes means for performing a first inverse transform operation on the first frequency-domain output signal to generate a first time-domain signal. The apparatus also includes means for performing a second inverse transform operation on the second frequency-domain output signal to generate a second time-domain signal. The apparatus further includes means for mapping one of the first time-domain signal or the second time-domain signal as a decoded target channel based on the temporal mismatch value. The apparatus also includes means for mapping the other of the first time-domain signal or the second time-domain signal as a decoded reference channel. The apparatus further includes means for performing a causal time-domain shift operation on the decoded target channel based on the temporal mismatch value to generate an adjusted decoded target channel. The apparatus also include means for outputting a first output signal and a second output signal. The first output signal is based on the decoded reference channel and the second output signal is based on the adjusted decoded target channel.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

Figure 20:
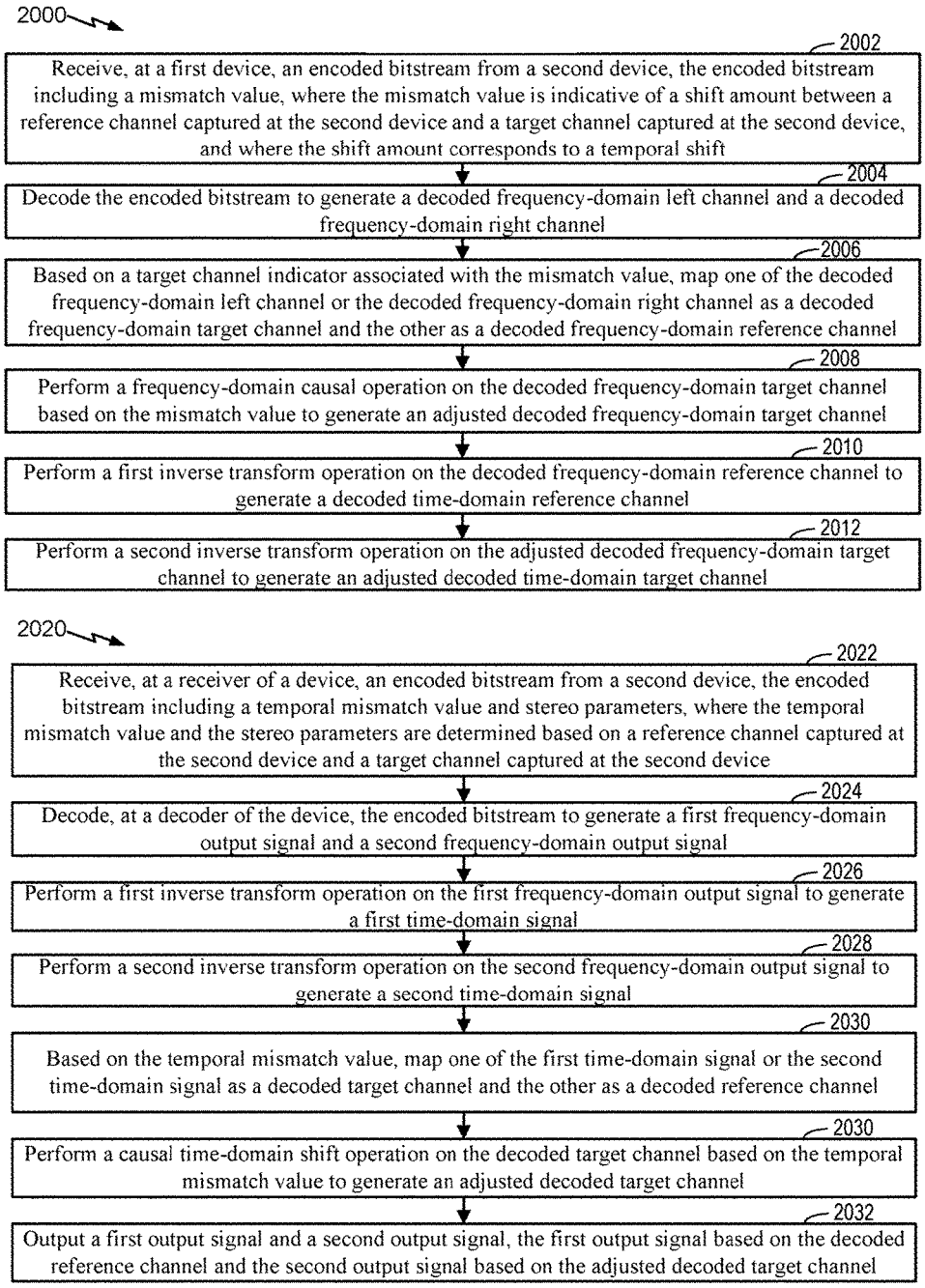
Figure 21:
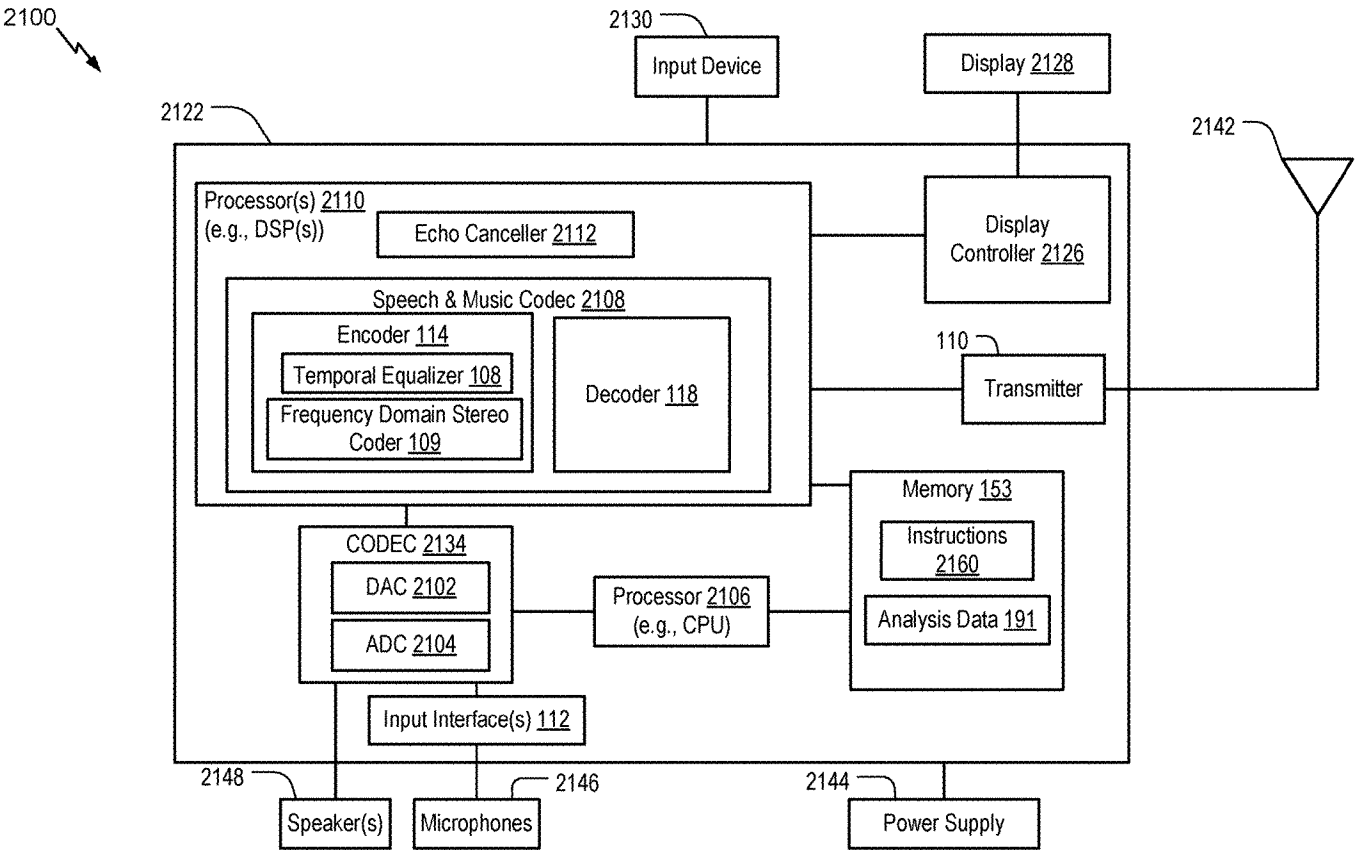
Figure 22:
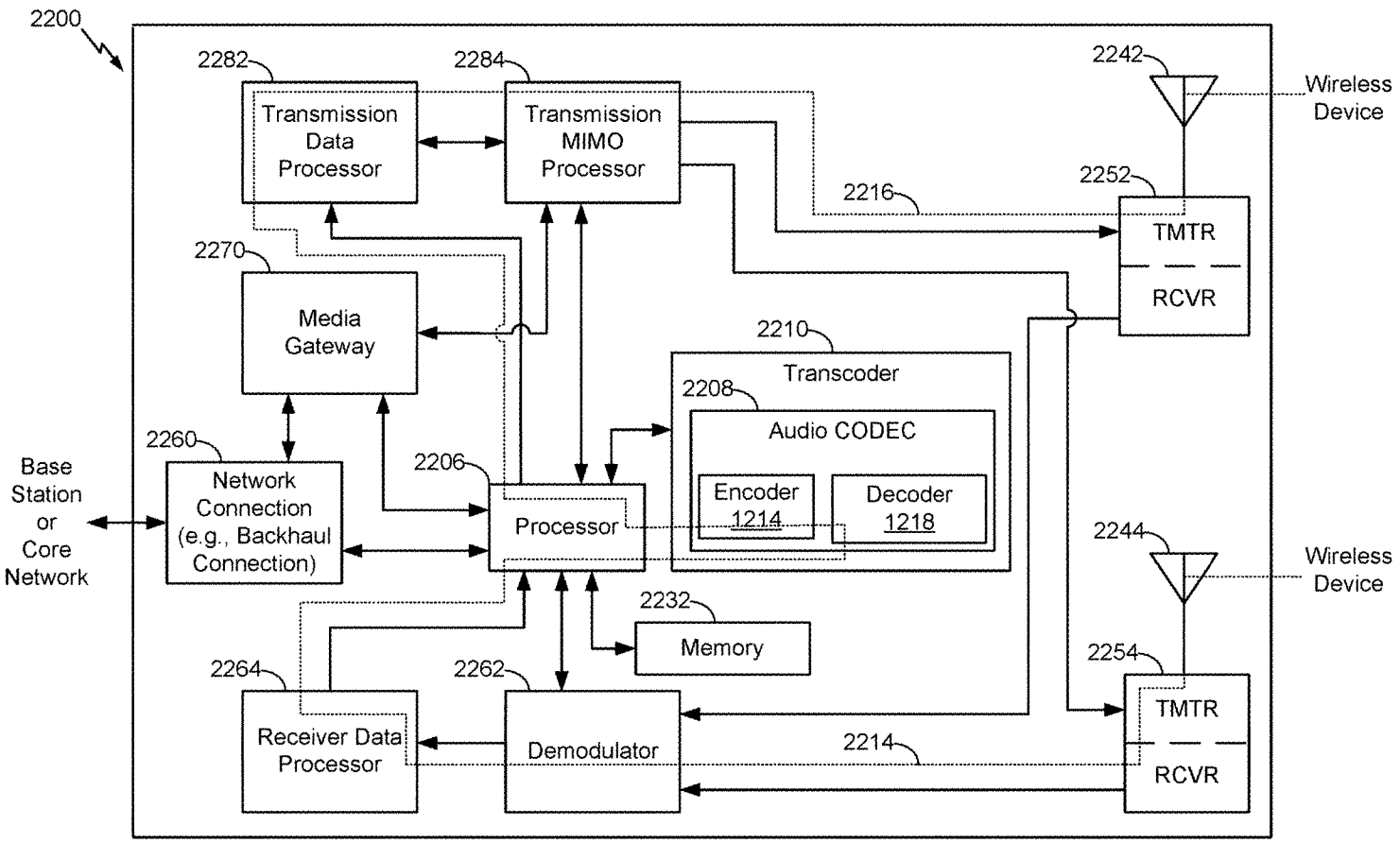

FIG. 20 include flow charts illustrating particular methods of decoding audio signals;

FIG. 21 is a block diagram of a particular illustrative example of a device that is operable to encode multiple audio signals; and FIG. 22 is a block diagram of a particular illustrative example of a base station.

VI. DETAILED DESCRIPTION

Systems and devices operable to encode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded in MS coding. Relatively more bits are spent on the sum signal than on the side signal. PS coding reduces redundancy in each sub-band by transforming the L/R signals into a sum signal and a set of side parameters. The side parameters may indicate an inter-channel intensity difference (IID), an inter-channel phase difference (IPD), an inter-channel time difference (ITD), etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2,\ S=(L-R)/2, \qquad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R),S=c(L-R), \qquad \text{Formula 2}$$

where c corresponds to a complex value which is frequency dependent.

Generating the Mid channel and the Side channel based on Formula 1 or Formula 2 may be referred to as performing a "downmixing" algorithm. A reverse process of generating the Left channel and the Right channel from the Mid channel and the Side channel based on Formula 1 or Formula 2 may be referred to as performing an "upmixing" algorithm.

In some cases, the Mid channel may be based other formulas such as:

$$M=(L+g_D R)/2, \text{ or} \qquad \text{Formula 3}$$

$$M=g_1 L+g_2 R \qquad \text{Formula 4}$$

where $g_1+g_2=1.0$, and where $g_D$ is a gain parameter. In other examples, the downmix may be performed in bands, where $mid(b)=c_1L(b)+c_2R(b)$, where $c_1$ and $c_2$ are complex numbers, where $side(b)=c_3L(b)-c_4R(b)$, and where $c_3$ and $c_4$ are complex numbers.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a temporal shift value indicative of a shift of the first audio signal relative to the second audio signal. The shift value may correspond to an amount of temporal delay between receipt of the first audio signal at the first microphone and receipt of the second audio signal at the second microphone. Furthermore, the encoder may determine the shift value on a frame-by-frame basis, e.g., based on each 20 milliseconds (ms) speech/audio frame. For example, the shift value may correspond to an amount of time that a second frame of the second audio signal is delayed with respect to a first frame of the first audio signal. Alternatively, the shift value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal delay value may also change from one frame to another. However, in some implementations, the shift value may always be positive to indicate an amount of delay of the "target" channel relative to the "reference" channel. Furthermore, the shift value may correspond to a "non-causal shift" value by which the delayed target channel is "pulled back" in time such that the target channel is aligned (e.g., maximally aligned) with the "reference" channel. The downmix algorithm to determine the mid channel and the side channel may be performed on the reference channel and the non-causal shifted target channel.

The encoder may determine the shift value based on the reference audio channel and a plurality of shift values applied to the target audio channel. For example, a first frame of the reference audio channel, X, may be received at a first time ($m_1$). A first particular frame of the target audio channel, Y, may be received at a second time ($n_1$) corresponding to a first shift value, e.g., $shift1=n_1-m_1$. Further, a second frame of the reference audio channel may be received at a third time ($m_2$). A second particular frame of the target audio channel may be received at a fourth time ($n_2$) corresponding to a second shift value, e.g., $shift2=n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a shift value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally not aligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, a time of arrival of audio signals at the microphones from multiple sound sources (e.g., talkers) may vary when the multiple talkers are alternatively talking (e.g., without overlap). In such a case, the encoder may dynamically adjust a temporal shift value based on the talker to identify the reference channel. In some other examples, the multiple talkers may be talking at the same time, which may result in varying temporal shift values depending on who is the loudest talker, closest to the microphone, etc.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular shift value. The encoder may generate a first estimated shift value based on the comparison values. For example, the first estimated shift value may correspond to a comparison value indicating a higher temporal-similarity (or lower difference) between the first frame of the first audio signal and a corresponding first frame of the second audio signal.

The encoder may determine the final shift value by refining, in multiple stages, a series of estimated shift values. For example, the encoder may first estimate a "tentative" shift value based on comparison values generated from stereo pre-processed and re-sampled versions of the first audio signal and the second audio signal. The encoder may generate interpolated comparison values associated with shift values proximate to the estimated "tentative" shift value. The encoder may determine a second estimated "interpolated" shift value based on the interpolated comparison values. For example, the second estimated "interpolated" shift value may correspond to a particular interpolated comparison value that indicates a higher temporal-similarity (or lower difference) than the remaining interpolated comparison values and the first estimated "tentative" shift value. If the second estimated "interpolated" shift value of the current frame (e.g., the first frame of the first audio signal) is different than a final shift value of a previous frame (e.g., a frame of the first audio signal that precedes the first frame), then the "interpolated" shift value of the current frame is further "amended" to improve the temporal-similarity between the first audio signal and the shifted second audio signal. In particular, a third estimated "amended" shift value may correspond to a more accurate measure of temporal-similarity by searching around the second estimated "interpolated" shift value of the current frame and the final estimated shift value of the previous frame. The third estimated "amended" shift value is further conditioned to estimate the final shift value by limiting any spurious changes in the shift value between frames and further controlled to not switch from a negative shift value to a positive shift value (or vice versa) in two successive (or consecutive) frames as described herein.

In some examples, the encoder may refrain from switching between a positive shift value and a negative shift value or vice-versa in consecutive frames or in adjacent frames. For example, the encoder may set the final shift value to a particular value (e.g., 0) indicating no temporal-shift based on the estimated "interpolated" or "amended" shift value of the first frame and a corresponding estimated "interpolated"

or "amended" or final shift value in a particular frame that precedes the first frame. To illustrate, the encoder may set the final shift value of the current frame (e.g., the first frame) to indicate no temporal-shift, i.e., shift1=0, in response to determining that one of the estimated "tentative" or "interpolated" or "amended" shift value of the current frame is positive and the other of the estimated "tentative" or "interpolated" or "amended" or "final" estimated shift value of the previous frame (e.g., the frame preceding the first frame) is negative. Alternatively, the encoder may also set the final shift value of the current frame (e.g., the first frame) to indicate no temporal-shift, i.e., shift1=0, in response to determining that one of the estimated "tentative" or "interpolated" or "amended" shift value of the current frame is negative and the other of the estimated "tentative" or "interpolated" or "amended" or "final" estimated shift value of the previous frame (e.g., the frame preceding the first frame) is positive.

The encoder may select a frame of the first audio signal or the second audio signal as a "reference" or "target" based on the shift value. For example, in response to determining that the final shift value is positive, the encoder may generate a reference channel or signal indicator having a first value (e.g., 0) indicating that the first audio signal is a "reference" signal and that the second audio signal is the "target" signal. Alternatively, in response to determining that the final shift value is negative, the encoder may generate the reference channel or signal indicator having a second value (e.g., 1) indicating that the second audio signal is the "reference" signal and that the first audio signal is the "target" signal.

The encoder may estimate a relative gain (e.g., a relative gain parameter) associated with the reference signal and the non-causal shifted target signal. For example, in response to determining that the final shift value is positive, the encoder may estimate a gain value to normalize or equalize the energy or power levels of the first audio signal relative to the second audio signal that is offset by the non-causal shift value (e.g., an absolute value of the final shift value). Alternatively, in response to determining that the final shift value is negative, the encoder may estimate a gain value to normalize or equalize the power levels of the non-causal shifted first audio signal relative to the second audio signal. In some examples, the encoder may estimate a gain value to normalize or equalize the energy or power levels of the "reference" signal relative to the non-causal shifted "target" signal. In other examples, the encoder may estimate the gain value (e.g., a relative gain value) based on the reference signal relative to the target signal (e.g., the unshifted target signal).

The encoder may generate at least one encoded signal (e.g., a mid signal, a side signal, or both) based on the reference signal, the target signal, the non-causal shift value, and the relative gain parameter. The side signal may correspond to a difference between first samples of the first frame of the first audio signal and selected samples of a selected frame of the second audio signal. The encoder may select the selected frame based on the final shift value. Fewer bits may be used to encode the side channel signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal shift value, the relative gain parameter, the reference channel or signal indicator, or a combination thereof.

The encoder may generate at least one encoded signal (e.g., a mid signal, a side signal, or both) based on the reference signal, the target signal, the non-causal shift value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid signal, a side signal, or both, of the first frame. Encoding the mid signal, the side signal, or both, based on the low band parameters, the high band parameters, or a combination thereof, may improve estimates of the non-causal shift value and inter-channel relative gain parameter. The low band parameters, the high band parameters, or a combination thereof, may include a pitch parameter, a voicing parameter, a coder type parameter, a low-band energy parameter, a high-band energy parameter, a tilt parameter, a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal shift value, the relative gain parameter, the reference channel (or signal) indicator, or a combination thereof.

In the present disclosure, terms such as "determining", "calculating", "shifting", "adjusting", etc. may be used to describe how one or more operations are performed. It should be noted that such terms are not to be construed as limiting and other techniques may be utilized to perform similar operations.

Figure 1:
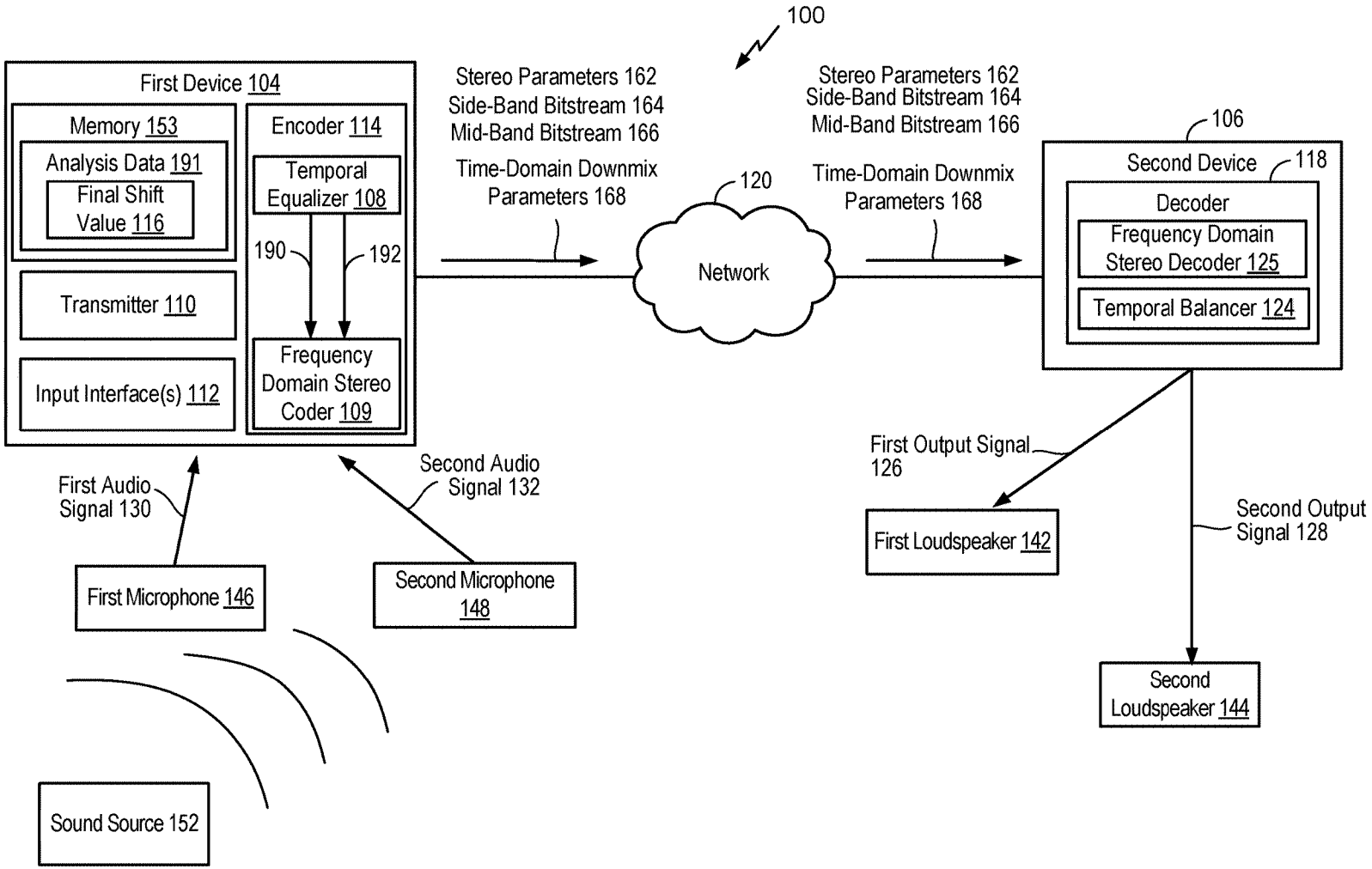
FIG. 1 is a block diagram of a particular illustrative example of a system that includes an encoder operable to encode multiple audio signals.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interfaces 112 may be coupled to a first microphone 146. A second input interface of the input interface(s) 112 may be coupled to a second microphone 148. The encoder 114 may include a temporal equalizer 108 and a frequency-domain stereo coder 109 and may be configured to downmix and encode multiple audio signals, as described herein. The first device 104 may also include a memory 153 configured to store analysis data 191. The second device 106 may include a decoder 118. The decoder 118 may include a temporal balancer 124 that is configured to upmix and render the multiple channels. The second device 106 may be coupled to a first loudspeaker 142, a second loudspeaker 144, or both.

During operation, the first device 104 may receive a first audio signal 130 via the first input interface from the first microphone 146 and may receive a second audio signal 132 via the second input interface from the second microphone 148. The first audio signal 130 may correspond to one of a right channel signal or a left channel signal. The second audio signal 132 may correspond to the other of the right channel signal or the left channel signal. A sound source 152 (e.g., a user, a speaker, ambient noise, a musical instrument, etc.) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio signal 130 and the second audio signal 132.

The temporal equalizer 108 may determine a final shift value 116 (e.g., a non-causal shift value) indicative of the shift (e.g., a non-causal shift) of the first audio signal 130 (e.g., "target") relative to the second audio signal 132 (e.g., "reference"). For example, a first value (e.g., a positive value) of the final shift value 116 may indicate that the second audio signal 132 is delayed relative to the first audio signal 130. A second value (e.g., a negative value) of the final shift value 116 may indicate that the first audio signal 130 is delayed relative to the second audio signal 132. A third value (e.g., 0) of the final shift value 116 may indicate no delay between the first audio signal 130 and the second audio signal 132.

In some implementations, the third value (e.g., 0) of the final shift value 116 may indicate that delay between the first audio signal 130 and the second audio signal 132 has switched sign. For example, a first particular frame of the first audio signal 130 may precede the first frame. The first particular frame and a second particular frame of the second audio signal 132 may correspond to the same sound emitted by the sound source 152. The delay between the first audio signal 130 and the second audio signal 132 may switch from having the first particular frame delayed with respect to the second particular frame to having the second frame delayed with respect to the first frame. Alternatively, the delay between the first audio signal 130 and the second audio signal 132 may switch from having the second particular frame delayed with respect to the first particular frame to having the first frame delayed with respect to the second frame. The temporal equalizer 108 may set the final shift value 116 to indicate the third value (e.g., 0), in response to determining that the delay between the first audio signal 130 and the second audio signal 132 has switched sign.

The temporal equalizer 108 may generate a reference signal indicator based on the final shift value 116. For example, the temporal equalizer 108 may, in response to determining that the final shift value 116 indicates a first value (e.g., a positive value), generate the reference signal indicator to have a first value (e.g., 0) indicating that the first audio signal 130 is a "reference" signal 190. The temporal equalizer 108 may determine that the second audio signal 132 corresponds to a "target" signal (not shown) in response to determining that the final shift value 116 indicates the first value (e.g., a positive value). Alternatively, the temporal equalizer 108 may, in response to determining that the final shift value 116 indicates a second value (e.g., a negative value), generate the reference signal indicator to have a second value (e.g., 1) indicating that the second audio signal 132 is the "reference" signal 190. The temporal equalizer 108 may determine that the first audio signal 130 corresponds to the "target" signal in response to determining that the final shift value 116 indicates the second value (e.g., a negative value). The temporal equalizer 108 may, in response to determining that the final shift value 116 indicates a third value (e.g., 0), generate the reference signal indicator to have a first value (e.g., 0) indicating that the first audio signal 130 is the "reference" signal 190. The temporal equalizer 108 may determine that the second audio signal 132 corresponds to the "target" signal in response to determining that the final shift value 116 indicates the third value (e.g., 0). Alternatively, the temporal equalizer 108 may, in response to determining that the final shift value 116 indicates the third value (e.g., 0), generate the reference signal indicator to have a second value (e.g., 1) indicating that the second audio signal 132 is the "reference" signal 190. The temporal equalizer 108 may determine that the first audio signal 130 corresponds to a "target" signal in response to determining that the final shift value 116 indicates the third value (e.g., 0). In some implementations, the temporal equalizer 108 may, in response to determining that the final shift value 116 indicates a third value (e.g., 0), leave the reference signal indicator unchanged. For example, the reference signal indicator may be the same as a reference signal indicator corresponding to the first particular frame of the first audio signal 130. The temporal equalizer 108 may generate a non-causal shift value indicating an absolute value of the final shift value 116.

The temporal equalizer 108 may generate a target signal indicator based on the target signal, the reference signal 190, a first shift value (e.g., a shift value for a previous frame), the final shift value 116, the reference signal indicator, or a combination thereof. The target signal indicator may indicate which of the first audio signal 130 or the second audio signal 132 is the target signal. The temporal equalizer 108 may generate an adjusted target signal 192 based on the target signal indicator, the target signal, or both. For example, the temporal equalizer 108 may adjust the target signal (e.g., the first audio signal 130 or the second audio signal 132) based on a temporal shift evolution from the first shift value to the final shift value 116. The temporal equalizer 108 may interpolate the target signal such that a subset of samples of the target signal that correspond to frame boundaries are dropped through smoothing and slow-shifting to generate the adjusted target signal 192.

Thus, the temporal equalizer 108 may time-shift the target signal to generate the adjusted target signal 192 such that the reference signal 190 and the adjusted target signal 192 are substantially synchronized. The temporal equalizer 108 may generate time-domain downmix parameters 168. The time-domain downmix parameters may indicate a shift value between the target signal and the reference signal 190. In other implementations, the time-domain downmix parameters may include additional parameters like a downmix gain etc. For example, the time-domain downmix parameters 168 may include a first shift value 262, a reference signal indicator 264, or both, as further described with reference to FIG. 2. The temporal equalizer 108 is described in greater detail with respect to FIG. 2. The temporal equalizer 108 may provide the reference signal 190 and the adjusted target signal 192 to the frequency-domain stereo coder 109, as shown.

The frequency-domain stereo coder 109 may transform one or more time-domain signals (e.g., the reference signal 190 and the adjusted target signal 192) into frequency-domain signals. The frequency-domain signals may be used to estimate stereo parameters 162. The stereo parameters 162 may include parameters that enable rendering of spatial properties associated with left channels and right channels. According to some implementations, the stereo parameters 162 may include parameters such as inter-channel intensity difference (IID) parameters (e.g., inter-channel level differences (ILDs), inter-channel time difference (ITD) parameters, inter-channel phase difference (IPD) parameters, inter-channel correlation (ICC) parameters, non-causal shift parameters, spectral tilt parameters, inter-channel voicing parameters, inter-channel pitch parameters, inter-channel gain parameters, etc. The stereo parameters 162 may be used at the frequency-domain stereo coder 109 during generation of other signals. The stereo parameters 162 may also be transmitted as part of an encoded signal. Estimation and use of the stereo parameters 162 is described in greater detail with respect to FIGS. 3-7.

The frequency-domain stereo coder 109 may also generate a side-band bitstream 164 and a mid-band bitstream 166 based at least in part on the frequency-domain signals. For purposes of illustration, unless otherwise noted, it is assumed that that the reference signal 190 is a left-channel signal (l or L) and the adjusted target signal 192 is a right-channel signal (r or R). The frequency-domain representation of the reference signal 190 may be noted as $L_{fr}(b)$ and the frequency-domain representation of the adjusted target signal 192 may be noted as $R_{fr}(b)$, where b represents a band of the frequency-domain representations. According to one implementation, a side-band signal $S_{fr}(b)$ may be generated in the frequency-domain from frequency-domain representations of the reference signal 190 and the adjusted target signal 192. For example, the side-band signal $S_{fr}(b)$ may be expressed as $(L_{fr}(b)-R_{fr}(b))/2$. The side-band signal $S_{fr}(b)$ may be provided to a side-band encoder to generate the side-band bitstream 164. According to one implementation, a mid-band signal m(t) may be generated in the time-domain and transformed into the frequency-domain. For example, the mid-band signal m(t) may be expressed as $(l(t)+r(t))/2$. Generating the mid-band signal in the time-domain prior to generation of the mid-band signal in the frequency-domain is described in greater detail with respect to FIGS. 3, 4 and 7. According to another implementation, a mid-band signal $M_{fr}(b)$ may be generated from frequency-domain signals (e.g., bypassing time-domain mid-band signal generation). Generating the mid-band signal $M_{fr}(b)$ from frequency-domain signals is described in greater detail with respect to FIGS. 5-6. The time-domain/frequency-domain mid-band signals may be provided to a mid-band encoder to generate the mid-band bitstream 166.

The side-band signal $S_{fr}(b)$ and the mid-band signal m(t) or $M_{fr}(b)$ may be encoded using multiple techniques. According to one implementation, the time-domain mid-band signal m(t) may be encoded using a time-domain technique, such as algebraic code-excited linear prediction (ACELP), with a bandwidth extension for higher band coding. Before side-band coding, the mid-band signal m(t) (either coded or uncoded) may be converted into the frequency-domain (e.g., the transform-domain) to generate the mid-band signal $M_{fr}(b)$.

One implementation of side-band coding includes predicting a side-band $S_{PRED}(b)$ from the frequency-domain mid-band signal $M_{fr}(b)$ using the information in the frequency mid-band signal $M_{fr}(b)$ and the stereo parameters 162 (e.g., ILDs) corresponding to the band (b). For example, the predicted side-band $S_{PRED}(b)$ may be expressed as $M_{fr}(b)*(ILD(b)-1)/(ILD(b)+1)$. An error signal e(b) in the band (b) may be calculated as a function of the side-band signal $S_{fr}(b)$ and the predicted side-band $S_{PRED}(b)$. For example, the error signal e(b) may be expressed as $S_{fr}(b)-S_{PRED}(b)$. The error signal e(b) may be coded using transform-domain coding techniques to generate a coded error signal $e_{CODED}(b)$. For upper-bands, the error signal e(b) may be expressed as a scaled version of a mid-band signal $M_PAST_{fr}(b)$ in the band (b) from a previous frame. For example, the coded error signal $e_{CODED}(b)$ may be expressed as $g_{PRED}(b)*M_PAST_{fr}(b)$, where $g_{PRED}(b)$ may be estimated such that an energy of $e(b)-g_{PRED}(b)*M_PAST_{fr}(b)$ is substantially reduced (e.g., minimized).

The transmitter 110 may transmit the stereo parameters 162, the side-band bitstream 164, the mid-band bitstream 166, the time-domain downmix parameters 168, or a combination thereof, via the network 120, to the second device 106. Alternatively, or in addition, the transmitter 110 may store the stereo parameters 162, the side-band bitstream 164, the mid-band bitstream 166, the time-domain downmix parameters 168, or a combination thereof, at a device of the network 120 or a local device for further processing or decoding later. Because a non-causal shift (e.g., the final shift value 116) may be determined during the encoding process, transmitting IPDs (e.g., as part of the stereo parameters 162) in addition to the non-causal shift in each band may be redundant. Thus, in some implementations, an IPD and non-casual shift may be estimated for the same frame but in mutually exclusive bands. In other implementations, lower resolution IPDs may be estimated in addition to the shift for finer per-band adjustments. Alternatively, IPDs may be not determined for frames where the non-casual shift is determined.

The decoder 118 may perform decoding operations based on the stereo parameters 162, the side-band bitstream 164, the mid-band bitstream 166, and the time-domain downmix parameters 168. For example, a frequency-domain stereo decoder 125 and the temporal balancer 124 may perform upmixing to generate a first output signal 126 (e.g., corresponding to first audio signal 130), a second output signal 128 (e.g., corresponding to the second audio signal 132), or both. The second device 106 may output the first output signal 126 via the first loudspeaker 142. The second device 106 may output the second output signal 128 via the second loudspeaker 144. In alternative examples, the first output signal 126 and second output signal 128 may be transmitted as a stereo signal pair to a single output loudspeaker.

The system 100 may thus enable the frequency-domain stereo coder 109 to transform the reference signal 190 and the adjusted target signal 192 into the frequency-domain to generate the stereo parameters 162, the side-band bitstream 164, and the mid-band bitstream 166. The time-shifting techniques of the temporal equalizer 108 that temporally shift the first audio signal 130 to align with the second audio signal 132 may be implemented in conjunction with frequency-domain signal processing. To illustrate, temporal equalizer 108 estimates a shift (e.g., a non-casual shift value) for each frame at the encoder 114, shifts (e.g., adjusts) a target channel according to the non-casual shift value, and uses the shift adjusted channels for the stereo parameters estimation in the transform-domain.

Figure 2:
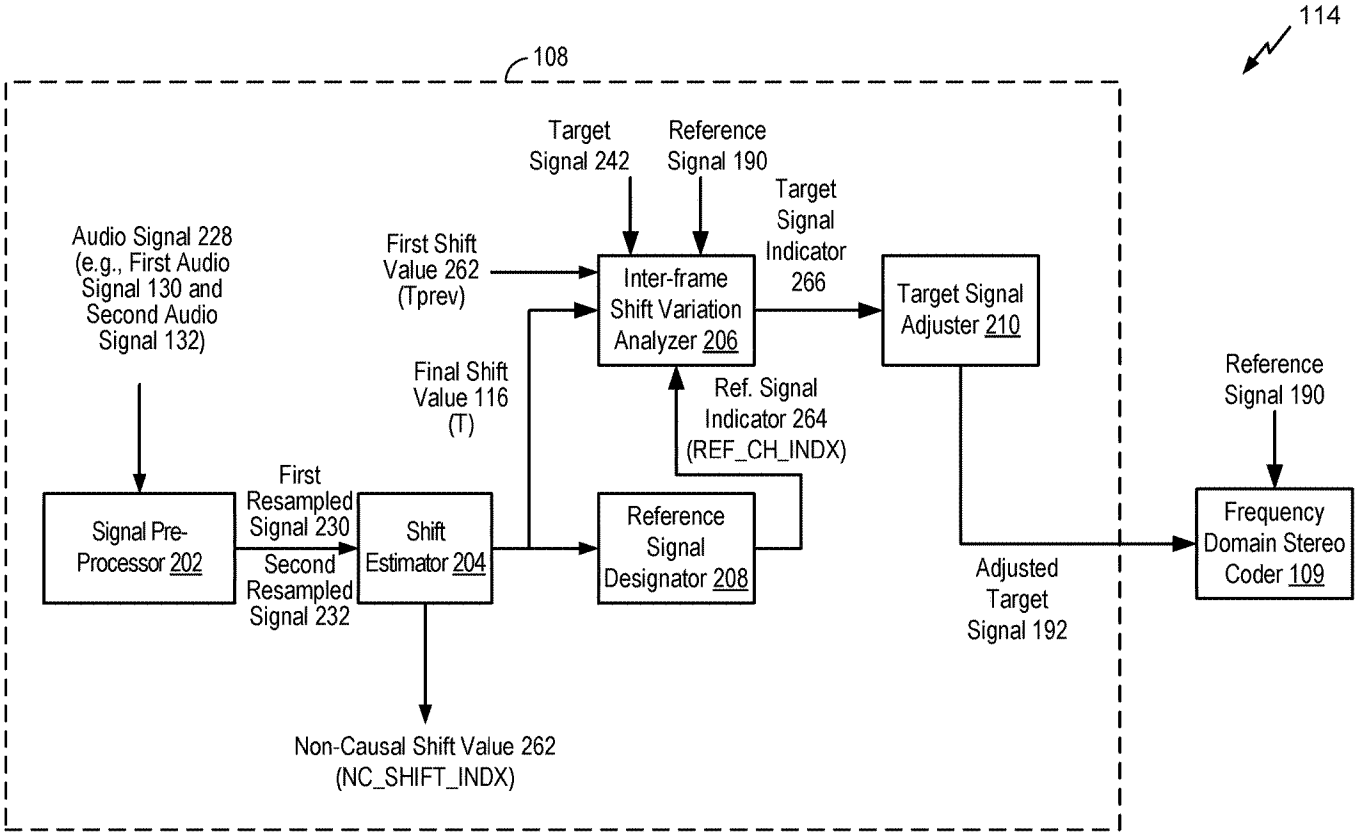
FIG. 2 is a diagram illustrating the encoder of FIG. 1.

Referring to FIG. 2, an illustrative example of the encoder 114 of the first device 104 is shown. The encoder 114 includes the temporal equalizer 108 and the frequency-domain stereo coder 109.

The temporal equalizer 108 includes a signal pre-processor 202 coupled, via a shift estimator 204, to an inter-frame shift variation analyzer 206, to a reference signal designator 208, or both. In a particular implementation, the signal pre-processor 202 may correspond to a resampler. The inter-frame shift variation analyzer 206 may be coupled, via a target signal adjuster 210, to the frequency-domain stereo coder 109. The reference signal designator 208 may be coupled to the inter-frame shift variation analyzer 206.

During operation, the signal pre-processor 202 may receive an audio signal 228. For example, the signal pre-processor 202 may receive the audio signal 228 from the input interface(s) 112. The audio signal 228 may include the first audio signal 130, the second audio signal 132, or both. The signal pre-processor 202 may generate a first resampled signal 230, a second resampled signal 232, or both. Operations of the signal pre-processor 202 are described in greater detail with respect to FIG. 8. The signal pre-processor 202 may provide the first resampled signal 230, the second resampled signal 232, or both, to the shift estimator 204.

The shift estimator 204 may generate the final shift value 116 (T), the non-causal shift value, or both, based on the first resampled signal 230, the second resampled signal 232, or both. Operations of the shift estimator 204 are described in greater detail with respect to FIG. 9. The shift estimator 204 may provide the final shift value 116 to the inter-frame shift variation analyzer 206, the reference signal designator 208, or both.

The reference signal designator 208 may generate a reference signal indicator 264. The reference signal indicator 264 may indicate which of the audio signals 130, 132 is the reference signal 190 and which of the signals 130, 132 is the target signal 242. The reference signal designator 208 may provide the reference signal indicator 264 to the inter-frame shift variation analyzer 206.

The inter-frame shift variation analyzer 206 may generate a target signal indicator 266 based on the target signal 242, the reference signal 190, a first shift value 262 (Tprev), the final shift value 116 (T), the reference signal indicator 264, or a combination thereof. The inter-frame shift variation analyzer 206 may provide the target signal indicator 266 to the target signal adjuster 210.

The target signal adjuster 210 may generate the adjusted target signal 192 based on the target signal indicator 266, the target signal 242, or both. The target signal adjuster 210 may adjust the target signal 242 based on a temporal shift evolution from the first shift value 262 (Tprev) to the final shift value 116 (T). For example, the first shift value 262 may include a final shift value corresponding to the previous frame. The target signal adjuster 210 may, in response to determining that a final shift value changed from the first shift value 262 having a first value (e.g., Tprev=2) corresponding to the previous frame that is lower than the final shift value 116 (e.g., T=4) corresponding to the previous frame, interpolate the target signal 242 such that a subset of samples of the target signal 242 that correspond to frame boundaries are dropped through smoothing and slow-shifting to generate the adjusted target signal 192. Alternatively, the target signal adjuster 210 may, in response to determining that a final shift value changed from the first shift value 262 (e.g., Tprev=4) that is greater than the final shift value 116 (e.g., T=2), interpolate the target signal 242 such that a subset of samples of the target signal 242 that correspond to frame boundaries are repeated through smoothing and slow-shifting to generate the adjusted target signal 192. The smoothing and slow-shifting may be performed based on hybrid Sin c- and Lagrange-interpolators. The target signal adjuster 210 may, in response to determining that a final shift value is unchanged from the first shift value 262 to the final shift value 116 (e.g., Tprev=T), temporally offset the target signal 242 to generate the adjusted target signal 192. The target signal adjuster 210 may provide the adjusted target signal 192 to the frequency-domain stereo coder 109.

Additional embodiments of operations associated with audio processing components, including but not limited to a signal pre-processor, a shift estimator, an inter-frame shift variation analyzer, a reference signal designator, a target signal adjuster, etc. are further described in Appendix A.

The reference signal 190 may also be provided to the frequency-domain stereo coder 109. The frequency-domain stereo coder 109 may generate the stereo parameters 162, the side-band bitstream 164, and the mid-band bitstream 166 based on the reference signal 190 and the adjusted target signal 192, as described with respect to FIG. 1 and as further described with respect to FIGS. 3-7.

Referring to FIGS. 3-7, a few example detailed implementations **109*a*-109*e* of frequency-domain stereo coders 109 working together with the time-domain downmix as described in FIG. 2 are shown. In some examples, the reference signal 190 may include a left-channel signal and the adjusted target signal 192 may include a right-channel signal. However, it should be understood that in other examples, the reference signal 190 may include a right-channel signal and the adjusted target signal 192 may include a left-channel signal. In other implementations, the reference channel 190 may be either of the left or the right channel which is chosen on a frame-by-frame basis and similarly, the adjusted target signal 192 may be the other of the left or right channels after being adjusted for temporal shift. For the purposes of the descriptions below, we provide examples of the specific case when the reference signal 190 includes a left-channel signal (L) and the adjusted target signal 192 includes a right-channel signal (R). Similar descriptions for the other cases can be trivially extended. It is also to be understood that the various components illustrated in FIGS. 3-7** (e.g., transforms, signal generators, encoders, estimators, etc.) may be implemented using hardware (e.g., dedicated circuitry), software (e.g., instructions executed by a processor), or a combination thereof.

Figure 3:
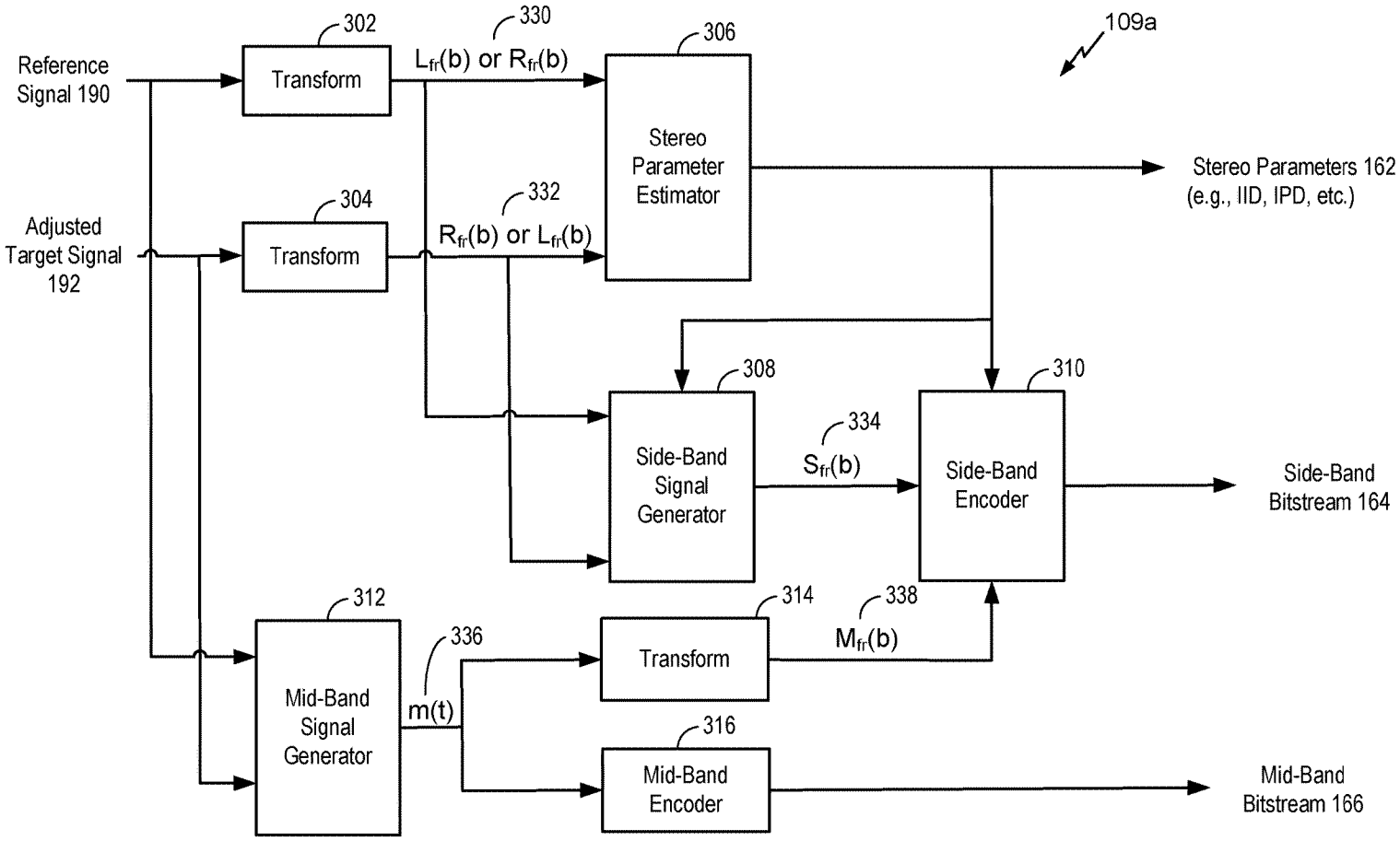
FIG. 3 is a diagram illustrating a first implementation of a frequency-domain stereo coder of the encoder of FIG. 1.

In FIG. 3, a transform 302 may be performed on the reference signal 190 and a transform 304 may be performed on the adjusted target signal 192. The transforms 302, 304 may be performed by transform operations that generate frequency-domain (or sub-band domain) signals. As non-limiting examples, performing the transforms 302, 304 may performing include Discrete Fourier Transform (DFT) operations, Fast Fourier Transform (FFT) operations, etc. According to some implementations, Quadrature Mirror Filterbank (QMF) operations (using filterbands, such as a Complex Low Delay Filter Bank) may be used to split the input signals (e.g., the reference signal 190 and the adjusted target signal 192) into multiple sub-bands, and the sub-bands may be converted into the frequency-domain using another frequency-domain transform operation. The transform 302 may be applied to the reference signal 190 to generate a frequency-domain reference signal ($L_{fr}(b)$) 330, and the transform 304 may be applied to the adjusted target signal 192 to generate a frequency-domain adjusted target signal ($R_{fr}(b)$) 332. The frequency-domain reference signal 330 and the frequency-domain adjusted target signal 332 may be provided to a stereo parameter estimator 306 and to a side-band signal generator 308.

The stereo parameter estimator 306 may extract (e.g., generate) the stereo parameters 162 based on the frequency-domain reference signal 330 and the frequency-domain adjusted target signal 332. To illustrate, IID(b) may be a function of the energies $E_L(b)$ of the left channels in the band (b) and the energies $E_R(b)$ of the right channels in the band (b). For example, IID(b) may be expressed as $20*\log_{10}(E_L(b)/E_R(b))$. IPDs estimated and transmitted at an encoder may provide an estimate of the phase difference in the frequency-domain between the left and right channels in the band (b). The stereo parameters 162 may include additional (or alternative) parameters, such as ICCs, ITDs etc. The stereo parameters 162 may be transmitted to the second device 106 of FIG. 1, provided to the side-band signal generator 308, and provided to a side-band encoder 310.

The side-band generator 308 may generate a frequency-domain sideband signal ($S_{fr}(b)$) 334 based on the frequency-domain reference signal 330 and the frequency-domain adjusted target signal 332. The frequency-domain sideband signal 334 may be estimated in the frequency-domain bins/ bands. In each band, the gain parameter (g) is different and may be based on the inter-channel level differences (e.g., based on the stereo parameters 162). For example, the frequency-domain sideband signal 334 may be expressed as $(L_{fr}(b)-c(b)*R_{fr}(b))/(1+c(b))$, where c(b) may be the ILD(b) or a function of the ILD(b) (e.g., c(b)=10^(ILD(b)/20)). The frequency-domain sideband signal 334 may be provided to the side-band encoder 310.

The reference signal 190 and the adjusted target signal 192 may also be provided to a mid-band signal generator 312. The mid-band signal generator 312 may generate a time-domain mid-band signal (m(t)) 336 based on the reference signal 190 and the adjusted target signal 192. For example, the time-domain mid-band signal 336 may be expressed as (l(t)+r(t))/2, where l(t) includes the reference signal 190 and r(t) includes the adjusted target signal 192. A transform 314 may be applied to time-domain mid-band signal 336 to generate a frequency-domain mid-band signal ($M_{fr}(b)$) 338, and the frequency-domain mid-band signal 338 may be provided to the side-band encoder 310. The time-domain mid-band signal 336 may be also provided to a mid-band encoder 316.

The side-band encoder 310 may generate the side-band bitstream 164 based on the stereo parameters 162, the frequency-domain sideband signal 334, and the frequency-domain mid-band signal 338. The mid-band encoder 316 may generate the mid-band bitstream 166 by encoding the time-domain mid-band signal 336. In particular examples, the side-band encoder 310 and the mid-band encoder 316 may include ACELP encoders to generate the side-band bitstream 164 and the mid-band bitstream 166, respectively. For the lower bands, the frequency-domain sideband signal 334 may be encoded using a transform-domain coding technique. For the higher bands, the frequency-domain sideband signal 334 may be expressed as a prediction from the previous frame's mid-band signal (either quantized or unquanitized).

Figure 4:
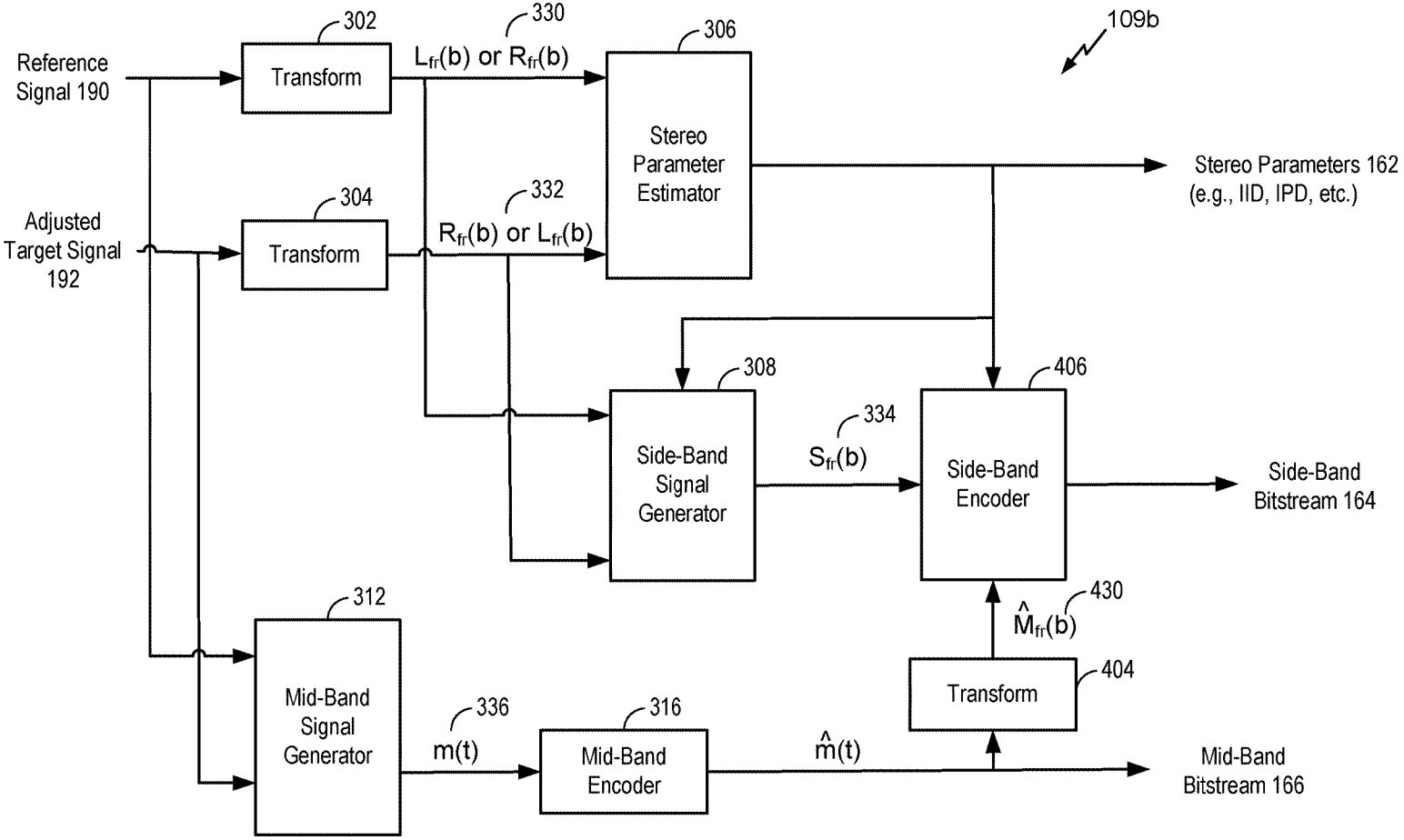
FIG. 4 is a diagram illustrating a second implementation of a frequency-domain stereo coder of the encoder of FIG. 1.

Referring to FIG. 4, a second implementation 109*b* of the frequency-domain stereo coder 109 is shown. The second implementation 109*b* of the frequency-domain stereo coder 109 may operate in a substantially similar manner as the first implementation 109*a* of the frequency-domain stereo coder 109. However, in the second implementation 109*b*, a transform 404 may be applied to the mid-band bitstream 166 (e.g., an encoded version of the time-domain mid-band signal 336) to generate a frequency-domain mid-band bitstream 430. A side-band encoder 406 may generate the side-band bitstream 164 based on the stereo parameters 162, the frequency-domain sideband signal 334, and the frequency-domain mid-band bitstream 430.

Figure 5:
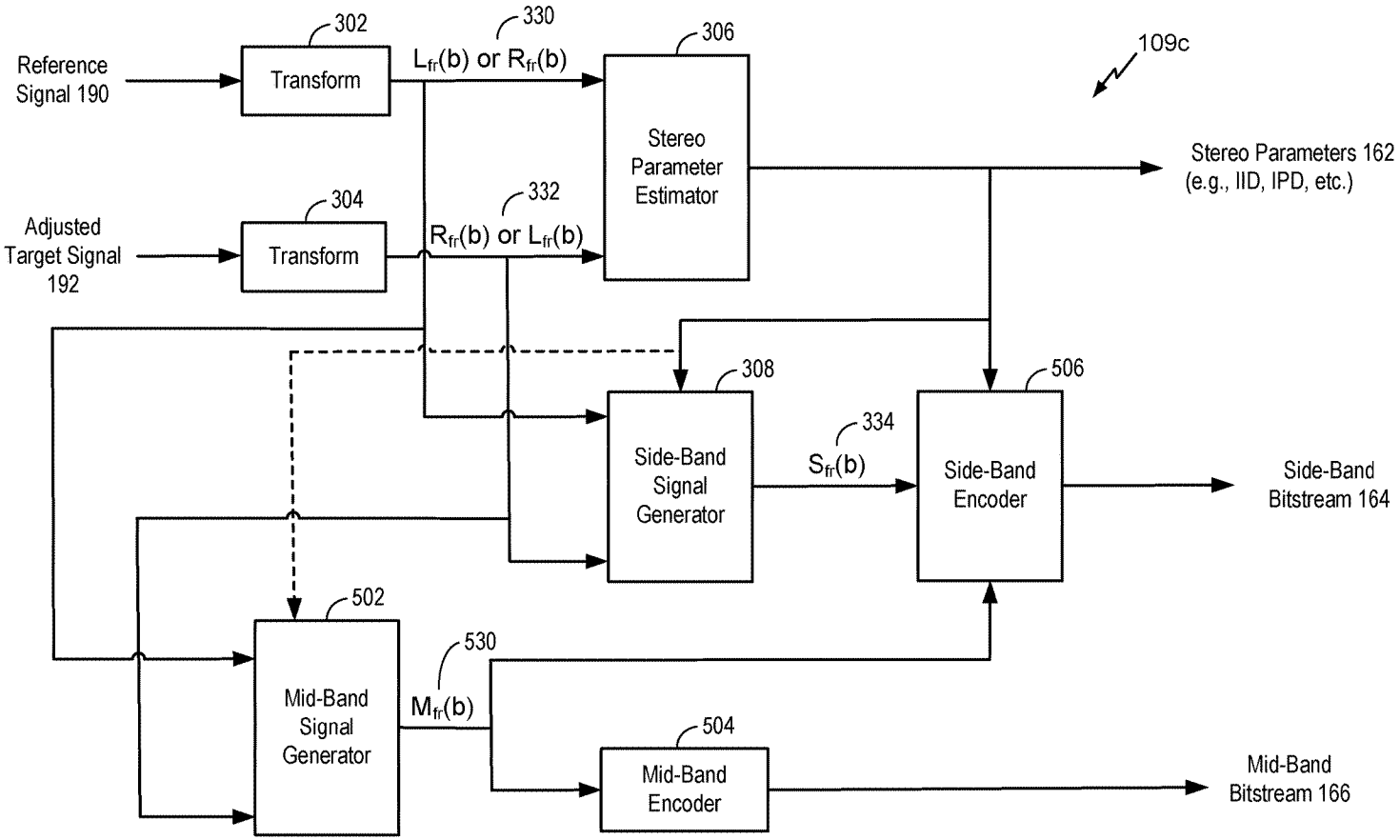
FIG. 5 is a diagram illustrating a third implementation of a frequency-domain stereo coder of the encoder of FIG. 1.

Referring to FIG. 5, a third implementation 109*c* of the frequency-domain stereo coder 109 is shown. The third implementation 109*c* of the frequency-domain stereo coder 109 may operate in a substantially similar manner as the first implementation 109*a* of the frequency-domain stereo coder 109. However, in the third implementation 109*c*, the frequency-domain reference signal 330 and the frequency-domain adjusted target signal 332 may be provided to a mid-band signal generator 502. According to some implementations, the stereo parameters 162 may also be provided to the mid-band signal generator 502. The mid-band signal generator 502 may generate a frequency-domain mid-band signal $M_{fr}(b)$ 530 based on the frequency-domain reference signal 330 and the frequency-domain adjusted target signal 332. According to some implementations, the frequency-domain mid-band signal $M_{fr}(b)$ 530 may be generated also based on the stereo parameters 162. Some methods of generation of the mid-band signal 530 based on the frequency-domain reference channel 330, the adjusted target channel 332 and the stereo parameters 162 are as follows.

$$M_{fr}(b)=(L_{fr}(b)+R_{fr}(b))/2$$

$$M_{fr}(b)=c1(b)*L_{fr}(b)+c_2*R_{fr}(b),\text{ where } c_1(b) \text{ and } c_2(b) \text{ are complex values.}$$

In some implementations, the complex values $c_1(b)$ and $c_2(b)$ are based on the stereo parameters 162. For example, in one implementation of mid side downmix when IPDs are estimated, $c_1(b)=(\cos(-\gamma)-i*\sin(-\gamma))/2^{0.5}$ and $c_2(b)=(\cos(IPD(b)-\gamma)+i*\sin(IPD(b)-\gamma))/2^{0.5}$ where i is the imaginary number signifying the square root of −1.

The frequency-domain mid-band signal 530 may be provided to a mid-band encoder 504 and to a side-band encoder 506 for the purpose of efficient side band signal encoding. In this implementation, the mid-band encoder 504 may further transform the mid-band signal 530 to any other transform/time-domain before encoding. For example, the mid-band signal 530 ($M_{fr}(b)$) may be inverse-transformed back to time-domain, or transformed to MDCT domain for coding.

The side-band encoder 506 may generate the side-band bitstream 164 based on the stereo parameters 162, the frequency-domain sideband signal 334, and the frequency-domain mid-band signal 530. The mid-band encoder 504 may generate the mid-band bitstream 166 based on the frequency-domain mid-band signal 530. For example, the mid-band encoder 504 may encode the frequency-domain mid-band signal 530 to generate the mid-band bitstream 166.

Figure 6:
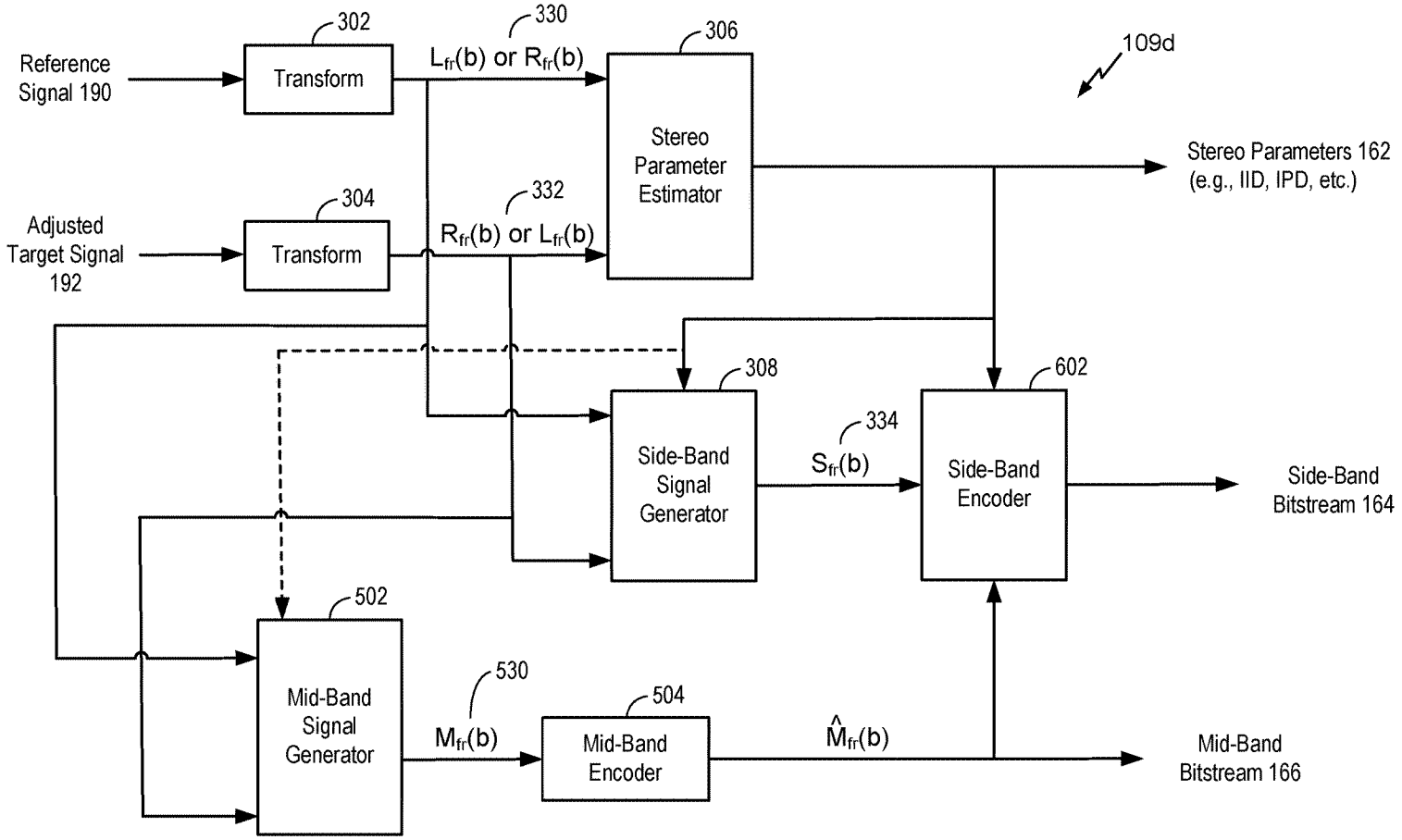
FIG. 6 is a diagram illustrating a fourth implementation of a frequency-domain stereo coder of the encoder of FIG. 1.

Referring to FIG. 6, a fourth implementation 109*d* of the frequency-domain stereo coder 109 is shown. The fourth implementation 109*d* of the frequency-domain stereo coder 109 may operate in a substantially similar manner as the third implementation 109*c* of the frequency-domain stereo coder 109. However, in the fourth implementation 109*d*, the mid-band bitstream 166 may be provided to a side-band encoder 602. In an alternate implementation, the quantized mid-band signal based on the mid-band bitstream may be provided to the side-band encoder 602. The side-band encoder 602 may be configured to generate the side-band bitstream 164 based on the stereo parameters 162, the frequency-domain sideband signal 334, and the mid-band bitstream 166.

Figure 7:
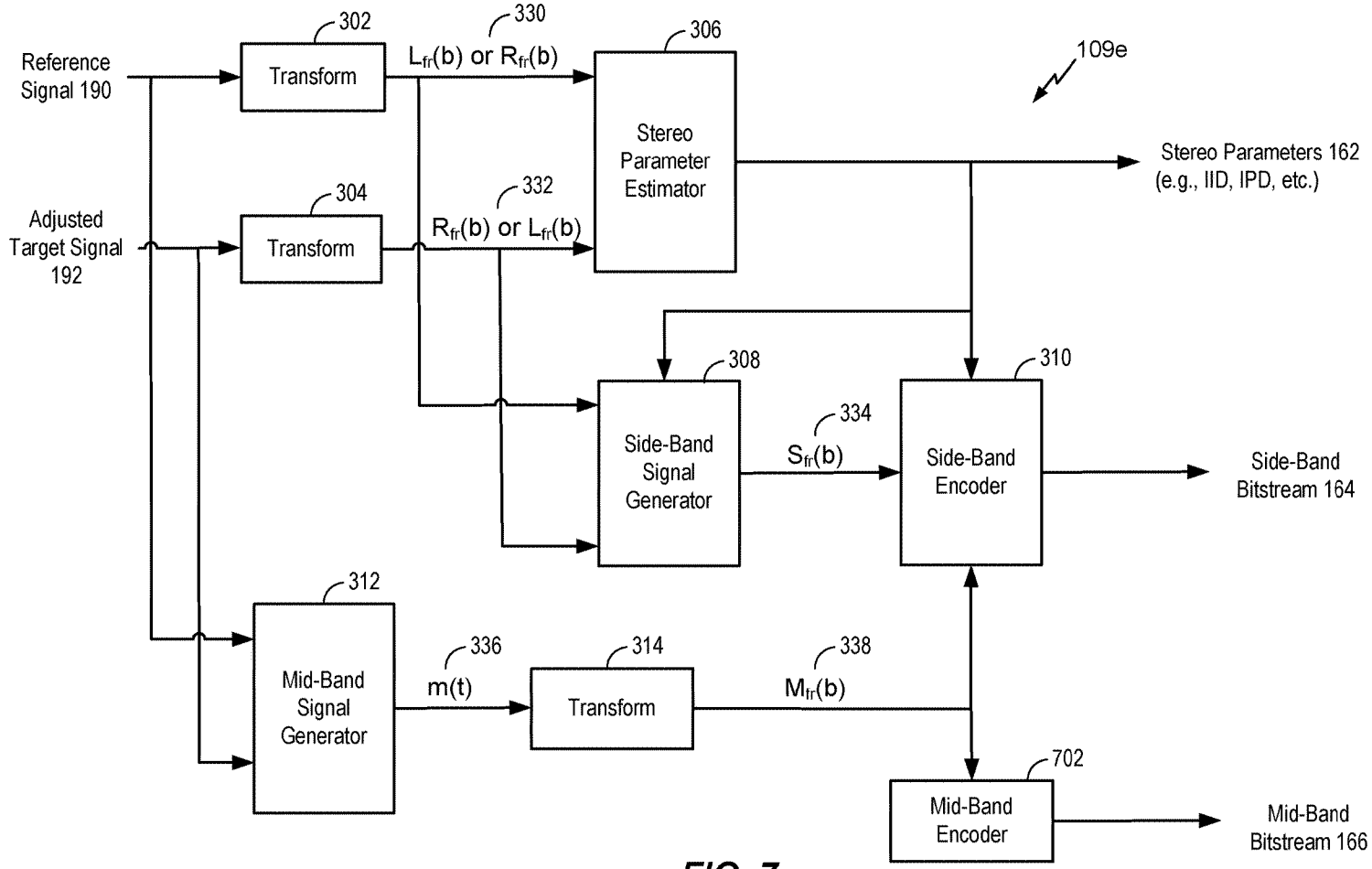
FIG. 7 is a diagram illustrating a fifth implementation of a frequency-domain stereo coder of the encoder of FIG. 1.

Referring to FIG. 7, a fifth implementation 109*e* of the frequency-domain stereo coder 109 is shown. The fifth implementation 109*e* of the frequency-domain stereo coder 109 may operate in a substantially similar manner as the first implementation 109*a* of the frequency-domain stereo coder 109. However, in the fifth implementation 109*e*, the frequency-domain mid-band signal 338 may be provided to a mid-band encoder 702. The mid-band encoder 702 may be configured to encode the frequency-domain mid-band signal 338 to generate the mid-band bitstream 166.

Figure 8:
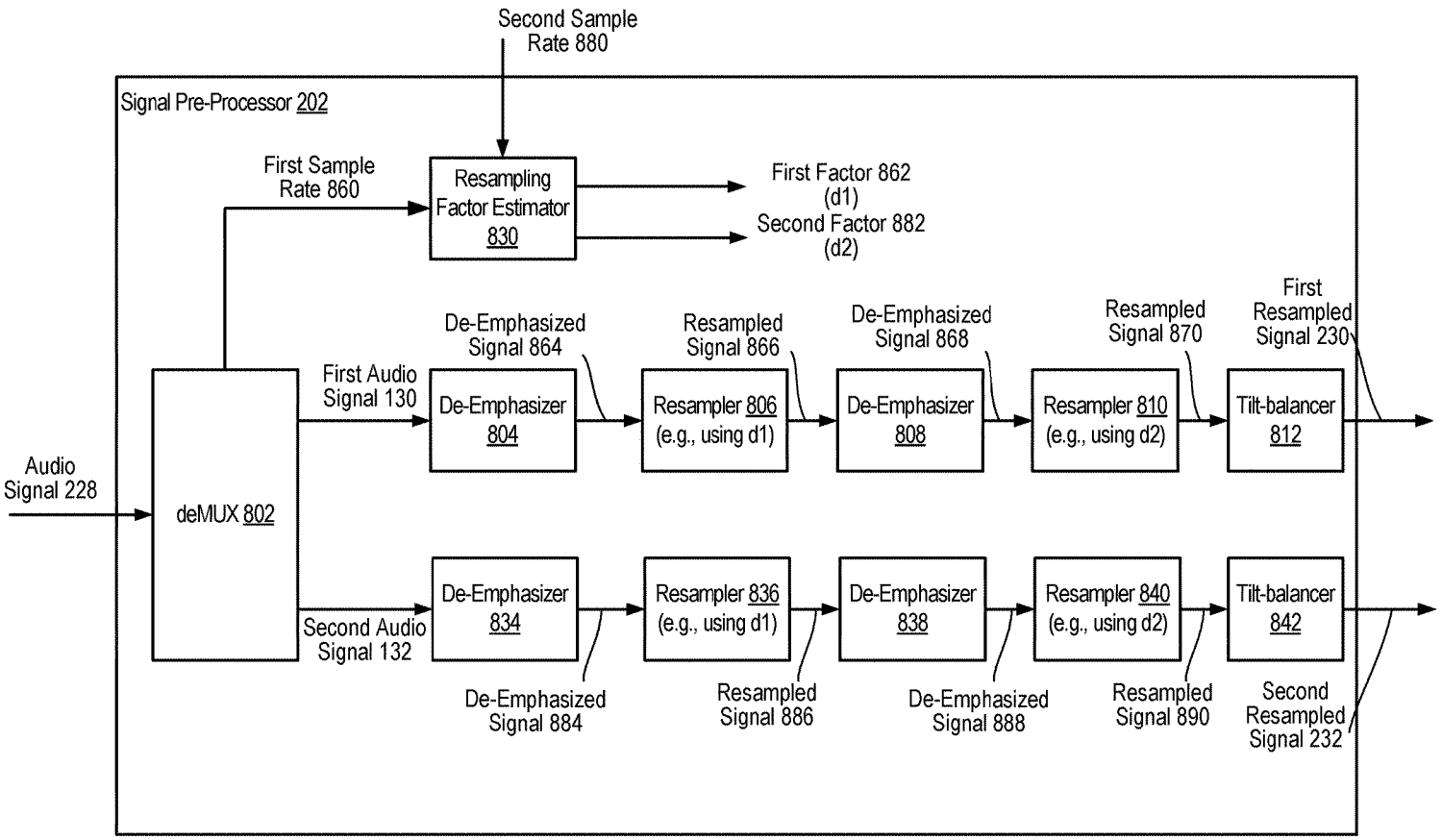
FIG. 8 is a diagram illustrating a signal pre-processor of the encoder of FIG. 1.

Referring to FIG. 8, an illustrative example of the signal pre-processor 202 is shown. The signal pre-processor 202 may include a demultiplexer (DeMUX) 802 coupled to a resampling factor estimator 830, a de-emphasizer 804, a de-emphasizer 834, or a combination thereof. The de-emphasizer 804 may be coupled to, via a resampler 806, to a de-emphasizer 808. The de-emphasizer 808 may be coupled, via a resampler 810, to a tilt-balancer 812. The de-emphasizer 834 may be coupled, via a resampler 836, to a de-emphasizer 838. The de-emphasizer 838 may be coupled, via a resampler 840, to a tilt-balancer 842.

During operation, the deMUX 802 may generate the first audio signal 130 and the second audio signal 132 by demultiplexing the audio signal 228. The deMUX 802 may provide a first sample rate 860 associated with the first audio signal 130, the second audio signal 132, or both, to the resampling factor estimator 830. The deMUX 802 may provide the first audio signal 130 to the de-emphasizer 804, the second audio signal 132 to the de-emphasizer 834, or both.

The resampling factor estimator 830 may generate a first factor 862 (d1), a second factor 882 (d2), or both, based on the first sample rate 860, a second sample rate 880, or both. The resampling factor estimator 830 may determine a resampling factor (D) based on the first sample rate 860, the second sample rate 880, or both. For example, the resampling factor (D) may correspond to a ratio of the first sample rate 860 and the second sample rate 880 (e.g., the resampling factor (D)=the second sample rate 880/the first sample rate 860 or the resampling factor (D)=the first sample rate 860/the second sample rate 880). The first factor 862 (d1), the second factor 882 (d2), or both, may be factors of the resampling factor (D). For example, the resampling factor (D) may correspond to a product of the first factor 862 (d1) and the second factor 882 (d2) (e.g., the resampling factor (D)=the first factor 862 (d1)*the second factor 882 (d2)). In some implementations, the first factor 862 (d1) may have a first value (e.g., 1), the second factor 882 (d2) may have a second value (e.g., 1), or both, which bypasses the resampling stages, as described herein.

The de-emphasizer 804 may generate a de-emphasized signal 864 by filtering the first audio signal 130 based on an IIR filter (e.g., a first order IIR filter). The de-emphasizer 804 may provide the de-emphasized signal 864 to the resampler 806. The resampler 806 may generate a resampled signal 866 by resampling the de-emphasized signal 864 based on the first factor 862 (d1). The resampler 806 may provide the resampled signal 866 to the de-emphasizer 808. The de-emphasizer 808 may generate a de-emphasized signal 868 by filtering the resampled signal 866 based on an IIR filter. The de-emphasizer 808 may provide the de-emphasized signal 868 to the resampler 810. The resampler 810 may generate a resampled signal 870 by resampling the de-emphasized signal 868 based on the second factor 882 (d2).

In some implementations, the first factor 862 (d1) may have a first value (e.g., 1), the second factor 882 (d2) may have a second value (e.g., 1), or both, which bypasses the resampling stages. For example, when the first factor 862 (d1) has the first value (e.g., 1), the resampled signal 866 may be the same as the de-emphasized signal 864. As another example, when the second factor 882 (d2) has the second value (e.g., 1), the resampled signal 870 may be the same as the de-emphasized signal 868. The resampler 810 may provide the resampled signal 870 to the tilt-balancer 812. The tilt-balancer 812 may generate the first resampled signal 230 by performing tilt balancing on the resampled signal 870.

The de-emphasizer 834 may generate a de-emphasized signal 884 by filtering the second audio signal 132 based on an IIR filter (e.g., a first order IIR filter). The de-emphasizer 834 may provide the de-emphasized signal 884 to the resampler 836. The resampler 836 may generate a resampled signal 886 by resampling the de-emphasized signal 884 based on the first factor 862 (d1). The resampler 836 may provide the resampled signal 886 to the de-emphasizer 838. The de-emphasizer 838 may generate a de-emphasized signal 888 by filtering the resampled signal 886 based on an IIR filter. The de-emphasizer 838 may provide the de-emphasized signal 888 to the resampler 840. The resampler 840 may generate a resampled signal 890 by resampling the de-emphasized signal 888 based on the second factor 882 (d2).

In some implementations, the first factor 862 (d1) may have a first value (e.g., 1), the second factor 882 (d2) may have a second value (e.g., 1), or both, which bypasses the resampling stages. For example, when the first factor 862 (d1) has the first value (e.g., 1), the resampled signal 886 may be the same as the de-emphasized signal 884. As another example, when the second factor 882 (d2) has the second value (e.g., 1), the resampled signal 890 may be the same as the de-emphasized signal 888. The resampler 840 may provide the resampled signal 890 to the tilt-balancer 842. The tilt-balancer 842 may generate the second resampled signal 532 by performing tilt balancing on the resampled signal 890. In some implementations, the tilt-balancer 812 and the tilt-balancer 842 may compensate for a low pass (LP) effect due to the de-emphasizer 804 and the de-emphasizer 834, respectively.

Figure 9:
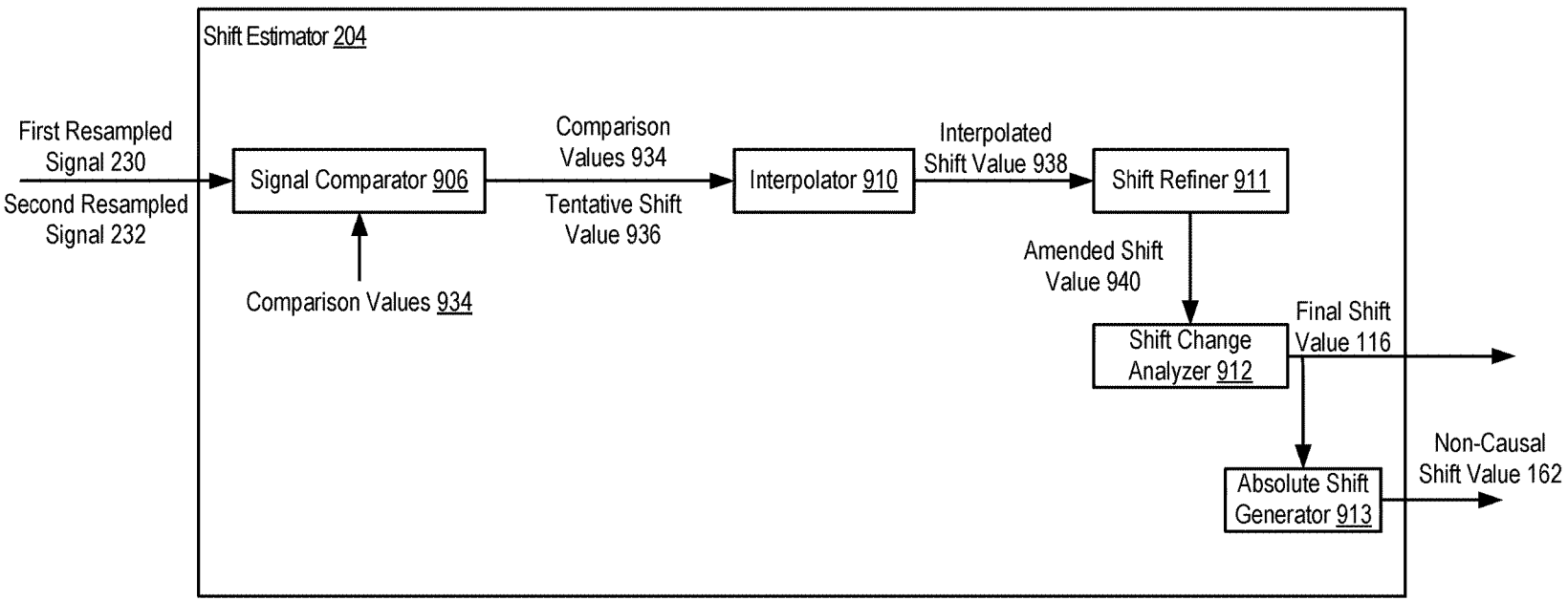
FIG. 9 is a diagram illustrating a shift estimator 204 of the encoder of FIG. 1.

Referring to FIG. 9, an illustrative example of the shift estimator 204 is shown. The shift estimator 204 may include a signal comparator 906, an interpolator 910, a shift refiner 911, a shift change analyzer 912, an absolute shift generator 913, or a combination thereof. It should be understood that the shift estimator 204 may include fewer than or more than the components illustrated in FIG. 9.

The signal comparator 906 may generate comparison values 934 (e.g., different values, similarity values, coherence values, or cross-correlation values), a tentative shift value 936, or both. For example, the signal comparator 906 may generate the comparison values 934 based on the first resampled signal 230 and a plurality of shift values applied to the second resampled signal 232. The signal comparator 906 may determine the tentative shift value 936 based on the comparison values 934. The first resampled signal 230 may include fewer samples or more samples than the first audio signal 130. The second resampled signal 232 may include fewer samples or more samples than the second audio signal 132. Determining the comparison values 934 based on the fewer samples of the resampled signals (e.g., the first resampled signal 230 and the second resampled signal 232) may use fewer resources (e.g., time number of operations, or both) than on samples of the original signals (e.g., the first audio signal 130 and the second audio signal 132). Determining the comparison values 934 based on the more samples of the resampled signals (e.g., the first resampled signal 230 and the second resampled signal 232) may increase precision than on samples of the original signals (e.g., the first audio signal 130 and the second audio signal 132). The signal comparator 906 may provide the comparison values 934, the tentative shift value 936, or both, to the interpolator 910.

The interpolator 910 may extend the tentative shift value 936. For example, the interpolator 910 may generate an interpolated shift value 938. For example, the interpolator 910 may generate interpolated comparison values corresponding to shift values that are proximate to the tentative shift value 936 by interpolating the comparison values 934. The interpolator 910 may determine the interpolated shift value 938 based on the interpolated comparison values and the comparison values 934. The comparison values 934 may be based on a coarser granularity of the shift values. For example, the comparison values 934 may be based on a first subset of a set of shift values so that a difference between a first shift value of the first subset and each second shift value of the first subset is greater than or equal to a threshold (e.g., ≥1). The threshold may be based on the resampling factor (D).

The interpolated comparison values may be based on a finer granularity of shift values that are proximate to the resampled tentative shift value 936. For example, the interpolated comparison values may be based on a second subset of the set of shift values so that a difference between a highest shift value of the second subset and the resampled tentative shift value 936 is less than the threshold (e.g., ≥1), and a difference between a lowest shift value of the second subset and the resampled tentative shift value 936 is less than the threshold. Determining the comparison values 934 based on the coarser granularity (e.g., the first subset) of the set of shift values may use fewer resources (e.g., time, operations, or both) than determining the comparison values 934 based on a finer granularity (e.g., all) of the set of shift values. Determining the interpolated comparison values corresponding to the second subset of shift values may extend the tentative shift value 936 based on a finer granularity of a smaller set of shift values that are proximate to the tentative shift value 936 without determining comparison values corresponding to each shift value of the set of shift values. Thus, determining the tentative shift value 936 based on the first subset of shift values and determining the interpolated shift value 938 based on the interpolated comparison values may balance resource usage and refinement of the estimated shift value. The interpolator 910 may provide the interpolated shift value 938 to the shift refiner 911.

The shift refiner 911 may generate an amended shift value 940 by refining the interpolated shift value 938. For example, the shift refiner 911 may determine whether the interpolated shift value 938 indicates that a change in a shift between the first audio signal 130 and the second audio signal 132 is greater than a shift change threshold. The change in the shift may be indicated by a difference between the interpolated shift value 938 and a first shift value associated with a previous frame. The shift refiner 911 may, in response to determining that the difference is less than or equal to the threshold, set the amended shift value 940 to the interpolated shift value 938. Alternatively, the shift refiner 911 may, in response to determining that the difference is greater than the threshold, determine a plurality of shift values that correspond to a difference that is less than or equal to the shift change threshold. The shift refiner 911 may determine comparison values based on the first audio signal 130 and the plurality of shift values applied to the second audio signal 132. The shift refiner 911 may determine the amended shift value 940 based on the comparison values. For example, the shift refiner 911 may select a shift value of the plurality of shift values based on the comparison values and the interpolated shift value 938. The shift refiner 911 may set the amended shift value 940 to indicate the selected shift value. A non-zero difference between the first shift value corresponding to the previous frame and the interpolated shift value 938 may indicate that some samples of the second audio signal 132 correspond to both frames. For example, some samples of the second audio signal 132 may be duplicated during encoding. Alternatively, the non-zero difference may indicate that some samples of the second audio signal 132 correspond to neither the previous frame nor the current frame. For example, some samples of the second audio signal 132 may be lost during encoding. Setting the amended shift value 940 to one of the plurality of shift values may prevent a large change in shifts between consecutive (or adjacent) frames, thereby reducing an amount of sample loss or sample duplication during encoding. The shift refiner 911 may provide the amended shift value 940 to the shift change analyzer 912.

In some implementations, the shift refiner 911 may adjust the interpolated shift value 938. The shift refiner 911 may determine the amended shift value 940 based on the adjusted interpolated shift value 938. In some implementations, the shift refiner 911 may determine the amended shift value 940.

The shift change analyzer 912 may determine whether the amended shift value 940 indicates a switch or reverse in timing between the first audio signal 130 and the second audio signal 132, as described with reference to FIG. 1. In particular, a reverse or a switch in timing may indicate that, for the previous frame, the first audio signal 130 is received at the input interface(s) 112 prior to the second audio signal 132, and, for a subsequent frame, the second audio signal 132 is received at the input interface(s) prior to the first audio signal 130. Alternatively, a reverse or a switch in timing may indicate that, for the previous frame, the second audio signal 132 is received at the input interface(s) 112 prior to the first audio signal 130, and, for a subsequent frame, the first audio signal 130 is received at the input interface(s) prior to the second audio signal 132. In other words, a switch or reverse in timing may be indicate that a final shift value corresponding to the previous frame has a first sign that is distinct from a second sign of the amended shift value 940 corresponding to the current frame (e.g., a positive to negative transition or vice-versa). The shift change analyzer 912 may determine whether delay between the first audio signal 130 and the second audio signal 132 has switched sign based on the amended shift value 940 and the first shift value associated with the previous frame. The shift change analyzer 912 may, in response to determining that the delay between the first audio signal 130 and the second audio signal 132 has switched sign, set the final shift value 116 to a value (e.g., 0) indicating no time shift. Alternatively, the shift change analyzer 912 may set the final shift value 116 to the amended shift value 940 in response to determining that the delay between the first audio signal 130 and the second audio signal 132 has not switched sign. The shift change analyzer 912 may generate an estimated shift value by refining the amended shift value 940. The shift change analyzer 912 may set the final shift value 116 to the estimated shift value. Setting the final shift value 116 to indicate no time shift may reduce distortion at a decoder by refraining from time shifting the first audio signal 130 and the second audio signal 132 in opposite directions for consecutive (or adjacent) frames of the first audio signal 130. The absolute shift generator 913 may generate the non-causal shift value 162 by applying an absolute function to the final shift value 116.

Figure 10:
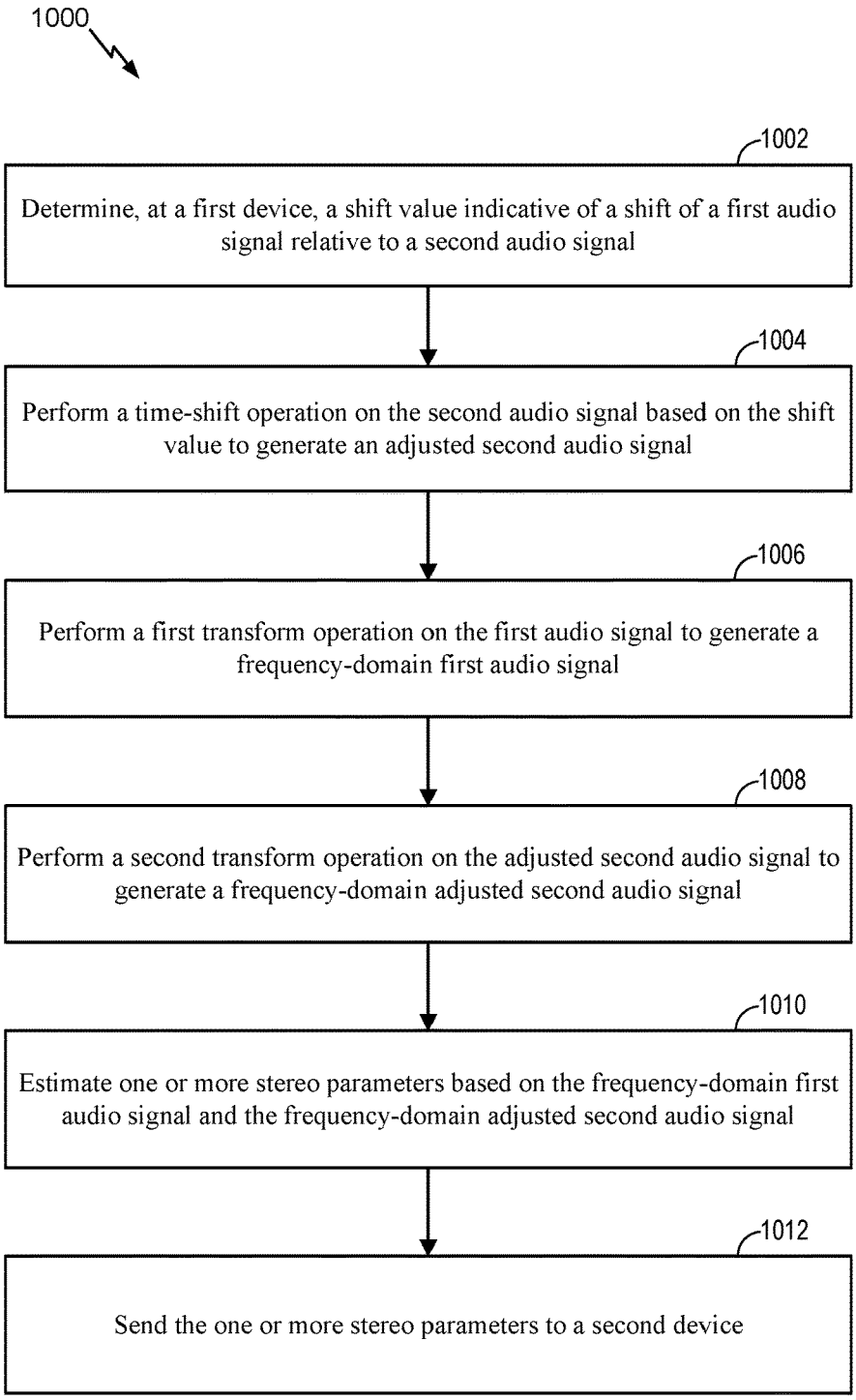
FIG. 10 is a flow chart illustrating a particular method of encoding multiple audio signals.

Referring to FIG. 10, a method 1000 of communication is shown. The method 1000 may be performed by the first device 104 of FIG. 1, the encoder 114 of FIGS. 1-2, frequency-domain stereo coder 109 of FIG. 1-7, the signal pre-processor 202 of FIGS. 2 and 8, the shift estimator 204 of FIGS. 2 and 9, or a combination thereof.

The method 1000 includes determining, at a first device, a shift value indicative of a shift of a first audio signal relative to a second audio signal, at 1002. For example, referring to FIG. 2, the temporal equalizer 108 may determine the final shift value 116 (e.g., a non-causal shift value) indicative of the shift (e.g., a non-causal shift) of the first audio signal 130 (e.g., "target") relative to the second audio signal 132 (e.g., "reference"). For example, a first value (e.g., a positive value) of the final shift value 116 may indicate that the second audio signal 132 is delayed relative to the first audio signal 130. A second value (e.g., a negative value) of the final shift value 116 may indicate that the first audio signal 130 is delayed relative to the second audio signal 132. A third value (e.g., 0) of the final shift value 116 may indicate no delay between the first audio signal 130 and the second audio signal 132.

A time-shift operation may be performed on the second audio signal based on the shift value to generate an adjusted second audio signal, at 1004. For example, referring to FIG. 2, the target signal adjuster 210 may adjust the target signal 242 based on a temporal shift evolution from the first shift value 262 (Tprev) to the final shift value 116 (T). For example, the first shift value 262 may include a final shift value corresponding to the previous frame. The target signal adjuster 210 may, in response to determining that a final shift value changed from the first shift value 262 having a first value (e.g., Tprev=2) corresponding to the previous frame that is lower than the final shift value 116 (e.g., T=4) corresponding to the previous frame, interpolate the target signal 242 such that a subset of samples of the target signal 242 that correspond to frame boundaries are dropped through smoothing and slow-shifting to generate the adjusted target signal 192. Alternatively, the target signal adjuster 210 may, in response to determining that a final shift value changed from the first shift value 262 (e.g., Tprev=4) that is greater than the final shift value 116 (e.g., T=2), interpolate the target signal 242 such that a subset of samples of the target signal 242 that correspond to frame boundaries are repeated through smoothing and slow-shifting to generate the adjusted target signal 192. The smoothing and slow-shifting may be performed based on hybrid Sin c- and Lagrange-interpolators. The target signal adjuster 210 may, in response to determining that a final shift value is unchanged from the first shift value 262 to the final shift value 116 (e.g., Tprev=T), temporally offset the target signal 242 to generate the adjusted target signal 192.

A first transform operation may be performed on the first audio signal to generate a frequency-domain first audio signal, at 1006. A second transform operation may be performed on the adjusted second audio signal to generate a frequency-domain adjusted second audio signal, at 1008. For example, referring to FIGS. 3-7, the transform 302 may be performed on the reference signal 190 and the transform 304 may be performed on the adjusted target signal 192. The transforms 302, 304 may include frequency-domain transform operations. As non-limiting examples, the transforms 302, 304 may include DFT operations, FFT operations, etc. According to some implementations, QMF operations (e.g., using complex low delay filter banks) may be used to split the input signals (e.g., the reference signal 190 and the adjusted target signal 192) into multiple sub-bands, and in some implementations, the sub-bands may be further converted into the frequency-domain using another frequency-domain transform operation. The transform 302 may be applied to the reference signal 190 to generate a frequency-domain reference signal $L_{fr}(b)$ 330, and the transform 304 may be applied to the adjusted target signal 192 to generate a frequency-domain adjusted target signal $R_{fr}(b)$ 332.

One or more stereo parameters may be estimated based on the frequency-domain first audio signal and the frequency-domain adjusted second audio signal, at 1010. For example, referring to FIGS. 3-7, the frequency-domain reference signal 330 and the frequency-domain adjusted target signal 332 may be provided to a stereo parameter estimator 306 and to a side-band signal generator 308. The stereo parameter estimator 306 may extract (e.g., generate) the stereo parameters 162 based on the frequency-domain reference signal 330 and the frequency-domain adjusted target signal 332. To illustrate, the IID(b) may be a function of the energies $E_L(b)$ of the left channels in the band (b) and the energies $E_R(b)$ of the right channels in the band (b). For example, IID(b) may be expressed as $20*\log_{10}(E_L(b)/E_R(b))$. IPDs estimated and transmitted at the encoder may provide an estimate of the phase difference in the frequency-domain between the left and right channels in the band (b). The stereo parameters 162 may include additional (or alternative) parameters, such as ICCs, ITDs etc.

The one or more stereo parameters may be sent to a second device, at 1012. For example, referring to FIG. 1, first device 104 may transmit the stereo parameters 162 to the second device 106 of FIG. 1.

The method 1000 may also include generating a time-domain mid-band signal based on the first audio signal and the adjusted second audio signal. For example, referring to FIGS. 3, 4, and 7, the mid-band signal generator 312 may generate the time-domain mid-band signal 336 based on the reference signal 190 and the adjusted target signal 192. For example, the time-domain mid-band signal 336 may be expressed as (l(t)+r(t))/2, where l(t) includes the reference signal 190 and r(t) includes the adjusted target signal 192. The method 1000 may also include encoding the time-domain mid-band signal to generate a mid-band bitstream. For example, referring to FIGS. 3 and 4, the mid-band encoder 316 may generate the mid-band bitstream 166 by encoding the time-domain mid-band signal 336. The method 1000 may further include sending the mid-band bitstream to the second device. For example, referring to FIG. 1, the transmitter 110 may send the mid-band bitstream 166 to the second device 106.

The method 1000 may also include generating a side-band signal based on the frequency-domain first audio signal, the frequency-domain adjusted second audio signal, and the one or more stereo parameters. For example, referring to FIG. 3, the side-band generator 308 may generate the frequency-domain sideband signal 334 based on the frequency-domain reference signal 330 and the frequency-domain adjusted target signal 332. The frequency-domain sideband signal 334 may be estimated in the frequency-domain bins/bands. In each band, the gain parameter (g) is different and may be based on the inter-channel level differences (e.g., based on the stereo parameters 162). For example, the frequency-domain sideband signal 334 may be expressed as $(L_{fr}(b)-c(b)*R_{fr}(b))/(1+c(b))$, where c(b) may be the ILD(b) or a function of the ILD(b) (e.g., c(b)=10^(ILD(b)/20)).

The method 1000 may also include performing a third transform operation on the time-domain mid-band signal to generate a frequency-domain mid-band signal. For example, referring to FIG. 3, the transform 314 may be applied to the time-domain mid-band signal 336 to generate the frequency-domain mid-band signal 338. The method 1000 may also include generating a side-band bitstream based on the side-band signal, the frequency-domain mid-band signal, and the one or more stereo parameters. For example, referring to FIG. 3, the side-band encoder 310 may generate the side-band bitstream 164 based on the stereo parameters 162, the frequency-domain sideband signal 334, and the frequency-domain mid-band signal 338.

The method 1000 may also include generating a frequency-domain mid-band signal based on the frequency-domain first audio signal and the frequency-domain adjusted second audio signal and additionally or alternatively based on the stereo parameters. For example, referring to FIGS. 5-6, the mid-band signal generator 502 may generate the frequency-domain mid-band signal 530 based on the frequency-domain reference signal 330 and the frequency-domain adjusted target signal 332 and additionally or alternatively based on the stereo parameters 162. The method 1000 may also include encoding the frequency-domain mid-band signal to generate a mid-band bitstream. For example, referring to FIG. 5, the mid-band encoder 504 may encode the frequency-domain mid-band signal 530 to generate the mid-band bitstream 166.

The method 1000 may also include generating a side-band signal based on the frequency-domain first audio signal, the frequency-domain adjusted second audio signal, and the one or more stereo parameters. For example, referring to FIGS. 5-6, the side-band generator 308 may generate the frequency-domain sideband signal 334 based on the frequency-domain reference signal 330 and the frequency-domain adjusted target signal 332. According to one implementation, the method 1000 includes generating a side-band bitstream based on the side-band signal, the mid-band bitstream, and the one or more stereo parameters. For example, referring to FIG. 6, the mid-band bitstream 166 may be provided to the side-band encoder 602. The side-band encoder 602 may be configured to generate the side-band bitstream 164 based on the stereo parameters 162, the frequency-domain sideband signal 334, and the mid-band bitstream 166. According to another implementation, the method 1000 includes generating a side-band bitstream based on the side-band signal, the frequency-domain mid-band signal, and the one or more stereo parameters. For example, referring to FIG. 5, the side-band encoder 506 may generate the side-band bitstream 164 based on the stereo parameters 162, the frequency-domain sideband signal 334, and the frequency-domain mid-band signal 530.

According to one implementation, the method 1000 may also include generating a first downsampled signal by downsampling the first audio signal and generating a second downsampled signal by downsampling the second audio signal. The method 1000 may also include determining comparison values based on the first downsampled signal and a plurality of shift values applied to the second downsampled signal. The shift value may be based on the comparison values.

According to another implementation, the method 1000 may also include determining a first shift value corresponding to first particular samples of the first audio signal that precede the first samples and determining an amended shift value based on comparison values corresponding to the first audio signal and the second audio signal. The shift value may be based on a comparison of the amended shift value and the first shift value.

The method 1000 of FIG. 10 may enable the frequency-domain stereo coder 109 to transform the reference signal 190 and the adjusted target signal 192 into the frequency-domain to generate the stereo parameters 162, the side-band bitstream 164, and the mid-band bitstream 166. The time-shifting techniques of the temporal equalizer 108 that temporally shift the first audio signal 130 to align with the second audio signal 132 may be implemented in conjunction with frequency-domain signal processing. To illustrate, temporal equalizer 108 estimates a shift (e.g., a non-casual shift value) for each frame at the encoder 114, shifts (e.g., adjusts) a target channel according to the non-casual shift value, and uses the shift adjusted channels for the stereo parameters estimation in the transform-domain.

Figure 11:
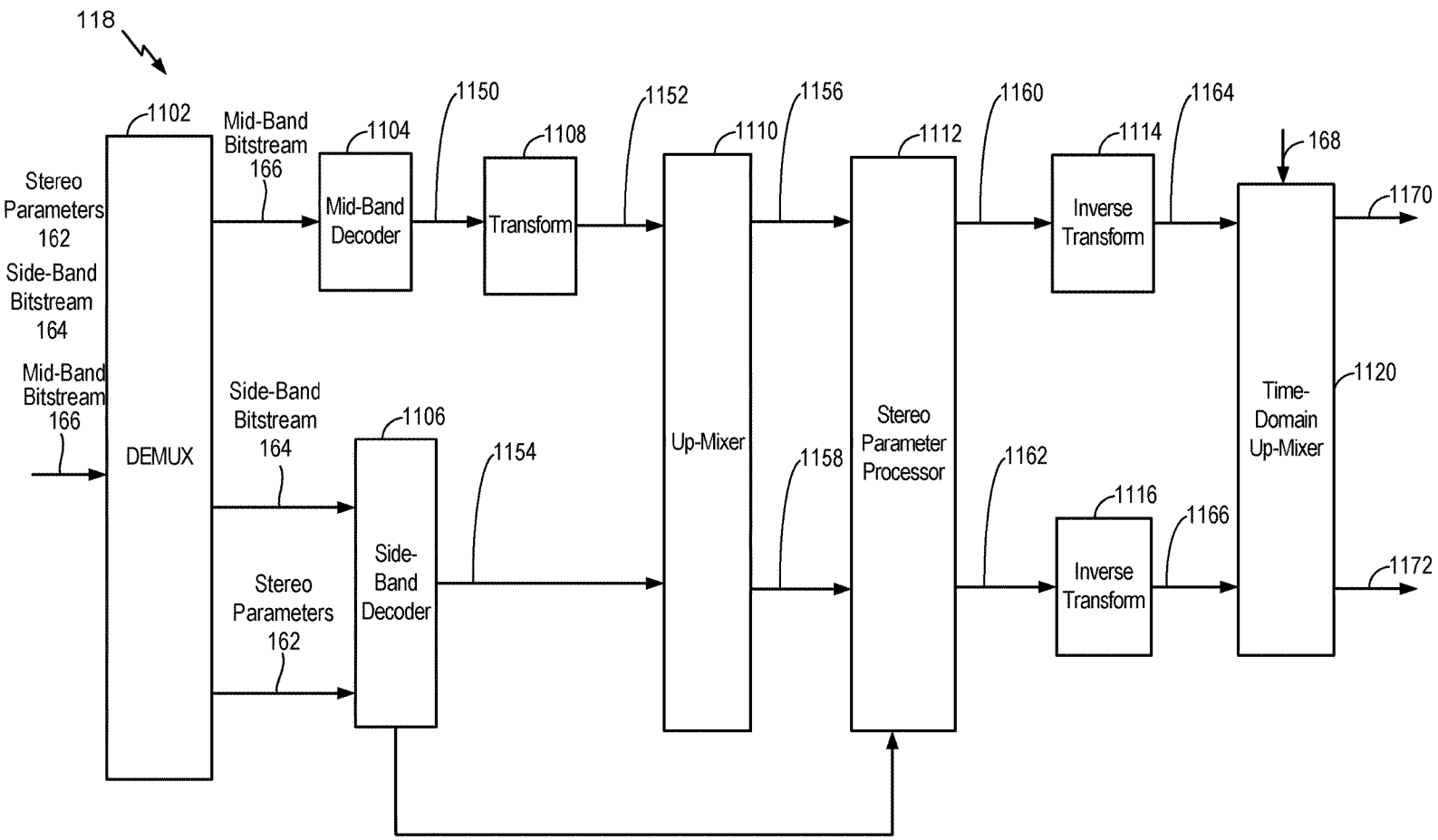
FIG. 11 is a diagram illustrating a decoder operable to decode audio signals.

Referring to FIG. 11, a diagram illustrating a particular implementation of the decoder 118 is shown. An encoded audio signal is provided to a demultiplexer (DEMUX) 1102 of the decoder 118. The encoded audio signal may include the stereo parameters 162, the side-band bitstream 164, and the mid-band bitstream 166. The demultiplexer 1102 may be configured to extract the mid-band bitstream 166 from the encoded audio signal and provide the mid-band bitstream 166 to a mid-band decoder 1104. The demultiplexer 1102 may also be configured to extract the side-band bitstream 164 and the stereo parameters 162 (e.g., ILDs, IPDs) from the encoded audio signal. The side-band bitstream 164 and the stereo parameters 162 may be provided to a side-band decoder 1106.

The mid-band decoder 1104 may be configured to decode the mid-band bitstream 166 to generate a mid-band signal ($m_{CODED}(t)$) 1150. If the mid-band signal 1150 is a time-domain signal, a transform 1108 may be applied to the mid-band signal 1150 to generate a frequency-domain mid-band signal ($M_{CODED}(b)$) 1152. The frequency-domain mid-band signal 1152 may be provided to an up-mixer 1110. However, if the mid-band signal 1150 is a frequency-domain signal, the mid-band signal 1150 may be provided directly to the up-mixer 1110 and the transform 1108 may be bypassed or may not be present in the decoder 118.

The side-band decoder 1106 may generate a side-band signal ($S_{CODED}(b)$) 1154 based on the side-band bitstream 164 and the stereo parameters 162. For example, the error (e) may be decoded for the low-bands and the high-bands. The side-band signal 1154 may be expressed as $S_{PRED}(b)+e_{CODED}(b)$, where $S_{PRED}(b)=M_{CODED}(b)*(ILD(b)-1)/(ILD(b)+1)$. The side-band signal 1154 may also be provided to the up-mixer 1110.

The up-mixer 1110 may perform an up-mix operation based on the frequency-domain mid-band signal 1152 and the side-band signal 1154. For example, the up-mixer 1110 may generate a first up-mixed signal ($L_{fr}$) 1156 and a second up-mixed signal ($R_{fr}$) 1158 based on the frequency-domain mid-band signal 1152 and the side-band signal 1154. Thus, in the described example, the first up-mixed signal 1156 may be a left-channel signal, and the second up-mixed signal 1158 may be a right-channel signal. The first up-mixed signal 1156 may be expressed as $M_{CODED}(b)+S_{CODED}(b)$, and the second up-mixed signal 1158 may be expressed as $M_{CODED}(b)-S_{CODED}(b)$. The up-mixed signals 1156, 1158 may be provided to a stereo parameter processor 1112.

The stereo parameter processor 1112 may apply the stereo parameters 162 (e.g., ILDs, IPDs) to the up-mixed signals 1156, 1158 to generate signals 1160, 1162. For example, the stereo parameters 162 (e.g., ILDs, IPDs) may be applied to the up-mixed left and right channels in the frequency-domain. When available, the IPD (phase differences) may be spread on the left and right channels to maintain the inter-channel phase differences. An inverse transform 1114 may be applied to the signal 1160 to generate a first time-domain signal l(t) 1164, and an inverse transform 1116 may be applied to the signal 1162 to generate a second time-domain signal r(t) 1166. Non-limiting examples of the inverse transforms 1114, 1116 include Inverse Discrete Cosine Transform (IDCT) operations, Inverse Fast Fourier Transform (IFFT) operations, etc. According to one implementation, the first time-domain signal 1164 may be a reconstructed version of the reference signal 190, and the second time-domain signal 1166 may be a reconstructed version of the adjusted target signal 192.

According to one implementation, the operations performed at the up-mixer 1110 may be performed at the stereo parameter processor 1112. According to another implementation, the operations performed at the stereo parameter processor 1112 may be performed at the up-mixer 1110. According to yet another implementation, the up-mixer 1110 and the stereo parameter processor 1112 may be implemented within a single processing element (e.g., a single processor).

Additionally, the first time-domain signal 1164 and the second time-domain signal 1166 may be provided to a time-domain up-mixer 1120. The time-domain up-mixer 1120 may perform a time-domain up-mix on the time-domain signals 1164, 1166 (e.g., the inverse-transformed left and right signals). The time-domain up-mixer 1120 may perform a reverse shift adjustment to undo the shift adjustment performed in the temporal equalizer 108 (more specifically the target signal adjuster 210). The time-domain up-mix may be based on the time-domain downmix parameters 168. For example, the time-domain up-mix may be based on the first shift value 262 and the reference signal indicator 264. Additionally, the time-domain up-mixer 1120 may perform inverse operations of other operations performed at a time-domain down-mix module which may be present.

Figure 12:
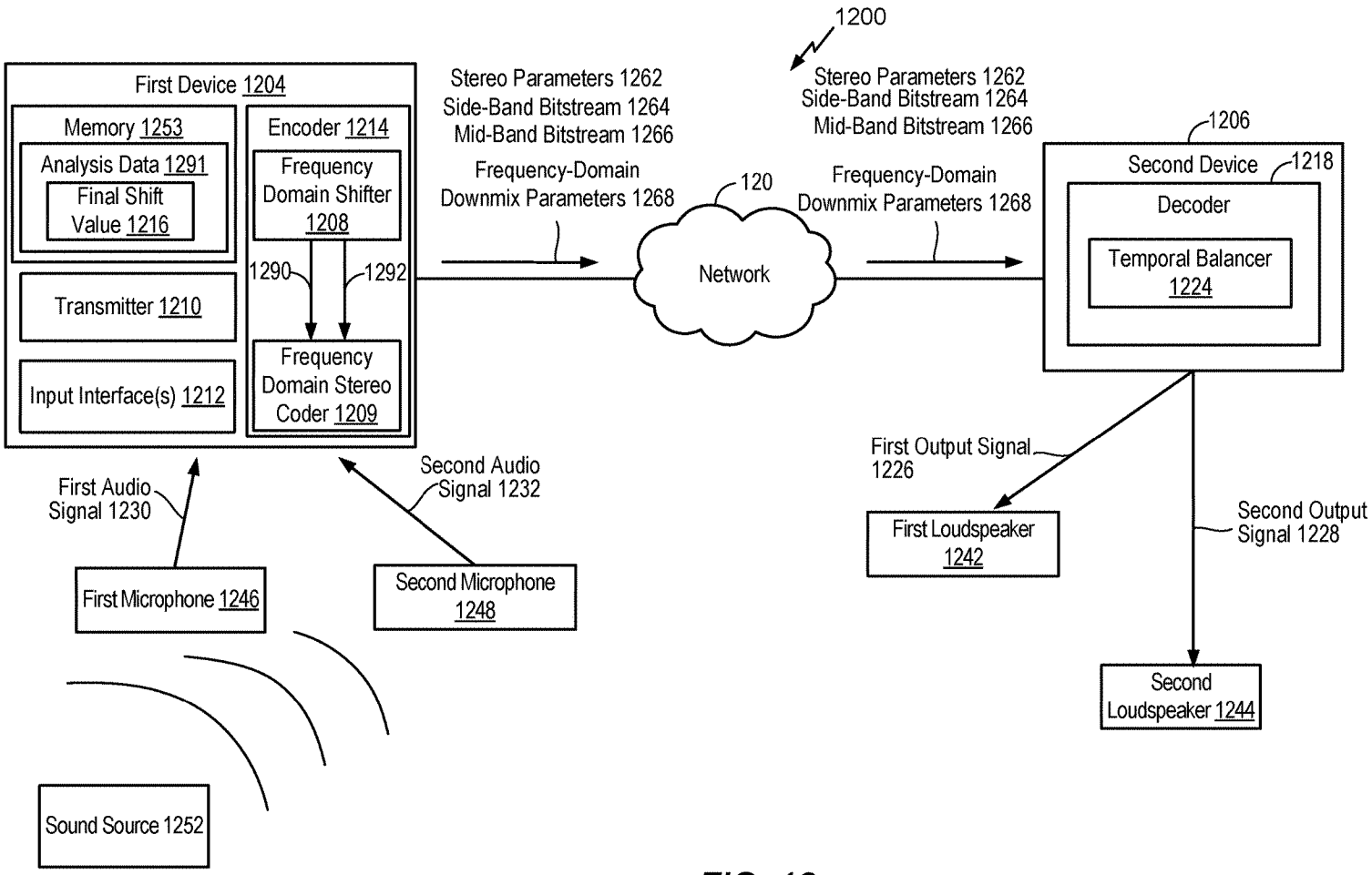
FIG. 12 is another block diagram of a particular illustrative example of a system that includes an encoder operable to encode multiple audio signals.

Referring to FIG. 12, a particular illustrative example of a system is disclosed and generally designated 1200. The system 1200 includes a first device 1204 communicatively coupled, via the network 120, to a second device 1206. The first device 1204 may correspond to the first device 104 of FIG. 1, and the second device 1206 may correspond to the second device 106 of FIG. 1. For example, components of the first device 104 of FIG. 1 may also be included in the first device 1204, and components of the second device 106 of FIG. 1 may also be included in the second device 1206. Thus, in addition to the coding techniques described with respect to FIG. 12, the first device 1204 may operate in a substantially similar manner as the first device 104 of FIG. 1, and the second device 1206 may operate in a substantially similar manner as the second device 106 of FIG. 1.

The first device 1204 may include an encoder 1214, a transmitter 1210, input interfaces 1212, or a combination thereof. According to one implementation, the encoder 1214 may correspond to the encoder 114 of FIG. 1 and may operate in a substantially similar manner, the transmitter 1210 may correspond to the transmitter 110 of FIG. 1 and may operate in a substantially similar manner, and the input interfaces 1212 may correspond to the input interfaces 112 of FIG. 1 and may operate in a substantially similar manner. A first input interface of the input interfaces 1212 may be coupled to a first microphone 1246. A second input interface of the input interfaces 1212 may be coupled to a second microphone 1248. The encoder 1214 may include a frequency-domain shifter 1208 and a frequency-domain stereo coder 1209 and may be configured to downmix and encode multiple audio signals, as described herein. The first device 1204 may also include a memory 1253 configured to store analysis data 1291. The second device 1206 may include a decoder 1218. The decoder 1218 may include a temporal balancer 1224 that is configured to upmix and render the multiple channels. The second device 1206 may be coupled to a first loudspeaker 1242, a second loudspeaker 1244, or both.

During operation, the first device 1204 may receive a first audio signal 1230 via the first input interface from the first microphone 1246 and may receive a second audio signal 1232 via the second input interface from the second microphone 1248. The first audio signal 1230 may correspond to one of a right channel signal or a left channel signal. The second audio signal 1232 may correspond to the other of the right channel signal or the left channel signal. A sound source 1252 may be closer to the first microphone 1246 than to the second microphone 1248. Accordingly, an audio signal from the sound source 1252 may be received at the input interfaces 1212 via the first microphone 1246 at an earlier time than via the second microphone 1248. This natural delay in the multi-channel signal acquisition through the multiple microphones may introduce a temporal mismatch between the first audio signal 1230 and the second audio signal 1232.

The frequency-domain shifter 1208 may be configured to perform a transform operation (e.g., a transform analysis) of the left channel and the right channel to estimate a non-causal shift value in the transform-domain (e.g., the frequency-domain). To illustrate, the frequency-domain shifter 1208 may perform a windowing operation on the left channel and the right channel. For example, the frequency-domain shifter 1208 may perform a windowing operation on the left channel to analyze a particular window of the first audio signal 1230, and the frequency-domain shifter 1208 may perform a windowing operation on the right channel to analyze a corresponding window of the second audio signal 1232. The frequency-domain shifter 1208 may perform a first transform operation (e.g., a DFT operation) on the first audio signal 1230 to convert the first audio signal 1230 from the time-domain to the transform-domain, and the frequency-domain shifter 1208 may perform a second transform operation (e.g., a DFT operation) on the second audio signal 1232 to convert the second audio signal 1232 from the time-domain to the transform-domain.

The frequency-domain shifter 1208 may estimate the non-causal shift value (e.g., a final shift value 1216) based on a phase difference between the first audio signal 1230 in the transform-domain and the second audio signal 1232 in the transform-domain. The final shift value 1216 may be a non-negative value that is associated with a channel indicator. The channel indicator may indicate which audio signal 1230, 1232 is the reference signal (e.g., the reference channel) and which audio signal 1230, 1232 is the target signal (e.g., the target channel). Alternatively, a shift value (e.g., a positive value, a zero value, or a negative value) may be estimated. As used herein, the "shift value" may also be referred to as a "temporal mismatch value." The shift value may be transmitted to the second device 1206.

According to another implementation, an absolute value of the shift value may be the final shift value 1216 (e.g., the non-causal shift value) and a sign of the shift value may indicate which audio signal 1230, 1232 is the reference signal and which audio signal 1230, 1232 is the target signal. The absolute value of the temporal mismatch value (e.g., the final shift value 1216) may be transmitted to the second device 1206 along with the sign of the mismatch value to indicate which channel is the reference channel and which channel is the target channel.

After determining the final shift value 1216, the frequency-domain shifter 1208 temporally aligns the target signal and the reference signal by performing a phase rotation of the target signal in the transform-domain (e.g., the frequency-domain). To illustrate, if the first audio signal 1230 is the reference signal, a frequency-domain signal 1290 may correspond to the first audio signal 1230 in the transform-domain. The frequency-domain shifter 1208 may perform a phase rotation of the second audio signal 1232 in the transform-domain to generate a frequency-domain signal 1292 that is temporally aligned with the frequency-domain signal 1290. The frequency-domain signal 1290 and the frequency-domain signal 1292 may be provided to the frequency-domain stereo coder 1209.

Thus, the frequency-domain shifter 1208 may temporally align the transform-domain version of the second audio signal 1232 (e.g., the target signal) to generate the signal 1292 such that transform-domain version of the first audio signal 1230 and the signal 1292 are substantially synchronized. The frequency-domain shifter 1208 may generate frequency-domain downmix parameters 1268. The frequency-domain downmix parameters 1268 may indicate a shift value between the target signal and the reference signal. In other implementations, the frequency-domain downmix parameters 1268 may include additional parameters like a downmix gain etc.

The frequency-domain stereo coder 1209 may estimate stereo parameters 1262 based on frequency-domain signals (e.g., the frequency-domain signals 1290, 1292). The stereo parameters 1262 may include parameters that enable rendering of spatial properties associated with left channels and right channels. According to some implementations, the stereo parameters 1262 may include parameters such as inter-channel intensity difference (IID) parameters (e.g., inter-channel level differences (ILDs), an alternative to ILDS called side-band gains, inter-channel time difference (ITD) parameters, inter-channel phase difference (IPD) parameters, inter-channel correlation (ICC) parameters, non-causal shift parameters, spectral tilt parameters, inter-channel voicing parameters, inter-channel pitch parameters, inter-channel gain parameters, etc. It should be understood that unless mentioned explicitly, ILDs could also refer to the alternative side-band gains. The ITD parameter may correspond to the temporal mismatch value or the final shift value 1216. The stereo parameters 1262 may be used at the frequency-domain stereo coder 1209 during generation of other signals. The stereo parameters 1262 may also be transmitted as part of an encoded signal. According to one implementation, operations performed by the frequency-domain stereo coder 1209 may also be performed by the frequency-domain shifter 1208. As a non-limiting example, the frequency-domain shifter 1208 may determine the ITD parameters and use the ITD parameters as the final shift value 1216.

The frequency-domain stereo coder 1209 may also generate a side-band bitstream 1264 and a mid-band bitstream 1266 based at least in part on the frequency-domain signals. For purposes of illustration, unless otherwise noted, it is assumed that that the frequency-domain signal 1290 (e.g., a reference signal) is a left-channel signal (l or L) and the frequency-domain signal 1292 is a right-channel signal (r or R). The frequency-domain signal 1290 may be noted as $L_{fr}(b)$ and the frequency-domain signal 1292 may be noted as $R_{fr}(b)$, where b represents a band of the frequency-domain representations. According to one implementation, a side-band signal $S_{fr}(b)$ may be generated in the frequency-domain from the frequency-domain signal 1290 and the frequency-domain signal 1292. For example, the side-band signal $S_{fr}(b)$ may be expressed as $(L_{fr}(b)-R_{fr}(b))/2$. The side-band signal $S_{fr}(b)$ may be provided to a side-band encoder to generate the side-band bitstream 1264. A mid-band signal $M_{fr}(b)$ may also be generated from the frequency-domain signals 1290, 1292.

The side-band signal $S_{fr}(b)$ and the mid-band signal $M_{fr}(b)$ may be encoded using multiple techniques. One implementation of side-band coding includes predicting a side-band $S_{PRED}(b)$ from the frequency-domain mid-band signal $M_{fr}(b)$ using the information in the frequency mid-band signal $M_{fr}(b)$ and the stereo parameters 1262 (e.g., ILDs) corresponding to the band (b). For example, the predicted side-band $S_{PRED}(b)$ may be expressed as $M_{fr}(b)*(ILD(b)-1)/(ILD(b)+1)$. An error signal e(b) in the band (b) may be calculated as a function of the side-band signal $S_{fr}(b)$ and the predicted side-band $S_{PRED}(b)$. For example, the error signal e(b) may be expressed as $S_{fr}(b)-S_{PRED}(b)$. The error signal e(b) may be coded using transform-domain coding techniques to generate a coded error signal $e_{CODED}(b)$. For upper-bands, the error signal e(b) may be expressed as a scaled version of a mid-band signal $M_PAST_{fr}(b)$ in the band (b) from a previous frame. For example, the coded error signal $e_{CODED}(b)$ may be expressed as $g_{PRED}(b)*M_PAST_{fr}(b)$, where $g_{PRED}(b)$ may be estimated such that an energy of $e(b)-g_{PRED}(b)*M_PAST_{fr}(b)$ is substantially reduced (e.g., minimized).

The transmitter 1210 may transmit the stereo parameters 1262, the side-band bitstream 1264, the mid-band bitstream 1266, the frequency-domain downmix parameters 1268, or a combination thereof, via the network 120, to the second device 1206. Alternatively, or in addition, the transmitter 1210 may store the stereo parameters 1262, the side-band bitstream 1264, the mid-band bitstream 1266, the frequency-domain downmix parameters 1268, or a combination thereof, at a device of the network 120 or a local device for further processing or decoding later. Because a non-causal shift (e.g., the final shift value 1216) may be determined during the encoding process, transmitting IPDs and/or the ITDs (e.g., as part of the stereo parameters 1262) in addition to the non-causal shift in each band may be redundant. Thus, in some implementations, an IPD and/or an ITD and non-casual shift may be estimated for the same frame but in mutually exclusive bands. In other implementations, lower resolution IPDs may be estimated in addition to the shift for finer per-band adjustments. Alternatively, IPDs and/or ITDs may be not determined for frames where the non-casual shift is determined.

The decoder 1218 may perform decoding operations based on the stereo parameters 1262, the side-band bitstream 1264, the mid-band bitstream 1266, and the frequency-domain downmix parameters 1268. The decoder 1218 (e.g., the second device 1206) may causally shift a regenerated target signal to undo the non-causal shifts performed by the encoder 1214. The causal shift may be performed in the frequency-domain (e.g., by phase rotation) or in the time-domain. The decoder 1218 may perform upmixing to generate a first output signal 1226 (e.g., corresponding to first audio signal 1230), a second output signal 1228 (e.g., corresponding to the second audio signal 1232), or both. The second device 1206 may output the first output signal 1226 via the first loudspeaker 1242. The second device 1206 may output the second output signal 1228 via the second loudspeaker 1244. In alternative examples, the first output signal 1226 and second output signal 1228 may be transmitted as a stereo signal pair to a single output loudspeaker.

The system 1200 may thus enable the frequency-domain stereo coder 1209 to generate the stereo parameters 1262, the side-band bitstream 1264, and the mid-band bitstream 1266. The frequency-shifting techniques of the frequency-domain shifter 1208 may be implemented in conjunction with frequency-domain signal processing. To illustrate, the frequency-domain shifter 1208 estimates a shift (e.g., a non-casual shift value) for each frame at the encoder 1214, shifts (e.g., adjusts) a target channel according to the non-casual shift value, and uses the shift adjusted channels for the stereo parameters estimation in the transform-domain.

Figure 13:
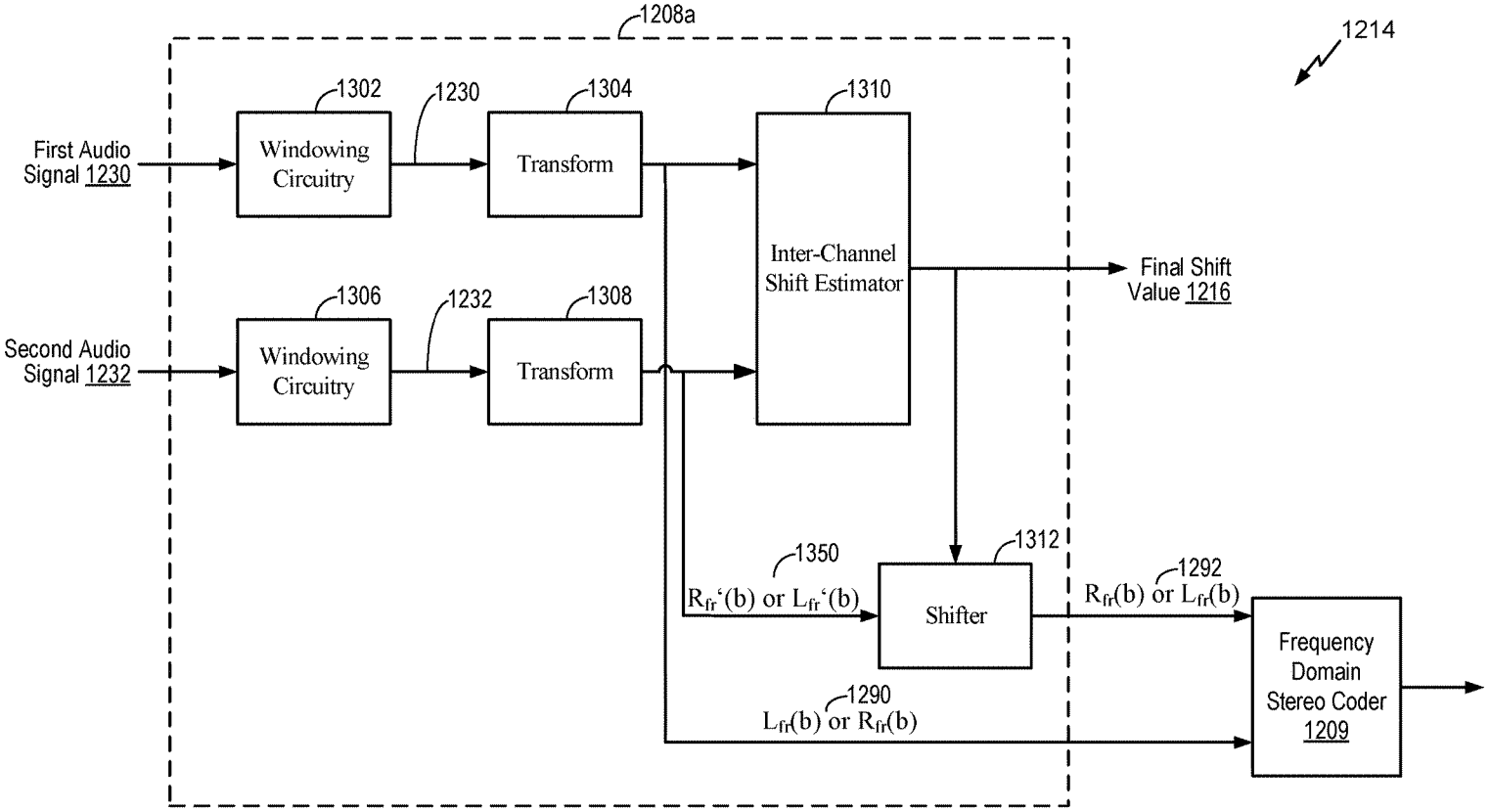
FIG. 13 is a diagram illustrating the encoder of FIG. 12.

Referring to FIG. 13, an illustrative example of the encoder 1214 of the first device 1204 is shown. The encoder 1214 includes a first implementation **1208*a* of the frequency-domain shifter 1208 and the frequency-domain stereo coder 1209. The frequency-domain shifter 1208*a* includes windowing circuitry 1302**, transform circuitry

1304, windowing circuitry 1306, transform circuitry 1308, an inter-channel shift estimator 1310, and a shifter 1312.

During operation, the first audio signal 1230 (e.g., a time-domain signal) may be provided to the windowing circuitry 1302 and the second audio signal 1232 (e.g., a time-domain signal) may be provided to the windowing circuitry 1306. The windowing circuitry 1302 may perform a windowing operation on the left channel (e.g., the channel corresponding to the first audio signal 1230) to analyze a particular window of the first audio signal 1230. The windowing circuitry 1306 may perform a windowing operation the right channel (e.g., the channel corresponding to the second audio signal 1232) to analyze a corresponding window of the second audio signal 1232.

The transform circuitry 1304 may perform a first transform operation (e.g., a Discrete Fourier Transform (DFT) operation) on the first audio signal 1230 to convert the first audio signal 1230 from the time-domain to the transform-domain. For example, the transform circuitry 1304 may perform the first transform operation on the first audio signal 1230 to generate the frequency-domain signal 1290. The frequency-domain signal 1290 may be provided to the inter-channel shift estimator 1310 and to the frequency-domain stereo coder 1209. The transform circuitry 1308 may perform a second transform operation (e.g., a DFT operation) on the second audio signal 1232 to convert the second audio signal 1232 from the time-domain to the transform-domain. For example, the transform circuitry 1308 may perform the second transform operation on the second audio signal 1232 to generate a time-domain signal 1350. The time-domain signal 1350 may be provided to the inter-channel shift estimator 1310 and to the shifter 1312.

The inter-channel shift estimator 1310 may estimate the final shift value 1216 (e.g., the non-causal shift value or an ITD value) based on a phase difference between the frequency-domain signal 1290 and the frequency-domain signal 1350. The final shift value 1216 may be provided to the shifter 1312. As used herein, the "final shift value" may as be referred to as the "final temporal mismatch value". Thus, the terms "shift value" and "temporal mismatch value" may be used interchangeably herein. According to one implementation, the final shift value 1216 is coded and provided to the second device 1206. The shifter 1312 performs a phase-shift operation (e.g., a phase-rotation operation) on the transform-domain 1350 signal to generate the frequency-domain signal 1292. The phase of the frequency-domain signal 1292 is such that the frequency-domain signal 1292 and the frequency-domain signal 1290 are temporally aligned.

In FIG. 13, it is assumed that the second audio signal 1232 is the target signal. However, if the target signal is unknown, the frequency-domain signal 1350 and the frequency-domain signal 1290 may be provided to the shifter 1312. The final shift value 1216 may indicate which frequency-domain signal 1350, 1290 corresponds to the target signal, and the shifter 1312 may perform the phase-rotation operation on the frequency-domain signal 1350, 1290 that corresponds to the target signal. Phase-rotation operations based on the final shift values may be bypassed on the other signal. It should be noted that other phase rotation operations based on the calculated IPDs (if available) may also be performed. The frequency-domain signal 1292 may be provided to the frequency-domain stereo coder 1209. Operations of the frequency-domain stereo coder 1209 are described with respect to FIGS. 15-16.

Figure 14:
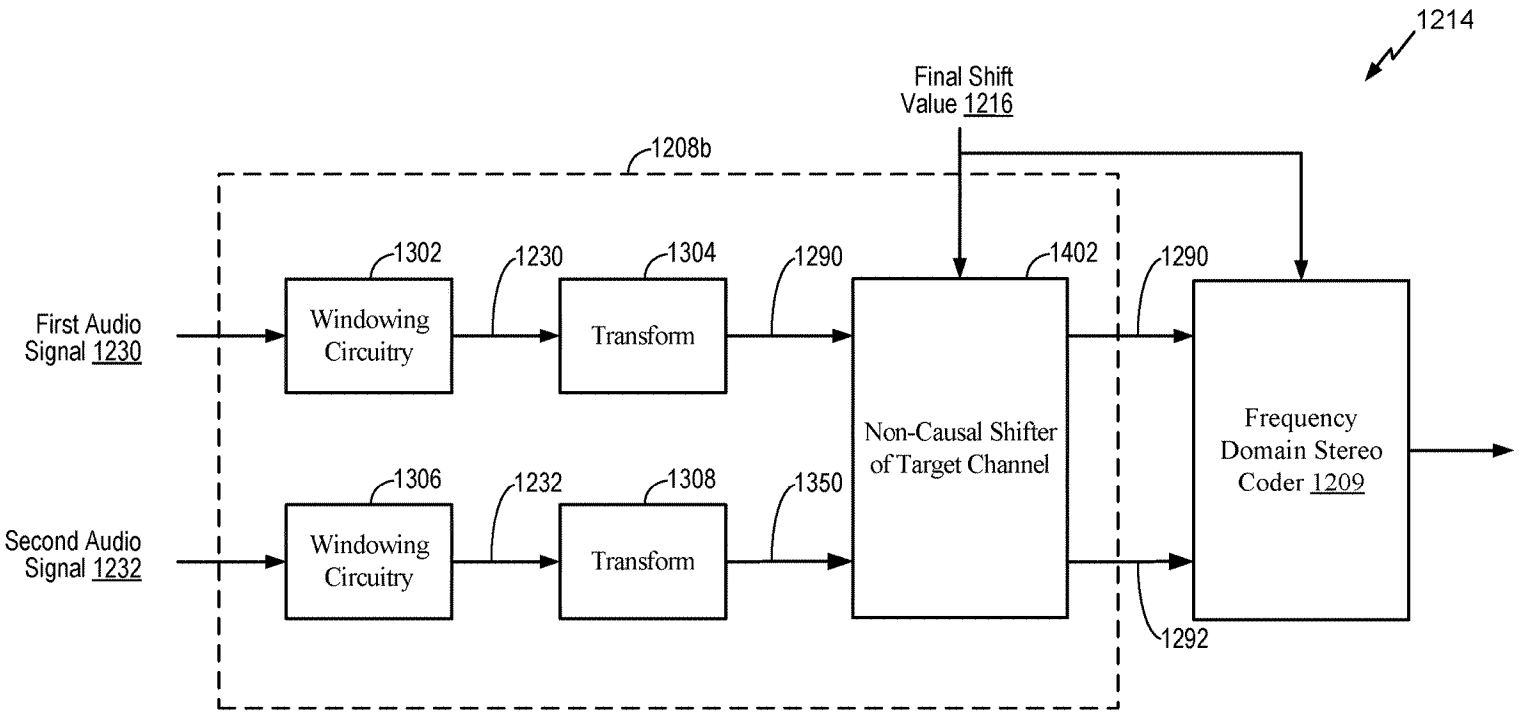
FIG. 14 is another diagram illustrating the encoder of FIG. 12.

Referring to FIG. 14, another illustrative example of the encoder 1214 of the first device 1204 is shown. The encoder 1214 includes a second implementation **1208*b* of the frequency-domain shifter 1208 and the frequency-domain stereo coder 1209. The frequency-domain shifter 1208*b* includes the windowing circuitry 1302, the transform circuitry 1304, the windowing circuitry 1306, the transform circuitry 1308, and a non-causal shifter 1402**.

The windowing circuitry 1302, 1306 and the transform circuitry 1304, 1308 may operate in a substantially similar manner as described with respect to FIG. 13. For example, the windowing circuitry 1302, 1306 and the transform circuitry 1304, 1308 may generate the frequency-domain signals 1290, 1350 based on the audio signal 1230, 1232, respectively. The frequency-domain signal 1290, 1350 may be provided to the non-causal shifter 1402.

The non-causal shifter 1402 may temporally align the target channel and the reference channel in the frequency-domain. For example, the non-causal shifter 1402 may perform a phase-rotation of the target channel to non-causally shift the target channel to align with the reference channel. The final shift value 1216 may be provided from the memory 1253 to the non-causal shifter 1402. According to some implementations, a shift value (estimated based on time-domain techniques or frequency-domain techniques) from a previous frame may be used as the final shift value 1216. Thus, the shift value from the previous frame may be used on a frame-by-frame basis where time-domain down-mix technologies and frequency-domain down-mix technologies are selected in the CODEC based on a particular metric. The final shift value 1216 (e.g., the non-causal shift value) may indicate the non-causal shift and may indicate the target channel. The final shift value 1216 may be estimated in the time-domain or in the transform-domain. For example, the final shift value 1216 may indicate that the right channel (e.g., the channel associated with the frequency-domain signal 1350) is the target channel. The non-causal shifter 1402 may rotate a phase of the frequency-domain signal 1350 by the shift amount indicated in the final shift value 1216 to generate the frequency-domain signal 1292. The frequency-domain signal 1292 may be provided to the frequency-domain stereo coder 1209. The non-causal shifter 1402 may pass the frequency-domain signal 1290 (e.g., the reference channel in this example) to the frequency-domain stereo coder 1209. The final shift value 1216 indicates the frequency-domain signal 1290 as the reference channel which may result in bypassing phase rotation based on the final shift values of the frequency-domain signal 1290. It should be noted that other phase rotation operations based on the calculated IPDs (if available), may be performed. Operations of the frequency-domain stereo coder 1209 are described with respect to FIGS. 15-16.

Figure 15:
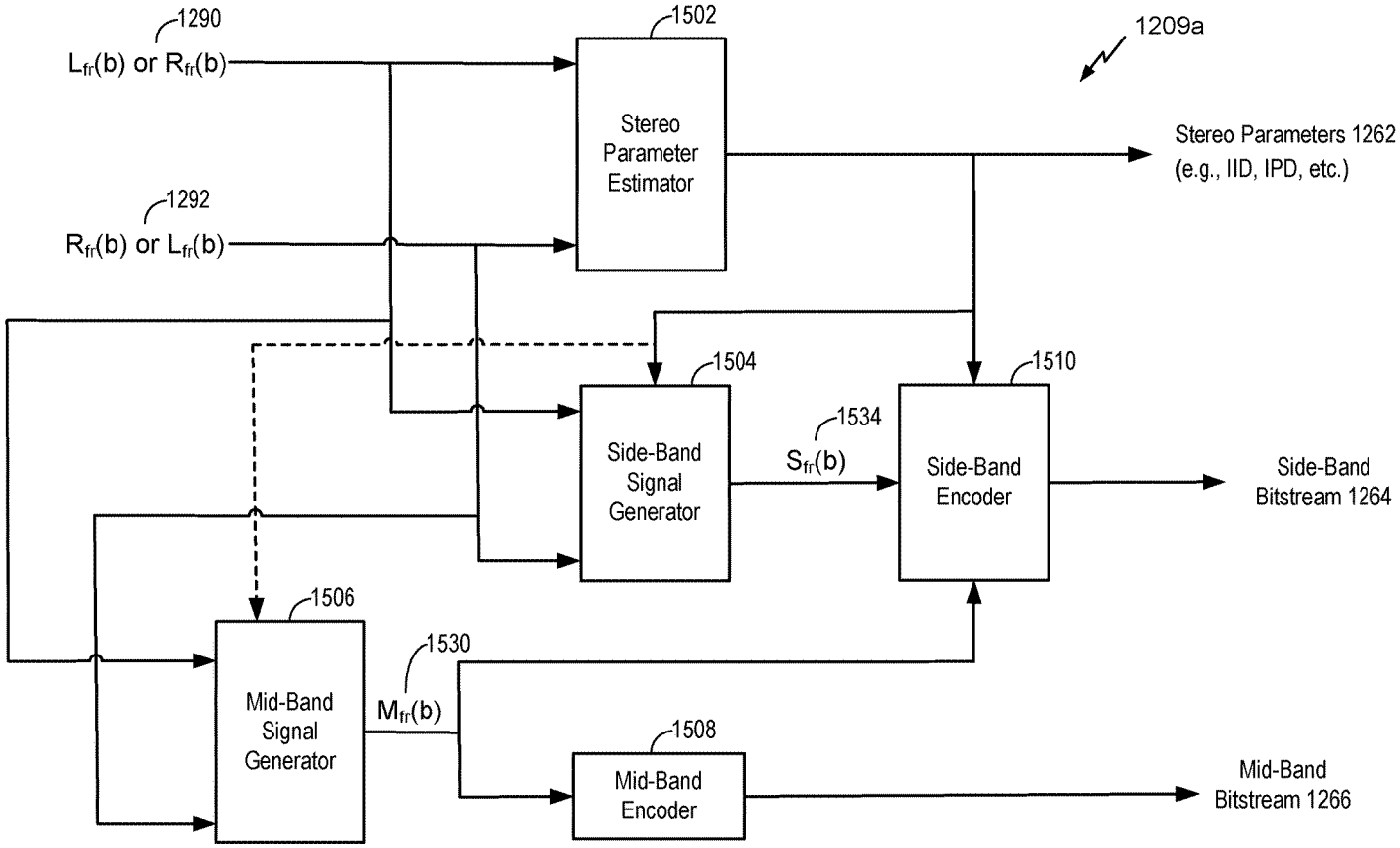
FIG. 15 is a diagram illustrating a first implementation of a frequency-domain stereo coder of the encoder of FIG. 12.

Referring to FIG. 15, a first implementation **1209*a* of the frequency-domain stereo coder 1209 is shown. The first implementation 1209*a* of the frequency-domain stereo coder 1209 includes a stereo parameter estimator 1502, a side-band signal generator 1504, a mid-band signal generator 1506, a mid-band encoder 1508, and a side-band encoder 1510**.

The frequency-domain signals 1290, 1292 may be provided to the stereo parameter estimator 1502. The stereo parameter estimator 1502 may extract (e.g., generate) the stereo parameters 1262 based on the frequency-domain signals 1290, 1292. To illustrate, IID(b) may be a function of the energies $E_L(b)$ of the left channels in the band (b) and the energies $E_R(b)$ of the right channels in the band (b). For example, IID(b) may be expressed as $20*\log_{10}(E_L(b)/E_R(b))$. IPDs estimated at and transmitted by an encoder may provide an estimate of the phase difference in the frequency-domain between the left and right channels in the band (b). The stereo parameters 1262 may include additional (or alternative) parameters, such as ICCs, ITDs etc. The stereo parameters 1262 may be transmitted to the second device 1206 of FIG. 12, provided to the side-band signal generator 1504, and provided to the side-band encoder 1510.

The side-band generator 1504 may generate a frequency-domain sideband signal ($S_{fr}(b)$) 1534 based on the frequency-domain signals 1290, 1292. The frequency-domain sideband signal 1534 may be estimated in the frequency-domain bins/bands. In each band, the gain parameter (g) is different and may be based on the inter-channel level differences (e.g., based on the stereo parameters 1262). For example, the frequency-domain sideband signal 1534 may be expressed as $(L_{fr}(b)-c(b)*R_{fr}(b))/(1+c(b))$, where c(b) may be the ILD(b) or a function of the ILD(b) (e.g., c(b)=10^(ILD(b)/20)). The frequency-domain sideband signal 1534 may be provided to the side-band encoder 1510.

The frequency-domain signals 1290, 1292 may also be provided to the mid-band signal generator 1506. According to some implementations, the stereo parameters 1262 may also be provided to the mid-band signal generator 1506. The mid-band signal generator 1506 may generate a frequency-domain mid-band signal $M_{fr}(b)$ 1530 based on the frequency-domain signals 1290, 1292. According to some implementations, the frequency-domain mid-band signal $M_{fr}(b)$ 1530 may be generated also based on the stereo parameters 1262. Some methods of generation of the mid-band signal 1530 based on the frequency-domain signals 1290, 1292 and the stereo parameters 162 are as follows.

$$M_{fr}(b)=(L_{fr}(b)+R_{fr}(b))/2$$

$$M_{fr}(b)=c_1(b)*L_{fr}(b)+c_2*R_{fr}(b),$$ where $c_1(b)$ and $c_2(b)$ are complex values.

In some implementations, the complex values $c_1(b)$ and $c_2(b)$ are based on the stereo parameters 162. For example, in one implementation of mid side downmix when IPDs are estimated, $c_1(b)=(\cos(-\gamma)-i*\sin(-\gamma))/2^{0.5}$ and $c_2(b)=(\cos(IPD(b)-\gamma)+i*\sin(IPD(b)-\gamma))/2^{0.5}$ where i is the imaginary number signifying the square root of −1.

The frequency-domain mid-band signal 1530 may be provided to the mid-band encoder 1508 and to the side-band encoder 1510 for the purpose of efficient side band signal encoding. In this implementation, the mid-band encoder 1508 may further transform the mid-band signal 1530 to any other transform/time-domain before encoding. For example, the mid-band signal 1530 ($M_{fr}(b)$) may be inverse-transformed back to time-domain, or transformed to MDCT domain for coding.

The side-band encoder 1510 may generate the side-band bitstream 1264 based on the stereo parameters 1262, the frequency-domain sideband signal 1534, and the frequency-domain mid-band signal 1530. The mid-band encoder 1508 may generate the mid-band bitstream 1266 based on the frequency-domain mid-band signal 1530. For example, the mid-band encoder 1508 may encode the frequency-domain mid-band signal 1530 to generate the mid-band bitstream 1266.

Figure 16:
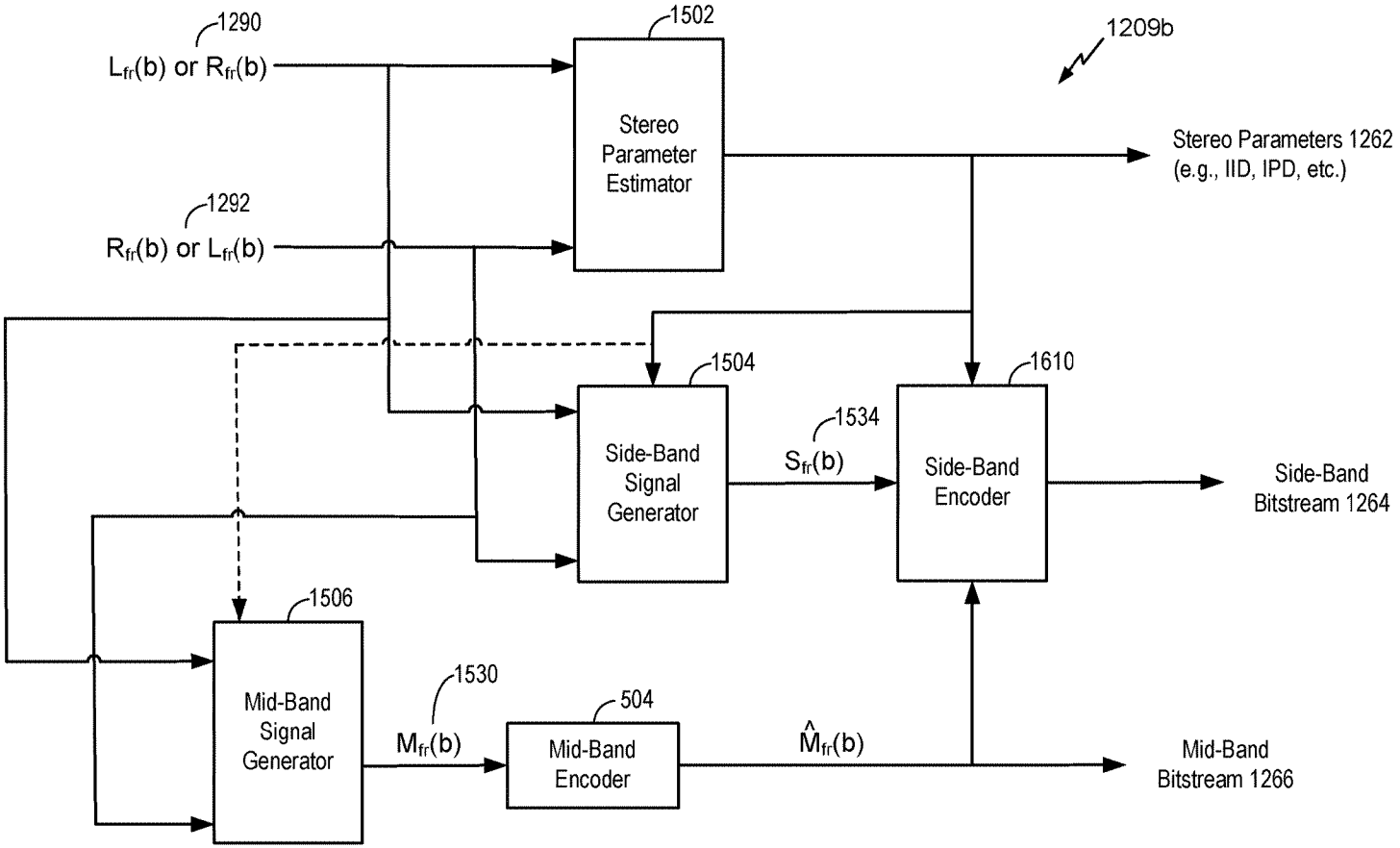
FIG. 16 is a diagram illustrating a second implementation of a frequency-domain stereo coder of the encoder of FIG. 12.

Referring to FIG. 16, a second implementation 1209*b* of the frequency-domain stereo coder 1209 is shown. The second implementation 1209*b* of the frequency-domain stereo coder 1209 includes the stereo parameter estimator 1502, the side-band signal generator 1504, the mid-band signal generator 1506, the mid-band encoder 1508, and a side-band encoder 1610.

The second implementation 1209*b* of the frequency-domain stereo coder 1209 may operate in a substantially similar manner as the first implementation 1209*a* of the frequency-domain stereo coder 1209. However, in the second implementation 1209*b*, the mid-band bitstream 1266 may be provided to the side-band encoder 1610. In an alternate implementation, the quantized mid-band signal based on the mid-band bitstream may be provided to the side-band encoder 1610. The side-band encoder 1610 may be configured to generate the side-band bitstream 1264 based on the stereo parameters 1262, the frequency-domain sideband signal 1534, and the mid-band bitstream 1266.

Figure 17:
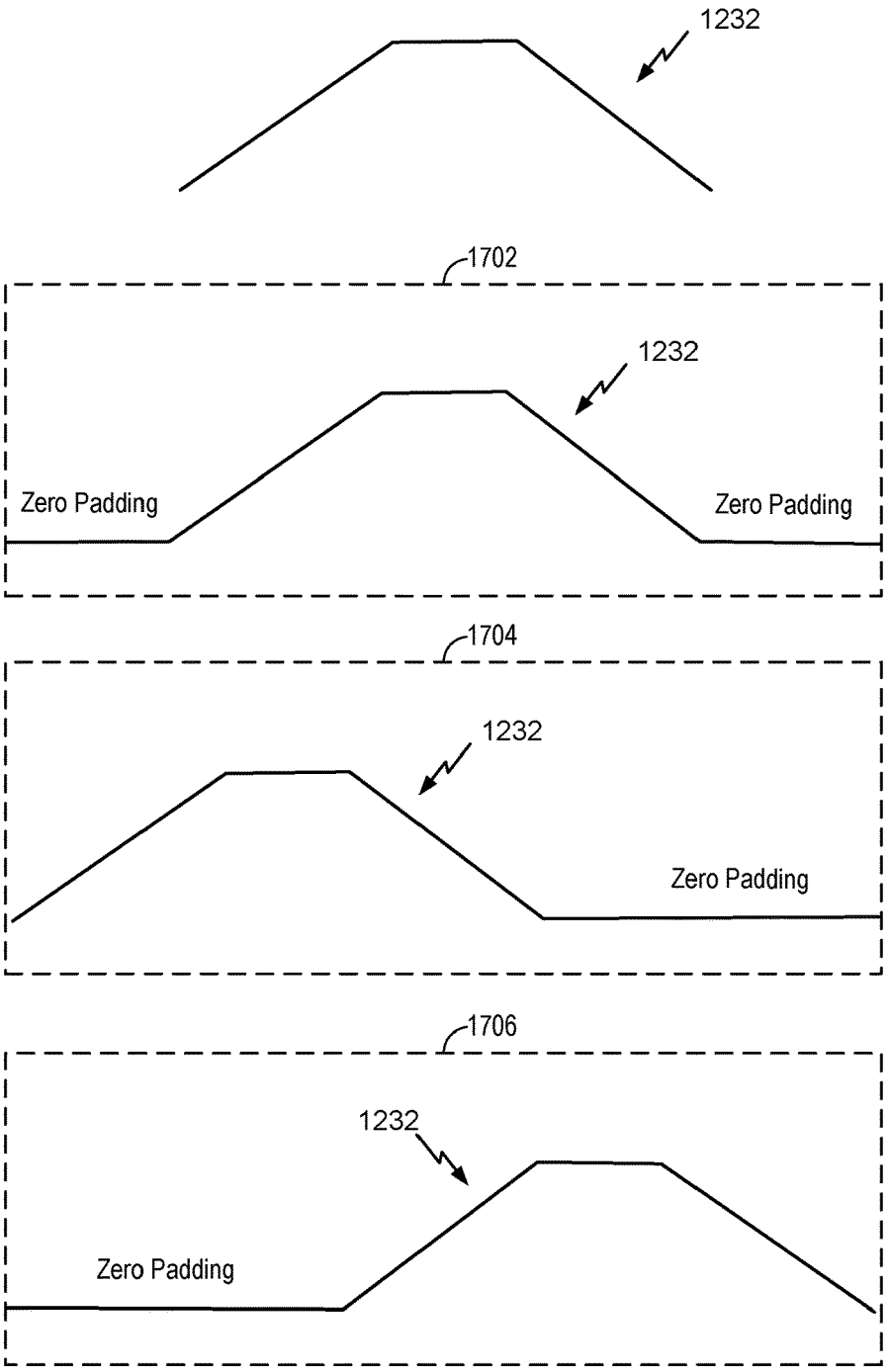
FIG. 17 illustrates zero-padding techniques.

Referring to FIG. 17, examples of zero-padding a target signal are shown. The zero-padding techniques described with respect to FIG. 17 may be performed by the encoder 1214 of FIG. 12.

At 1702, a window of the second audio signal 1232 (e.g., the target signal) is shown. The encoder 1214 may perform zero-padding on both sides of the second audio signal 1232, at 1702. For example, content of the second audio signal 1232 in the window may be zero-padded. However, if the second audio signal 1232 (or a frequency-domain version of the second audio signal 1232) undergoes causal or non-causal shifting (e.g., time-shifting or phase-shifting), the non-zero portions of the second audio signal 1232 in the window may be rotated and discontinuities may occur in the temporal domain. Thus, to avoid the discontinuities associated with zero-padding both sides, the amount of zero-padding may be increased. However, increasing the amount of zero-padding may increase the window size and the complexity of the transform operations. Increasing the amount of zero-padding may also increase the end-to-end delay of the stereo or multi-channel coding system.

However, at 1704, a window of the second audio signal 1232 is shown using non-symmetric zero-padding. One example of non-symmetric zero-padding is single-sided zero-padding. In the illustrated example, the right-hand side of the window of the second audio signal 1232 is zero-padded by a relatively large amount and the left-hand side of the window of the second audio signal 1232 is zero-padded by a relative small amount (or not zero-padded). As a result, the second audio signal 1232 may be shifted (to the right) by a relatively large amount without resulting in discontinuities. Additionally, the size of the window is relatively small, which may result in reduced complexity associated with transform operations.

At 1706, a window of the second audio signal 1232 is shown using single-sided (or non-symmetric) zero-padding. In the illustrated example, the left-hand side of the second audio signal 1232 is zero-padded by a relatively large amount and the right-hand side of the second audio signal 1232 is not zero-padded. As a result, the second audio signal 1232 may be shifted (to the left) by a relatively large amount without resulting in discontinuities. Additionally, the size of the window is relatively small, which may result in reduced complexity associated with transform operations.

Thus, the zero-padding techniques described with respect to FIG. 17 may enable a relatively large shift (e.g., a relatively large time-shift or a relatively large phase rotation/shift) of the target channel at the encoder by zero-padding one side of a window based on the direction of the shift as opposed to zero-padding both sides of the window. For example, because the encoder non-causally shifts the target channel, one side of the window may be zero-padded (as illustrated at 1704 and 1706) to facilitate a relatively large shift, and the size of the window may be equal to the size of a window having dual-side zero-padding. Additionally, a decoder may perform a causal shift in response to the non-causal shift at the encoder. As a result, the decoder may zero-pad the opposite side of the window as the encoder to facilitate a relatively large causal shift.

Figure 18:
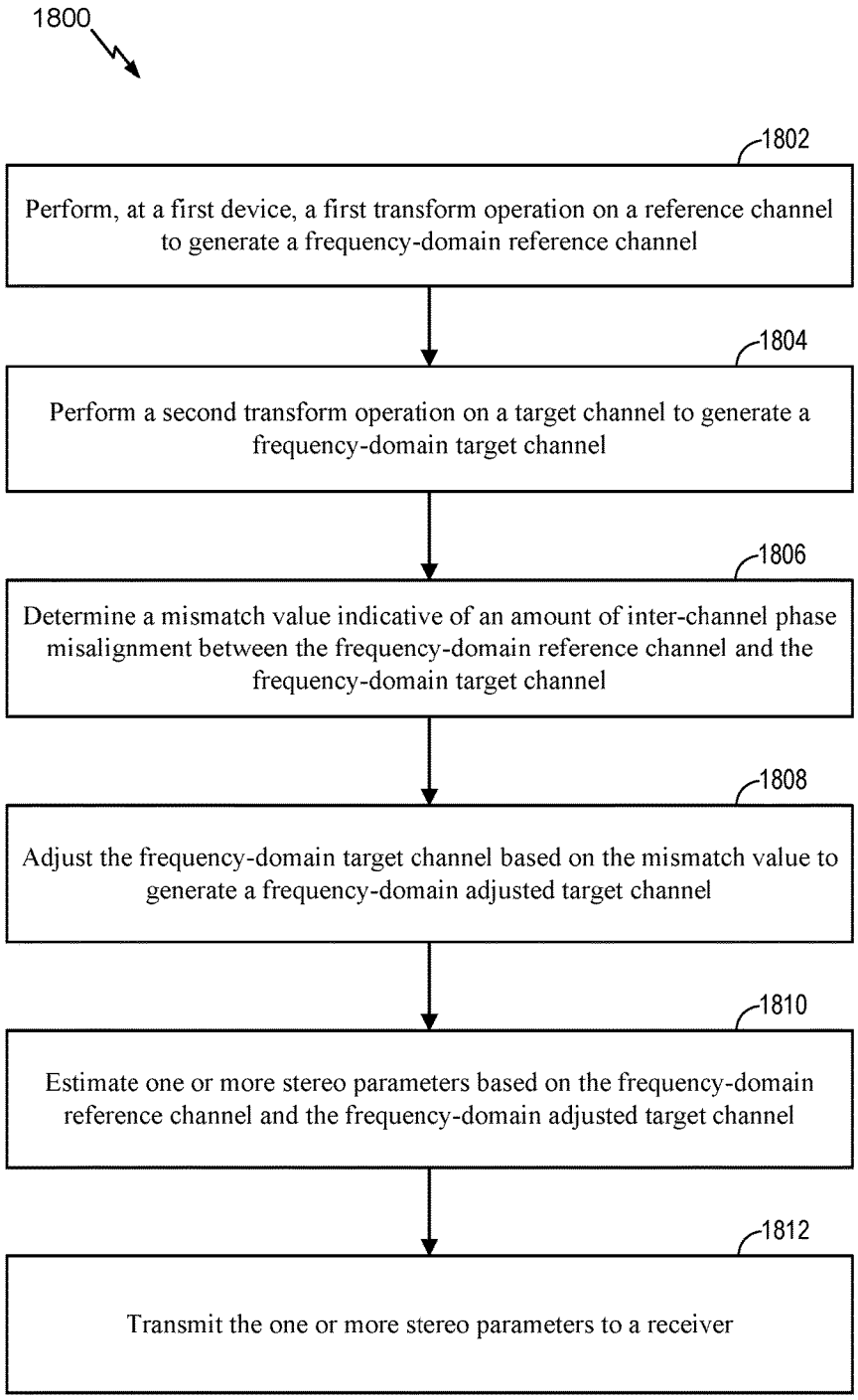
FIG. 18 is a flow chart illustrating a particular method of encoding multiple audio signals.

Referring to FIG. 18, a method 1800 of communication is shown. The method 1800 may be performed by the first device 104 of FIG. 1, the encoder 114 of FIGS. 1-2, frequency-domain stereo coder 109 of FIG. 1-7, the signal pre-processor 202 of FIGS. 2 and 8, the shift estimator 204 of FIGS. 2 and 9, the first device 1204 of FIG. 12, the encoder 1214 of FIG. 12, the frequency-domain shifter 1208 of FIG. 12, the frequency-domain stereo coder 1209 of FIG. 12, or a combination thereof.

The method 1800 includes performing, at a first device, a first transform operation on a reference channel using an encoder-side windowing scheme to generate a frequency-domain reference channel, at 1802. For example, referring to FIG. 13, the transform circuitry 1304 may perform a first transform operation on the first audio signal 1230 (e.g., the reference channel according to the method 1800) to generate the frequency-domain signal 1290 (e.g., the frequency-domain reference channel according to the method 1800).

The method 1800 also includes performing a second transform operation on a target channel using the encoder-side windowing scheme to generate a frequency-domain target channel, at 1804. For example, referring to FIG. 13, the transform circuitry 1308 may perform a second transform operation on the second audio signal 1232 (e.g., the target channel according to the method 1800) to generate the frequency-domain signal 1350 (e.g., the frequency-domain target channel according to the method 1800).

The method 1800 also includes determining a mismatch value indicative of an amount of inter-channel phase misalignment (e.g., phase shift or phase rotation) between the frequency-domain reference channel and the frequency-domain target channel, at 1806. For example, referring to FIG. 13, the inter-channel shift estimator 1310 may determine the final shift value 1216 (e.g., the mismatch value according to the method 1800) indicative of an amount of phase shift between the frequency-domain signal 1290 and the frequency-domain signal 1350.

The method 1800 also includes adjusting the frequency-domain target channel based on the mismatch value to generate a frequency-domain adjusted target channel, at 1808. For example, referring to FIG. 13, the shifter 1312 may adjust the frequency-domain signal 1350 based on the final shift value 1216 to generate the frequency-domain signal 1292 (e.g., the frequency-domain adjusted target channel according to the method 1800).

The method 1800 also includes estimating one or more stereo parameters based on the frequency-domain reference channel and the frequency-domain adjusted target channel, at 1810. For example, referring to FIGS. 15-16, the stereo parameter estimator 1502 may estimate the stereo parameters 1262 based on the frequency-domain channels 1290, 1292. The method 1800 also includes transmitting the one or more stereo parameters to a receiver, at 1812. For example, referring to FIG. 12, the transmitter 1210 may transmit the stereo parameters 1262 to a receiver of the second device 1206.

According to one implementation, the method 1800 includes generating a frequency-domain mid-band channel based on the frequency-domain reference channel and the frequency-domain adjusted target channel. For example, referring to FIG. 15, the mid-band signal generator 1506 may generate the mid-band signal 1530 (e.g., the frequency-domain mid-band channel according to the method 1800) based on the frequency-domain signals 1290, 1292. The method 1800 may also include encoding the frequency-domain mid-band channel to generate a mid-band bitstream. For example, referring to FIG. 15, the mid-band encoder 1508 may encode the frequency-domain mid-band signal 1530 to generate the mid-band bitstream 1266. The method 1800 may also include transmitting the mid-band bitstream to the receiver. For example, referring to FIG. 12, the transmitter 1210 may transmit the mid-band bitstream 1266 to the receiver of the second device 1206.

According to one implementation, the method 1800 includes generating a side-band channel based on the frequency-domain reference channel, the frequency-domain adjusted target channel, and the one or more stereo parameters. For example, referring to FIG. 15, the side-band signal generator 1504 may generate the frequency-domain side-band signal 1534 (e.g., the side-band channel according to the method 1800) based on the frequency-domain signals 1290, 1292 and the stereo parameters 1262. The method 1800 may also include generating a side-band bitstream based on the side-band channel, the frequency-domain mid-band channel, and the one or more stereo parameters. For example, referring to FIG. 15, the side-band encoder 1510 may generate the side-band bitstream 1264 based on the stereo parameters 1262, the frequency-domain sideband signal 1534, and the frequency-domain mid-band signal 1530. The method 1800 may also include transmitting the side-band bitstream to the receiver. For example, referring to FIG. 12, the transmitter may transmit the side-band bitstream 1264 to the receiver of the second device 1206.

According to one implementation, the method 1800 may include generating a first downsampled signal by downsampling the frequency-domain reference channel and generating a second downsampled signal by downsampling the frequency-domain target channel. The method 1800 may also include determining comparison values based on the first downsampled signal and a plurality of phase shift values applied to the second downsampled signal. The mismatch may be based on the comparison values.

According to another implementation, the method 1800 includes performing a zero-padding operation on the frequency-domain target channel prior to performing the second transform operation. The zero-padding operation may be performed on two sides of the window of the target channel. According to another implementation, the zero-padding operation may be performed on a single side of the window of the target channel. According to another implementation, the zero-padding operation may be asymmetrically performed on either side of the window of the target channel. In each implementation, the same windowing scheme may also be used for the reference channel.

The method 1800 of FIG. 18 may enable the frequency-domain stereo coder 1209 to generate the stereo parameters 1262, the side-band bitstream 1264, and the mid-band bitstream 1266. The phase-shifting techniques of the frequency-domain shifter 1214 may be implemented in conjunction with frequency-domain signal processing. To illustrate, frequency-domain shifter 1214 estimates a shift (e.g., a non-casual shift value) for each frame at the encoder 1214, shifts (e.g., adjusts) a target channel according to the non-casual shift value, and uses the shift adjusted channels for the stereo parameters estimation in the transform-domain.

Figure 19:
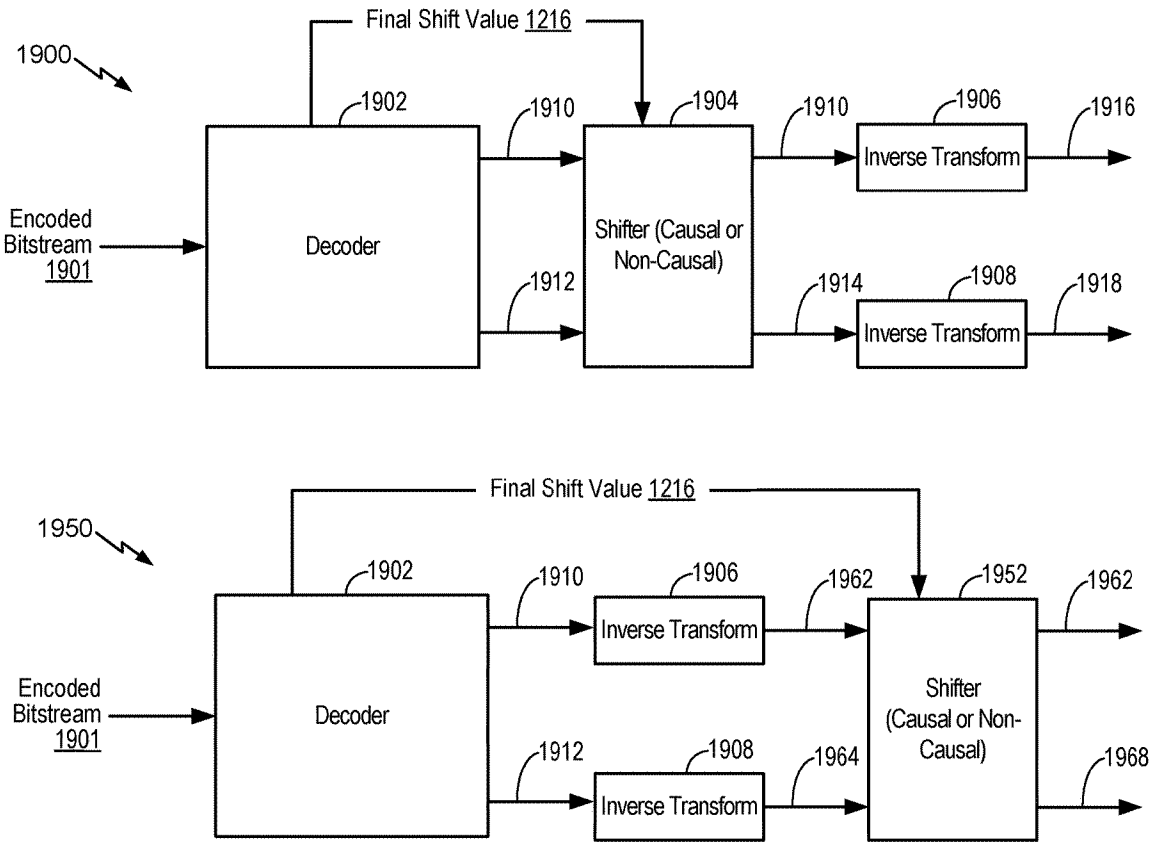
FIG. 19 illustrates decoding systems operable to decode audio signals.

Referring to FIG. 19, a first decoder system 1900 and a second decoder system 1950 are shown. The first decoder system 1900 includes a decoder 1902, a shifter 1904 (e.g., a causal shifter or a non-causal shifter), inverse transform circuitry 1906, and inverse transform circuitry 1908. The second decoder system 1950 includes the decoder 1902, the inverse transform circuitry 1906, the inverse transform circuitry 1908, and a shifter 1952 (e.g., a causal shifter or a non-causal shifter). According to one implementation, the first decoder system 1900 may correspond to the decoder 1218 of FIG. 12. According to another implementation, the second decoder system 1950 may correspond to the decoder 1218 of FIG. 12.

An encoded bitstream 1901 may be provided to the decoder 1902. The encoded bitstream 1901 may include the stereo parameters 1262, the side-band bitstream 1264, the mid-band bitstream 1266, the frequency-domain downmix parameters 1268, the final shift value 1216, etc. The final shift value 1216 received at the decoder systems 1900, 1950 may be a non-negative shift value multiplexed with a channel indicator (e.g., a target channel indicator) or a single shift value representative of a negative or non-negative shift. The decoder 1902 may be configured to decode a mid-band channel and a side-band channel based on the encoded bitstream 1901. The decoder 1902 may also be configured to perform DFT analysis on the mid-band channel and the side-band channel. The decoder 1902 may decode the stereo parameters 1262.

The decoder 1902 may decode the encoded bitstream 1901 to generate a decoded frequency-domain left channel 1910 and a decoded frequency-domain right channel 1912. It should be noted that the decoder 1902 is configured to perform operations closely corresponding to the inverse operations of the encoder until prior to the non-causal shifting operation. Thus, the decoded frequency-domain left channel 1910 and the decoded frequency-domain right channel 1912 may, in some implementations, correspond to the encoder side frequency domain reference channel (1290) and the encoder side frequency domain adjusted target channel (1292), or vice versa; while in other implementations, the decoded frequency-domain left channel 1910 and the decoded frequency-domain right channel 1912 may correspond to the frequency transformed versions of the encoder side time domain reference channel (190) and the encoder side time domain adjusted target channel (192), or vice versa. The decoded frequency-domain left channel 1910 and the decoded frequency-domain right channel 1912 may be provided to the shifter 1904 (e.g., the causal shifter). The decoder 1902 may also determine the final shift value 1216 based on the encoded bitstream 1901. The final shift value may be the mismatch value indicative of a phase shift between a reference channel (e.g., the first audio signal 1230) and a target channel (e.g., the second audio signal 1232). The final shift value 1216 may correspond to a temporal shift. The final shift value 1216 may be provided to the causal shifter 1904.

The shifter 1904 (e.g., the causal shifter) may be configured to determine, based on a target channel indicator of the final shift value 1216, whether the decoded frequency-domain left channel 1910 is the target channel or the reference channel. Similarly, the shifter 1904 may be configured to determine, based on the target channel indicator of the final shift value 1216, whether the decoded frequency-domain right channel 1912 is the target channel or the reference channel. For ease of illustration, the decoded frequency-domain right channel 1912 is described as the target channel. However, it should be understood that in other implementations (or for other frames), the decoded frequency-domain left channel 1910 may be the target channel and the shifting operations described below may be performed on the decoded frequency-domain left channel 1910.

The shifter 1904 may be configured to perform a frequency-domain shift operation (e.g., a causal shift operation) on the decoded frequency-domain right channel 1912 (e.g., the target channel in the illustrated example) based on the final shift value 1216 to generate an adjusted decoded frequency-domain target channel 1914. The adjusted decoded frequency-domain target channel 1914 may be provided to the inverse transform circuitry 1908. The causal shifter 1904 may bypass shifting operations on the decoded frequency-domain left channel 1910 based on the target channel indicator associated with the final shift value 1216. For example, the final shift value 1216 may indicate that the target channel (e.g., the channel on which to perform the frequency-domain causal shift) is the decoded frequency-domain right channel 1912. The decoded frequency-domain left channel 1910 may be provided to the inverse transform circuitry 1906.

The inverse transform circuitry 1906 may be configured to perform a first inverse transform operation on the decoded frequency-domain left channel 1910 to generate a decoded time-domain left channel 1916. According to one implementation, the decoded time-domain left channel 1916 may correspond to the first output signal 1226 of FIG. 12. The inverse transform circuitry 1908 may be configured to perform a second inverse transform operation on the adjusted decoded frequency-domain target channel 1914 to generate an adjusted decoded time-domain target channel 1918 (e.g., a time-domain right channel). According to one implementation, the adjusted decoded time-domain target channel 1918 may correspond to the second output signal 1228 of FIG. 12.

At the second decoder system 1950, the decoded frequency-domain left channel 1910 may be provided to the inverse transform circuitry 1906, and the decoded frequency-domain right channel 1912 may be provided to the inverse transform circuitry 1908. The inverse transform circuitry 1906 may be configured to perform a first inverse transform operation on the decoded frequency-domain left channel 1910 to generate a decoded time-domain left channel 1962. The inverse transform circuitry 1908 may be configured to perform a second inverse transform operation on the decoded frequency-domain right channel 1912 to generate a decoded time-domain right channel 1964. The decoded time-domain left channel 1962 and the decoded time-domain right channel 1964 may be provided to the shifter 1952.

At the second decoder system 1950, the decoder 1902 may provide the final shift value 1216 to the shifter 1952. The final shift value 1216 may correspond to a phase shift amount and may indicate whether which channel (for each frame) is the reference channel and which channel is the target channel. For example, the shifter 1904 (e.g., the causal shifter) may be configured to determine, based on a target channel indicator of the final shift value 1216, whether the decoded time-domain left channel 1962 is the target channel or the reference channel. Similarly, the shifter 1904 may be configured to determine, based on the target channel indicator of the final shift value 1216, whether the decoded time-domain right channel 1964 is the target channel or the reference channel. For ease of illustration, the decoded time-domain right channel 1964 is described as the target channel. However, it should be understood that in other implementations (or for other frames), the decoded time-domain left channel 1962 may be the target channel and the shifting operations described below may be performed on the decoded time-domain left channel 1962.

The shifter 1952 may perform a time-domain shift operation on the decoded time-domain right channel 1964 based on the final shift value 1216 to generate an adjusted decoded time-domain target channel 1968. The time-domain shift operation may include a non-causal shift or a causal shift. According one implementation, the adjusted decoded time-domain target channel 1968 may correspond to the second output signal 1228 of FIG. 12. The shifter 1952 may bypass shifting operations on the decoded time-domain left channel 1962 based on a target channel indicator associated with the final shift value 1216. The decoded time-domain reference channel 1962 may correspond to the first output signal 1226 of FIG. 12.

Each decoder 118, 1218 and each decoding system 1900, 1950 described herein may be used in conjunction with each encoder 114, 1214 and each encoding system described herein. As a non-limiting example, the decoder 1218 of FIG. 12 may receive a bitstream from the encoder 114 of FIG. 1. In response to receiving the bitstream, the decoder 1218 may perform a phase-rotation operation on the target channel in the frequency-domain to undo a time-shift operation performed in the time-domain at the encoder 114. As another non-limiting example, the decoder 118 of FIG. 1 may receive a bitstream from the encoder 1214 of FIG. 12. In response to receiving the bitstream, the decoder 118 may perform a time-shift operation on the target channel in the time-domain to undo a phase-rotation operation performed in the frequency-domain at the encoder 1214.

Referring to FIG. 20, a first method 2000 of communication and a second method 2020 of communication are shown. The methods 2000, 2020 may be performed by the second device 106 of FIG. 1, the second device 1206 of FIG. 12, the first decoder system 1900 of FIG. 19, the second decoder system 1950 of FIG. 19, or a combination thereof.

The first method 2000 includes receiving, at a first device, an encoded bitstream from a second device, at 2002. The encoded bitstream may include a mismatch value indicative of a shift amount between a reference channel captured at the second device and a target channel captured at the second device. The shift amount may correspond to a temporal shift. For example, referring to FIG. 19, the decoder 1902 may receive the encoded bitstream 1901. The encoded bitstream 1901 may include a mismatch value (e.g., the final shift value 1216) indicative of a shift amount between a reference channel and a target channel. The shift amount may correspond to a temporal shift.

The first method 2000 may also include decoding the encoded bitstream to generate a decoded frequency-domain left channel and a decoded frequency-domain right channel, at 2004. For example, referring to FIG. 19, the decoder 1902 may decode the encoded bitstream 1901 to generate the decoded frequency-domain left channel 1910 and the decoded frequency-domain right channel 1912.

The method 2000 may also include based on a target channel indicator associated with the mismatch value, mapping one of the decoded frequency-domain left channel or the decoded frequency-domain right channel as a decoded frequency-domain target channel and the other as a decoded frequency-domain reference channel, at 2006. For example, referring to FIG. 19, the shifter 1904 maps the decoded frequency-domain left channel 1910 to the decoded frequency-domain reference channel and the decoded-frequency domain right channel 1912 to the decoded frequency-domain target channel. It should be understood that in other implementations or for other frames, the shifter 1904 may map the decoded frequency-domain left channel 1910 to the decoded frequency-domain target channel and the decoded frequency-domain right channel 1912 to the decoded frequency-domain reference channel.

The first method 2000 may also include performing a frequency-domain causal shift operation on the decoded frequency-domain target channel based on the mismatch value to generate an adjusted decoded frequency-domain target channel, at 2008. For example, referring to FIG. 19, the shifter 1904 may perform the frequency-domain causal shift operation on the decoded frequency-domain right channel 1912 (e.g., the decoded frequency-domain target channel) based on the final shift value 1216 to generate the adjusted decoded frequency-domain target channel 1914.

The first method 2000 may also include performing a first inverse transform operation on the decoded frequency-domain reference channel to generate a decoded time-domain reference channel, at 2010. For example, referring to FIG. 19, the inverse transform circuitry 1906 may perform the first inverse transform operation on the decoded frequency-domain left channel 1910 to generate a decoded time-domain reference channel 1916.

The first method 2000 may also include performing a second inverse transform operation on the adjusted decoded frequency-domain target channel to generate an adjusted decoded time-domain target channel, at 2012. For example, referring to FIG. 19, the inverse transform circuitry 1908 may perform the second inverse transform operation on the adjusted decoded frequency-domain target channel 1914 to generate the adjusted decoded time-domain target channel 1918.

The second method 2020 includes receiving an encoded bitstream from a second device, at 2022. The encoded bitstream may include a temporal mismatch value and stereo parameters. The temporal mismatch value and the stereo parameters are determined based on a reference channel captured at the second device and a target channel captured at the second device. For example, referring to FIG. 19, the decoder 1902 may receive the encoded bitstream 1901. The encoded bitstream 1901 may include the temporal mismatch value mismatch value (e.g., the final shift value 1216) and the stereo parameters 1262 (e.g., IPDs and ILDs).

The second method 2020 may also include decoding the encoded bitstream to generate a first frequency-domain output signal and a second frequency-domain output signal, at 2024. For example, referring to FIG. 19, the decoder 1902 may decode the encoded bitstream 1901 to generate the decoded frequency-domain left channel 1910 and the decoded frequency-domain right channel 1912.

The second method 2020 may also include performing a first inverse transform operation on the first frequency-domain output signal to generate a first time-domain signal, at 2026. For example, referring to FIG. 19, the inverse transform circuitry 1906 may perform the first inverse transform operation on the decoded frequency-domain left channel 1910 to generate the decoded time-domain left channel 1962.

The second method 2020 may also include performing a second inverse transform operation on the second frequency-domain output signal to generate a second time-domain signal, at 2028. For example, referring to FIG. 19, the inverse transform circuitry 1908 may perform the second inverse transform operation on the decoded frequency-domain right channel 1912 to generate the decoded time-domain right channel 1964.

The second method 2020 may also include based on the temporal mismatch value, mapping one of the first time-domain signal or the second time-domain signal as a decoded target channel and the other as a decoded reference channel, at 2030. For example, referring to FIG. 19, the shifter 1952 maps the decoded time-domain left channel 1962 as the decoded time-domain reference channel and maps the decoded time-domain right channel 1964 as the decoded time-domain frequency channel. It should be understood that in other implementations or for other frames, the shifter 1904 may map the decoded time-domain left channel 1962 to the decoded time-domain target channel and the decoded time-domain right channel 1964 to the decoded time-domain reference channel.

The second method 2020 may also include performing a causal time-domain shift operation on the decoded target channel based on the temporal mismatch value to generate an adjusted decoded target channel, at 2032. The causal time-domain shift operation performed on the decoded target channel may be based on an absolute value of the temporal mismatch value. For example, referring to FIG. 19, the shifter 1952 may perform the time-domain shift operation on the decoded time-domain right channel 1964 based on the final shift value 1216 to generate an adjusted decoded time-domain target channel 1968. The time-domain shift operation may include a non-causal shift or a causal shift.

The second method 2020 may also include outputting a first output signal and a second output signal, at 2032. The first output signal may be based on the decoded reference channel and the second output signal may be based on the adjusted target channel. For example, referring to FIG. 12, the second device may output the first output signal 1226 and the second output signal 1228.

According to the second method 2020, the temporal mismatch value and the stereo parameters may be determined at the second device (e.g., an encoder-side device) using an encoder-side windowing scheme. The encoder-side windowing scheme may use first windows having a first overlap size, and a decoder-side windowing scheme at the decoder 1218 may use second windows having a second overlap size. The first overlap size is different than the second overlap size. For example, the second overlap size is smaller than the first overlap size. The first windows of the encoder-side windowing scheme have a first amount of zero-padding, and the second windows of the decoder-side windowing scheme have a second amount of zero-padding. The first amount of zero-padding is different than the second amount of zero-padding. For example, the second amount of zero-padding is smaller than the first amount of zero-padding.

According to some implementations, the second method 2020 also includes decoding the encoded bitstream to generate a decoded mid signal and performing a transform operation on the decoded mid signal to generate a frequency-domain decoded mid signal. The second method 2020 may also include performing an up-mix operation on the frequency-domain decoded mid signal to generate the first frequency-domain output signal and the second frequency-domain output signal. The stereo parameters are applied to the frequency-domain decoded mid signal during the up-mix operation. The stereo parameters may include a set of ILD values and a set of IPD values that are estimated based on the reference channel and the target channel at the second device. The set of ILD values and the set of IPD values are transmitted to the decoder-side receiver.

Referring to FIG. 21, a block diagram of a particular illustrative example of a device (e.g., a wireless communication device) is depicted and generally designated 2100. In various embodiments, the device 2100 may have fewer or more components than illustrated in FIG. 21. In an illustrative embodiment, the device 2100 may correspond to the first device 104 of FIG. 1, the second device 106 of FIG. 1, the first device 1204 of FIG. 12, the second device 1206 of FIG. 12, or a combination thereof. In an illustrative embodiment, the device 2100 may perform one or more operations described with reference to systems and methods of FIGS. 1-20.

In a particular embodiment, the device 2100 includes a processor 2106 (e.g., a central processing unit (CPU)). The device 2100 may include one or more additional processors 2110 (e.g., one or more digital signal processors (DSPs)). The processors 2110 may include a media (e.g., speech and music) coder-decoder (CODEC) 2108, and an echo canceller 2112. The media CODEC 2108 may include the decoder 118, the encoder 114, the decoder 1218, the encoder 1214, or a combination thereof. The encoder 114 may include the temporal equalizer 108.

The device 2100 may include a memory 153 and a CODEC 2134. Although the media CODEC 2108 is illustrated as a component of the processors 2110 (e.g., dedicated circuitry and/or executable programming code), in other embodiments one or more components of the media CODEC 2108, such as the decoder 118, the encoder 114, the decoder 1218, the encoder 1214, or a combination thereof, may be included in the processor 2106, the CODEC 2134, another processing component, or a combination thereof.

The device 2100 may include the transmitter 110 coupled to an antenna 2142. The device 2100 may include a display 2128 coupled to a display controller 2126. One or more speakers 2148 may be coupled to the CODEC 2134. One or more microphones 2146 may be coupled, via the input interface(s) 112, to the CODEC 2134. In a particular implementation, the speakers 2148 may include the first loudspeaker 142, the second loudspeaker 144 of FIG. 1, or a combination thereof. In a particular implementation, the microphones 2146 may include the first microphone 146, the second microphone 148 of FIG. 1, the first microphone 1246 of FIG. 12, the second microphone 1248 of FIG. 12, or a combination thereof. The CODEC 2134 may include a digital-to-analog converter (DAC) 2102 and an analog-to-digital converter (ADC) 2104.

The memory 153 may include instructions 2160 executable by the processor 2106, the processors 2110, the CODEC 2134, another processing unit of the device 2100, or a combination thereof, to perform one or more operations described with reference to FIGS. 1-20. The memory 153 may store the analysis data 191.

One or more components of the device 2100 may be implemented via dedicated hardware (e.g., circuitry), by a processor executing instructions to perform one or more tasks, or a combination thereof. As an example, the memory 153 or one or more components of the processor 2106, the processors 2110, and/or the CODEC 2134 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 2160) that, when executed by a computer (e.g., a processor in the CODEC 2134, the processor 2106, and/or the processors 2110), may cause the computer to perform one or more operations described with reference to FIGS. 1-20. As an example, the memory 153 or the one or more components of the processor 2106, the processors 2110, and/or the CODEC 2134 may be a non-transitory computer-readable medium that includes instructions (e.g., the instructions 2160) that, when executed by a computer (e.g., a processor in the CODEC 2134, the processor 2106, and/or the processors 2110), cause the computer perform one or more operations described with reference to FIGS. 1-20.

In a particular embodiment, the device 2100 may be included in a system-in-package or system-on-chip device (e.g., a mobile station modem (MSM)) 2122. In a particular embodiment, the processor 2106, the processors 2110, the display controller 2126, the memory 153, the CODEC 2134, and the transmitter 110 are included in a system-in-package or the system-on-chip device 2122. In a particular embodiment, an input device 2130, such as a touchscreen and/or keypad, and a power supply 2144 are coupled to the system-on-chip device 2122. Moreover, in a particular embodiment, as illustrated in FIG. 21, the display 2128, the input device 2130, the speakers 2148, the microphones 2146, the antenna 2142, and the power supply 2144 are external to the system-on-chip device 2122. However, each of the display 2128, the input device 2130, the speakers 2148, the microphones 2146, the antenna 2142, and the power supply 2144 can be coupled to a component of the system-on-chip device 2122, such as an interface or a controller.

The device 2100 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In conjunction with the disclosed implementations, an apparatus includes means for receiving an encoded bitstream from a second device. The encoded bitstream includes a temporal mismatch value and stereo parameters. The temporal mismatch value and the stereo parameters are determined based on a reference channel captured at the second device and a target channel captured at the second device. For example, the means for receiving may include the second device 1218 of FIG. 12, the decoder 1218 of FIG. 12, the decoder 1902 of FIG. 19, one or more other devices, circuits, or modules.

The apparatus also includes means for decoding the encoded bitstream to generate a first frequency-domain output signal and a second frequency-domain output signal. For example, the means for decoding may include the second device 1218 of FIG. 12, the decoder 1218 of FIG. 12, the decoder 1902 of FIG. 19, the CODEC 2134 of FIG. 21, the processor 2106 of FIG. 21, the processor 2110 of FIG. 21, one or more other devices, circuits, or modules.

The apparatus also includes means for performing a first inverse transform operation on the first frequency-domain output signal to generate a first time-domain signal. For example, the means for performing may include the second device 1218 of FIG. 12, the decoder 1218 of FIG. 12, the inverse transform unit 1906 of FIG. 19, the CODEC 2134 of FIG. 21, the processor 2106 of FIG. 21, the processor 2110 of FIG. 21, one or more other devices, circuits, or modules.

The apparatus also includes means for performing a second inverse transform operation on the second frequency-domain output signal to generate a second time-domain signal. For example, the means for performing may include the second device 1218 of FIG. 12, the decoder 1218 of FIG. 12, the inverse transform unit 1908 of FIG. 19, the CODEC 2134 of FIG. 21, the processor 2106 of FIG. 21, the processor 2110 of FIG. 21, one or more other devices, circuits, or modules.

The apparatus also includes means for means for mapping one of the first time-domain signal or the second time-domain signal as a decoded target channel and the other as a decoded reference channel. For example, the means for mapping may include the second device 1218 of FIG. 12, the decoder 1218 of FIG. 12, the shifter 1952 of FIG. 19, the CODEC 2134 of FIG. 21, the processor 2106 of FIG. 21, the processor 2110 of FIG. 21, one or more other devices, circuits, or modules.

The apparatus also includes means for performing a causal time-domain shift operation on the decoded target channel based on the temporal mismatch value to generate an adjusted decoded target channel. For example, the means for performing may include the second device 1218 of FIG. 12, the decoder 1218 of FIG. 12, the shifter 1952 of FIG. 19, the CODEC 2134 of FIG. 21, the processor 2106 of FIG. 21, the processor 2110 of FIG. 21, one or more other devices, circuits, or modules.

The apparatus also includes means for outputting a first output signal and a second output signal. The first output signal is based on the decoded reference channel and the second output signal is based on the adjusted decoded target channel. For example, the means for outputting may include the second device 1218 of FIG. 12, the decoder 1218 of FIG. 12, the CODEC 2134 of FIG. 21, one or more other devices, circuits, or modules.

Referring to FIG. 22, a block diagram of a particular illustrative example of a base station 2200 is depicted. In various implementations, the base station 2200 may have more components or fewer components than illustrated in FIG. 22. In an illustrative example, the base station 2200 may include the first device 104, the second device 106 of FIG. 1, the first device 1204 of FIG. 12, the second device 1206 of FIG. 12, or a combination thereof. In an illustrative example, the base station 2200 may operate according to the methods described herein.

The base station 2200 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 2100 of FIG. 21.

Various functions may be performed by one or more components of the base station 2200 (and/or in other components not shown), such as sending and receiving messages and data (e.g., audio data). In a particular example, the base station 2200 includes a processor 2206 (e.g., a CPU). The base station 2200 may include a transcoder 2210. The transcoder 2210 may include an audio CODEC 2208 (e.g., a speech and music CODEC). For example, the transcoder 2210 may include one or more components (e.g., circuitry) configured to perform operations of the audio CODEC 2208. As another example, the transcoder 2210 is configured to execute one or more computer-readable instructions to perform the operations of the audio CODEC 2208. Although the audio CODEC 2208 is illustrated as a component of the transcoder 2210, in other examples one or more components of the audio CODEC 2208 may be included in the processor 2206, another processing component, or a combination thereof. For example, the decoder 1218 (e.g., a vocoder decoder) may be included in a receiver data processor 2264. As another example, the encoder 1214 (e.g., a vocoder encoder) may be included in a transmission data processor 2282.

The transcoder 2210 may function to transcode messages and data between two or more networks. The transcoder 2210 is configured to convert message and audio data from a first format (e.g., a digital format) to a second format. To illustrate, the decoder 1218 may decode encoded signals having a first format and the encoder 1214 may encode the decoded signals into encoded signals having a second format. Additionally or alternatively, the transcoder 2210 is configured to perform data rate adaptation. For example, the transcoder 2210 may downconvert a data rate or upconvert the data rate without changing a format the audio data. To illustrate, the transcoder 2210 may downconvert 64 kbit/s signals into 16 kbit/s signals. The audio CODEC 2208 may include the encoder 1214 and the decoder 1218.

The base station 2200 may include a memory 2232. The memory 2232, such as a computer-readable storage device, may include instructions. The instructions may include one or more instructions that are executable by the processor 2206, the transcoder 2210, or a combination thereof, to perform the methods described herein. The base station 2200 may include multiple transmitters and receivers (e.g., transceivers), such as a first transceiver 2252 and a second transceiver 2254, coupled to an array of antennas. The array of antennas may include a first antenna 2242 and a second antenna 2244. The array of antennas is configured to wirelessly communicate with one or more wireless devices, such as the device 2100 of FIG. 21. For example, the second antenna 2244 may receive a data stream 2214 (e.g., a bitstream) from a wireless device. The data stream 2214 may include messages, data (e.g., encoded speech data), or a combination thereof.

The base station 2200 may include a network connection 2260, such as backhaul connection. The network connection 2260 is configured to communicate with a core network or one or more base stations of the wireless communication network. For example, the base station 2200 may receive a second data stream (e.g., messages or audio data) from a core network via the network connection 2260. The base station 2200 may process the second data stream to generate messages or audio data and provide the messages or the audio data to one or more wireless device via one or more antennas of the array of antennas or to another base station via the network connection 2260. In a particular implementation, the network connection 2260 may be a wide area network (WAN) connection, as an illustrative, non-limiting example. In some implementations, the core network may include or correspond to a Public Switched Telephone Network (PSTN), a packet backbone network, or both.

The base station 2200 may include a media gateway 2270 that is coupled to the network connection 2260 and the processor 2206. The media gateway 2270 is configured to convert between media streams of different telecommunications technologies. For example, the media gateway 2270 may convert between different transmission protocols, different coding schemes, or both. To illustrate, the media gateway 2270 may convert from PCM signals to Real-Time Transport Protocol (RTP) signals, as an illustrative, non-limiting example. The media gateway 2270 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 2270 may include a transcoder, such as the transcoder 2210, and is configured to transcode data when codecs are incompatible. For example, the media gateway 2270 may transcode between an Adaptive Multi-Rate (AMR) codec and a G.711 codec, as an illustrative, non-limiting example. The media gateway 2270 may include a router and a plurality of physical interfaces. In some implementations, the media gateway 2270 may also include a controller (not shown). In a particular implementation, the media gateway controller may be external to the media gateway 2270, external to the base station 2200, or both. The media gateway controller may control and coordinate operations of multiple media gateways. The media gateway 2270 may receive control signals from the media gateway controller and may function to bridge between different transmission technologies and may add service to end-user capabilities and connections.

The base station 2200 may include a demodulator 2262 that is coupled to the transceivers 2252, 2254, the receiver data processor 2264, and the processor 2206, and the receiver data processor 2264 may be coupled to the processor 2206. The demodulator 2262 is configured to demodulate modulated signals received from the transceivers 2252, 2254 and to provide demodulated data to the receiver data processor 2264. The receiver data processor 2264 is configured to extract a message or audio data from the demodulated data and send the message or the audio data to the processor 2206.

The base station 2200 may include a transmission data processor 2282 and a transmission multiple input-multiple output (MIMO) processor 2284. The transmission data processor 2282 may be coupled to the processor 2206 and the transmission MIMO processor 2284. The transmission MIMO processor 2284 may be coupled to the transceivers 2252, 2254 and the processor 2206. In some implementations, the transmission MIMO processor 2284 may be coupled to the media gateway 2270. The transmission data processor 2282 is configured to receive the messages or the audio data from the processor 2206 and to code the messages or the audio data based on a coding scheme, such as CDMA or orthogonal frequency-division multiplexing (OFDM), as an illustrative, non-limiting examples. The transmission data processor 2282 may provide the coded data to the transmission MIMO processor 2284.

The coded data may be multiplexed with other data, such as pilot data, using CDMA or OFDM techniques to generate multiplexed data. The multiplexed data may then be modulated (i.e., symbol mapped) by the transmission data processor 2282 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 2206.

The transmission MIMO processor 2284 is configured to receive the modulation symbols from the transmission data processor 2282 and may further process the modulation symbols and may perform beamforming on the data. For example, the transmission MIMO processor 2284 may apply beamforming weights to the modulation symbols. The beamforming weights may correspond to one or more antennas of the array of antennas from which the modulation symbols are transmitted.

During operation, the second antenna 2244 of the base station 2200 may receive a data stream 2214. The second transceiver 2254 may receive the data stream 2214 from the second antenna 2244 and may provide the data stream 2214 to the demodulator 2262. The demodulator 2262 may demodulate modulated signals of the data stream 2214 and provide demodulated data to the receiver data processor 2264. The receiver data processor 2264 may extract audio data from the demodulated data and provide the extracted audio data to the processor 2206.

The processor 2206 may provide the audio data to the transcoder 2210 for transcoding. The decoder 1218 of the transcoder 2210 may decode the audio data from a first format into decoded audio data and the encoder 1214 may encode the decoded audio data into a second format. In some implementations, the encoder 1214 may encode the audio data using a higher data rate (e.g., upconvert) or a lower data rate (e.g., downconvert) than received from the wireless device. In other implementations, the audio data may not be transcoded. Although transcoding (e.g., decoding and encoding) is illustrated as being performed by a transcoder 2210, the transcoding operations (e.g., decoding and encoding) may be performed by multiple components of the base station 2200. For example, decoding may be performed by the receiver data processor 2264 and encoding may be performed by the transmission data processor 2282. In other implementations, the processor 2206 may provide the audio data to the media gateway 2270 for conversion to another transmission protocol, coding scheme, or both. The media gateway 2270 may provide the converted data to another base station or core network via the network connection 2260.

Encoded audio data generated at the encoder 1214, such as transcoded data, may be provided to the transmission data processor 2282 or the network connection 2260 via the processor 2206. The transcoded audio data from the transcoder 2210 may be provided to the transmission data processor 2282 for coding according to a modulation scheme, such as OFDM, to generate the modulation symbols. The transmission data processor 2282 may provide the modulation symbols to the transmission MIMO processor 2284 for further processing and beamforming. The transmission MIMO processor 2284 may apply beamforming weights and may provide the modulation symbols to one or more antennas of the array of antennas, such as the first antenna 2242 via the first transceiver 2252. Thus, the base station 2200 may provide a transcoded data stream 2216, that corresponds to the data stream 2214 received from the wireless device, to another wireless device. The transcoded data stream 2216 may have a different encoding format, data rate, or both, than the data stream 2214. In other implementations, the transcoded data stream 2216 may be provided to the network connection 2260 for transmission to another base station or a core network.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device comprising:

a receiver configured to receive an encoded bitstream from a second device, the encoded bitstream including a temporal mismatch value and stereo parameters, wherein the temporal mismatch value and the stereo parameters are determined based on a reference channel captured at the second device and a target channel captured at the second device;

a decoder configured to:

decode the encoded bitstream to generate a first frequency-domain output signal and a second frequency-domain output signal;

perform a first inverse transform operation on the first frequency-domain output signal to generate a first time-domain signal;

perform a second inverse transform operation on the second frequency-domain output signal to generate a second time-domain signal;

based on the temporal mismatch value, map one of the first time-domain signal or the second time-domain signal as a decoded target channel;

map the other of the first time-domain signal or the second time-domain signal as a decoded reference channel; and perform a causal time-domain shift operation on the decoded target channel based on the temporal mismatch value to generate an adjusted decoded target channel; and an output device configured to output a first output signal and a second output signal, the first output signal based on the decoded reference channel and the second output signal based on the adjusted decoded target channel.

2. The device of claim 1, wherein, at the second device, the temporal mismatch value and the stereo parameters are determined using an encoder-side windowing scheme.

3. The device of claim 2, wherein the encoder-side windowing scheme uses first windows having a first overlap size, and wherein a decoder-side windowing scheme at the decoder uses second windows having a second overlap size.

4. The device of claim 3, wherein the first overlap size is different than the second overlap size.

5. The device of claim 4, wherein the second overlap size is smaller than the first overlap size.

6. The device of claim 2, wherein the encoder-side windowing scheme uses first windows having a first amount of zero-padding, and wherein a decoder-side windowing scheme at the decoder uses second windows having a second amount of zero-padding.

7. The device of claim 6, wherein the first amount of zero-padding is different than the second amount of zero-padding.

8. The device of claim 7, wherein the second amount of zero-padding is smaller than the first amount of zero-padding.

9. The device of claim 1, wherein the stereo parameters include a set of inter-channel level difference (ILD) values and a set of inter-channel phase difference (IPD) values that are estimated based on the reference channel and the target channel at the second device.

10. The device of claim 9, wherein the set of ILD values and the set of IPD values are transmitted to the receiver.

11. The device of claim 1, wherein the causal time-domain shift operation performed on the decoded target channel is based on an absolute value of the temporal mismatch value.

12. The device of claim 1, further comprising:

a stereo decoder configured to decode the encoded bitstream to generate a decoded mid signal;

a transform unit configured to perform a transform operation on the decoded mid signal to generate a frequency-domain decoded mid signal; and an up-mixer configured to perform an up-mix operation on the frequency-domain decoded mid signal to generate the first frequency-domain output signal and the second frequency-domain output signal, the stereo parameters applied to the frequency-domain decoded mid signal during the up-mix operation.

13. The device of claim 1, wherein the receiver, the decoder, and the output device are integrated into a mobile device.

14. The device of claim 1, wherein the receiver, the decoder, and the output device are integrated into a base station.

15. A method comprising:

receiving, at a receiver of a device, an encoded bitstream from a second device, the encoded bitstream including a temporal mismatch value and stereo parameters, wherein the temporal mismatch value and the stereo parameters are determined based on a reference channel captured at the second device and a target channel captured at the second device;

decoding, at a decoder of the device, the encoded bitstream to generate a first frequency-domain output signal and a second frequency-domain output signal;

performing a first inverse transform operation on the first frequency-domain output signal to generate a first time-domain signal;

performing a second inverse transform operation on the second frequency-domain output signal to generate a second time-domain signal;

based on the temporal mismatch value, mapping one of the first time-domain signal or the second time-domain signal as a decoded target channel;

mapping the other of the first time-domain signal or the second time-domain signal as a decoded reference channel;

performing a causal time-domain shift operation on the decoded target channel based on the temporal mismatch value to generate an adjusted decoded target channel; and outputting a first output signal and a second output signal, the first output signal based on the decoded reference channel and the second output signal based on the adjusted decoded target channel.

16. The method of claim 15, wherein, at the second device, the temporal mismatch value and the stereo parameters are determined using an encoder-side windowing scheme.

17. The method of claim 16, wherein the encoder-side windowing scheme uses first windows having a first overlap size, and wherein a decoder-side windowing scheme at the decoder uses second windows having a second overlap size.

18. The method of claim 17, wherein the first overlap size is different than the second overlap size.

19. The method of claim 18, wherein the second overlap size is smaller than the first overlap size.

20. The method of claim 16, wherein the encoder-side windowing scheme uses first windows having a first amount of zero-padding, and wherein a decoder-side windowing scheme at the decoder uses second windows having a second amount of zero-padding.

21. The method of claim 15, further comprising:

decoding the encoded bitstream to generate a decoded mid signal;

performing a transform operation on the decoded mid signal to generate a frequency-domain decoded mid signal; and performing an up-mix operation on the frequency-domain decoded mid signal to generate the first frequency-domain output signal and the second frequency-domain output signal, the stereo parameters applied to the frequency-domain decoded mid signal during the up-mix operation.

22. The method of claim 15, wherein the causal time-domain shift operation on the decoded target channel is performed at a mobile device.

23. The method of claim 15, wherein the causal time-domain shift operation on the decoded target channel is performed at a base station.

24. A non-transitory computer-readable medium comprising instructions that, when executed by a processor within a decoder, cause the processor to perform operations comprising:

decoding an encoded bitstream received from a second device to generate a first frequency-domain output signal and a second frequency-domain output signal, the encoded bitstream including a temporal mismatch value and stereo parameters, wherein the temporal mismatch value and the stereo parameters are determined based on a reference channel captured at the second device and a target channel captured at the second device;

performing a first inverse transform operation on the first frequency-domain output signal to generate a first time-domain signal;

performing a second inverse transform operation on the second frequency-domain output signal to generate a second time-domain signal;

based on the temporal mismatch value, mapping one of the first time-domain signal or the second time-domain signal as a decoded target channel;

mapping the other of the first time-domain signal or the second time-domain signal as a decoded reference channel;

performing a causal time-domain shift operation on the decoded target channel based on the temporal mismatch value to generate an adjusted decoded target channel; and outputting a first output signal and a second output signal, the first output signal based on the decoded reference channel and the second output signal based on the adjusted decoded target channel.

25. The non-transitory computer-readable medium of claim 24, wherein, at the second device, the temporal mismatch value and the stereo parameters are determined using an encoder-side windowing scheme.

26. The non-transitory computer-readable medium of claim 25, wherein the encoder-side windowing scheme uses first windows having a first overlap size, and wherein a decoder-side windowing scheme at the decoder uses second windows having a second overlap size.

27. The non-transitory computer-readable medium of claim 26, wherein the first overlap size is different than the second overlap size.

28. An apparatus comprising:

means for receiving an encoded bitstream from a second device, the encoded bitstream including a temporal mismatch value and stereo parameters, wherein the temporal mismatch value and the stereo parameters are determined based on a reference channel captured at the second device and a target channel captured at the second device;

means for decoding the encoded bitstream to generate a first frequency-domain output signal and a second frequency-domain output signal;

means for performing a first inverse transform operation on the first frequency-domain output signal to generate a first time-domain signal;

means for performing a second inverse transform operation on the second frequency-domain output signal to generate a second time-domain signal;

based on the temporal mismatch value, means for mapping one of the first time-domain signal or the second time-domain signal as a decoded target channel;

means for mapping the other of the first time-domain signal or the second time-domain signal as a decoded reference channel;

means for performing a causal time-domain shift operation on the decoded target channel based on the temporal mismatch value to generate an adjusted decoded target channel; and means for outputting a first output signal and a second output signal, the first output signal based on the decoded reference channel and the second output signal based on the adjusted decoded target channel.

29. The apparatus of claim 28, wherein the means for performing the causal time-domain shift operation is integrated into a mobile device.

30. The apparatus of claim 28, wherein the means for performing the causal time-domain shift operation is integrated into a base station.

* * * * *